US010875309B2

(12) United States Patent
Arimura et al.

(10) Patent No.: US 10,875,309 B2
(45) Date of Patent: Dec. 29, 2020

(54) LIQUID EJECTING APPARATUS AND MAINTENANCE METHOD FOR LIQUID EJECTING APPARATUS

(71) Applicant: SEIKO EPSON CORPORATION, Tokyo (JP)

(72) Inventors: Toshio Arimura, Shiojiri (JP); Yuji Kanazawa, Shiojiri (JP); Masaaki Ando, Matsumoto (JP); Noritaka Mitsuo, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/553,845

(22) Filed: Aug. 28, 2019

(65) Prior Publication Data

US 2020/0070521 A1 Mar. 5, 2020

(30) Foreign Application Priority Data

Aug. 30, 2018 (JP) ..... 2018-161126

(51) Int. Cl.
*B41J 2/165* (2006.01)
*B41J 2/17* (2006.01)
*B41J 29/17* (2006.01)

(52) U.S. Cl.
CPC ..... *B41J 2/16526* (2013.01); *B41J 2/16523* (2013.01); *B41J 2/16544* (2013.01); *B41J 2/1721* (2013.01); *B41J 29/17* (2013.01)

(58) Field of Classification Search
CPC ..... B41J 2/16526; B41J 2/16523; B41J 2/16544; B41J 2/1721
See application file for complete search history.

(56) References Cited

U.S. PATENT DOCUMENTS

2006/0061620 A1* 3/2006 Tani ..... B41J 2/1721 347/36
2008/0259117 A1 10/2008 Takada
2011/0050800 A1 3/2011 Kamiyama
2012/0062650 A1 3/2012 Kamiyama

FOREIGN PATENT DOCUMENTS

JP H03-227649 A 10/1991
JP H11-105302 A 4/1999
JP 2003-334962 A 11/2003
JP 2007-283658 A 11/2007
JP 2009-073002 A 4/2009
JP 2010-023515 A 2/2010
(Continued)

*Primary Examiner* — Jason S Uhlenhake
(74) *Attorney, Agent, or Firm* — Workman Nydegger

(57) ABSTRACT

A liquid ejecting apparatus includes a liquid ejecting portion configured to eject a first liquid from a nozzle, a liquid receiving portion configured to receive, in a state where a second liquid is accommodated in the liquid receiving portion, for a purpose of maintenance of the liquid ejecting portion, the first liquid discharged from the nozzle, a maintenance portion that maintains a liquid surface of a liquid accommodated in the liquid receiving portion at an upper limit position, and a discharge portion configured to discharge, from a discharge port open to the liquid receiving portion, the liquid accommodated in the liquid receiving portion. The discharge port is positioned below the upper limit position.

9 Claims, 20 Drawing Sheets

(56) References Cited

FOREIGN PATENT DOCUMENTS

| | | | |
|---|---|---|---|
| JP | 2010-125620 | A | 6/2010 |
| JP | 2011-046149 | A | 3/2011 |
| JP | 2011-051116 | A | 3/2011 |
| JP | 2011-088307 | A | 5/2011 |
| JP | 2011-088308 | A | 5/2011 |
| JP | 2011-101956 | A | 5/2011 |
| JP | 2011-126062 | A | 6/2011 |
| JP | 2012-040451 | A | 3/2012 |
| JP | 2012-056207 | A | 3/2012 |
| JP | 2013-060018 | A | 4/2013 |

* cited by examiner

LIQUID EJECTING APPARATUS AND MAINTENANCE METHOD FOR LIQUID EJECTING APPARATUS

The present application is based on, and claims priority from JP Application Serial Number 2018-161126, filed Aug. 30, 2018, the disclosure of which is hereby incorporated by reference herein in its entirety.

BACKGROUND

1. Technical Field

The present disclosure relates to a liquid ejecting apparatus such as a printer and a maintenance method for a liquid ejecting apparatus.

2. Related Art

For example, as disclosed in JP-A-11-105302, there is an image forming apparatus which is an example of a liquid ejecting apparatus which discharges an ink which is an example of a first liquid from an ink jet head to perform printing. The image forming apparatus has a cleaning liquid tank which is an example of a liquid receiving portion which stores a cleaning liquid which is an example of a second liquid. The ink jet head discharges the liquid toward a liquid surface of the cleaning liquid stored in the cleaning liquid tank to perform preliminary discharge.

The image forming apparatus includes a waste liquid receiver for receiving the cleaning liquid overflowing from the cleaning liquid tank. In the image forming apparatus, the cleaning liquid tank is filled with the cleaning liquid, and the position of the liquid surface of the cleaning liquid is aligned with an upper end of the cleaning liquid tank. Therefore, it is difficult to change the position of the liquid surface of the cleaning liquid, and the specification for maintaining the ink jet head is limited.

Such a problem may occur not only in the image forming apparatus including the cleaning liquid tank filled with the cleaning liquid but also in the liquid ejecting apparatus including the liquid receiving portion which accommodates the liquid.

SUMMARY

According to an aspect of the present disclosure, there is provided a liquid ejecting apparatus including: a liquid ejecting portion configured to eject a first liquid from a nozzle; a liquid receiving portion configured to receive, in a state where a second liquid is accommodated in the liquid receiving portion, for a purpose of maintenance of the liquid ejecting portion, the first liquid discharged from the nozzle; a maintenance portion that maintains a liquid surface of a liquid accommodated in the liquid receiving portion at an upper limit position; and a discharge portion configured to discharge, from a discharge port open to the liquid receiving portion, the liquid accommodated in the liquid receiving portion. The discharge port is positioned below the upper limit position.

According to another aspect of the present disclosure, there is provided a maintenance method for a liquid ejecting apparatus, the apparatus including a liquid ejecting portion configured to eject a first liquid from a nozzle, and a liquid receiving portion configured to receive, in a state where a second liquid is accommodated in the liquid receiving portion, for a purpose of maintenance of the liquid ejecting portion, the first liquid discharged from the nozzle, and the method including an adjustment operation of adjusting a position of a liquid surface of a liquid accommodated in the liquid receiving portion, a liquid discharge operation of discharging the first liquid from the nozzle toward the liquid receiving portion after the adjustment operation, and a waste liquid discharge operation of discharging, from the liquid receiving portion, the liquid in the liquid receiving portion.

DESCRIPTION OF EXEMPLARY EMBODIMENTS

Hereinafter, an embodiment of a liquid ejecting apparatus and a maintenance method for a liquid ejecting apparatus will be described with reference to the drawings. The liquid ejecting apparatus is an ink jet printer which records an image such as a character or a photograph by ejecting ink, which is an example of a first liquid, to a recording medium such as a paper sheet.

Figure 1:
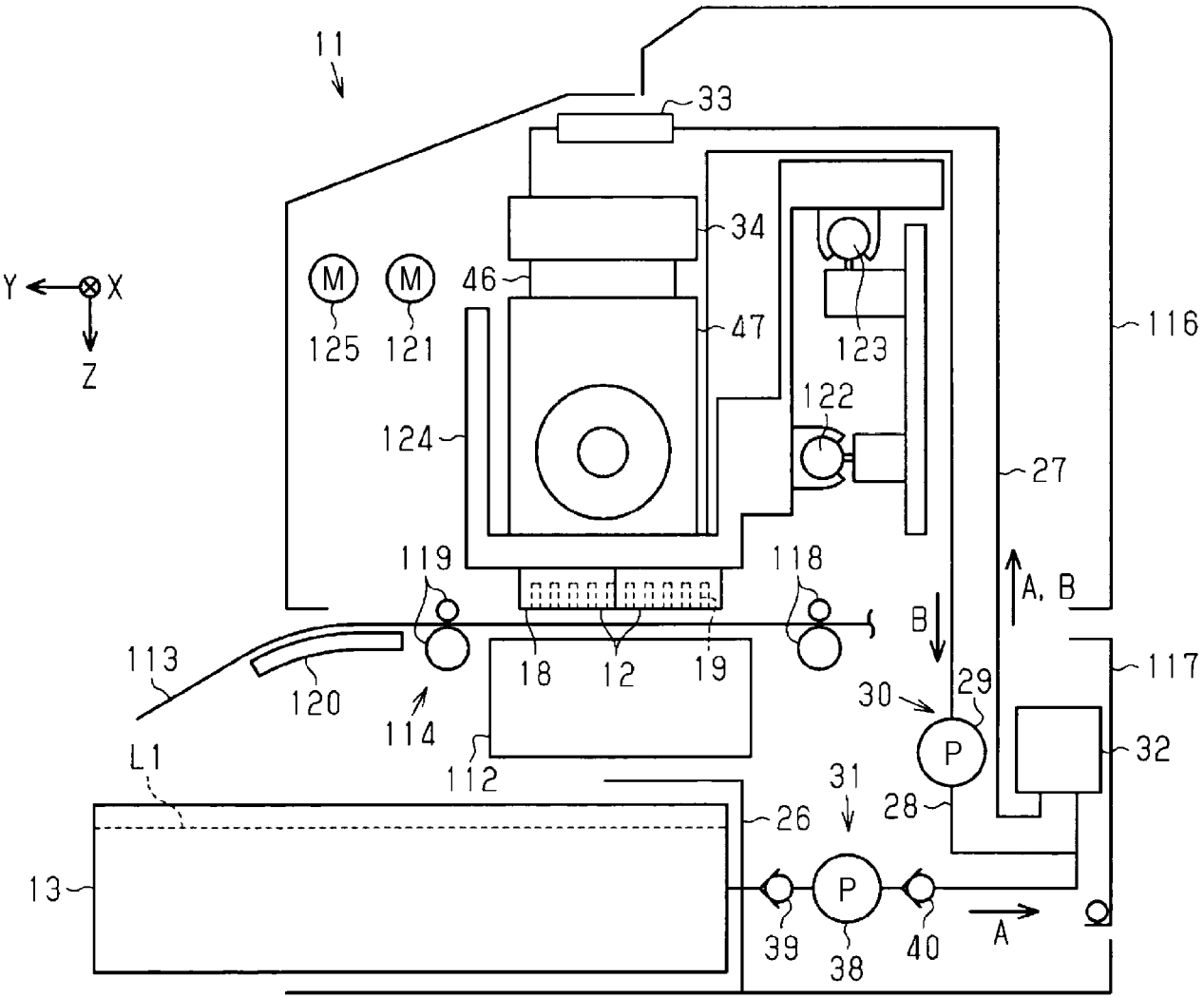
FIG. 1 is a side view schematically illustrating a liquid ejecting apparatus.

As illustrated in FIG. 1, a liquid ejecting apparatus 11 is provided with a liquid ejecting portion 12 that ejects droplets, a supporting table 112 that supports a recording medium 113, and a transport portion 114 that transports the recording medium 113 in a transport direction Y. The liquid ejecting portion 12 ejects a first liquid L1, which is supplied from a liquid supply source 13, to the recording medium 113 in a form of droplets. The liquid ejecting portion 12 ejects the first liquid L1 from a plurality of nozzles 19 formed in a nozzle surface 18.

The liquid ejecting apparatus 11 of the present embodiment is provided with a guide shaft 122 and a guide shaft 123 that extend in a scanning direction X and a carriage 124 that is supported by the guide shaft 122 and the guide shaft 123. The liquid ejecting apparatus 11 is provided with a carriage motor 125 that moves the carriage 124 along the guide shaft 122 and the guide shaft 123. The scanning direction X is a direction different from the transport direction Y and a vertical direction Z. The carriage 124 reciprocates along the guide shaft 122 and the guide shaft 123 in the scanning direction X when the carriage motor 125 is driven.

The liquid ejecting portion 12 is installed in the carriage 124. The liquid ejecting portion 12 is attached to a lower end portion of the carriage 124 which is an end portion in the vertical direction Z. In the present embodiment, two liquid ejecting portions 12 are attached to the carriage 124. The two liquid ejecting portions 12 are disposed at the lower end portion of the carriage 124 so as to be separated from each other in the scanning direction X by a predetermined distance and to be offset from each other in the transport direction Y by a predetermined distance.

The liquid ejecting apparatus 11 of the present embodiment is configured as a serial type apparatus in which the liquid ejecting portion 12 reciprocates in the scanning direction X. The liquid ejecting apparatus 11 may be configured as a line type apparatus in which the liquid ejecting portion 12 is provided to be long in the scanning direction X.

The supporting table 112 is disposed to face the liquid ejecting portion 12. The supporting table 112 is provided to extend in the scanning direction X. The supporting table 112, the transport portion 114, the guide shaft 122, and the guide shaft 123 are assembled into a main body 116 that is configured of a housing, a frame, and the like. The main body 116 is provided with a cover 117 configured to be opened and closed.

The transport portion 114 includes a pair of transport rollers 118 that is positioned upstream of the supporting table 112 in the transport direction Y and a pair of transport rollers 119 that is positioned downstream of the supporting table 112 in the transport direction Y. The transport portion 114 includes a guide plate 120 that is positioned downstream of the pair of transport rollers 119 in the transport direction Y and that guides the recording medium 113. The transport portion 114 includes a transport motor 121 that causes the pair of transport rollers 118 and the pair of transport rollers 119 to rotate. The pair of transport rollers 118 and the pair of transport rollers 119 transport the recording medium 113 when being rotated with the transport motor 121 being driven in a state where the recording medium 113 is nipped therebetween. At this time, the recording medium 113 is transported along a surface of the supporting table 112 and a surface of the guide plate 120 while being supported by the supporting table 112 and the guide plate 120. The transport direction Y in the present embodiment is such a direction that the recording medium 113 is transported on the supporting table 112.

Figure 2:
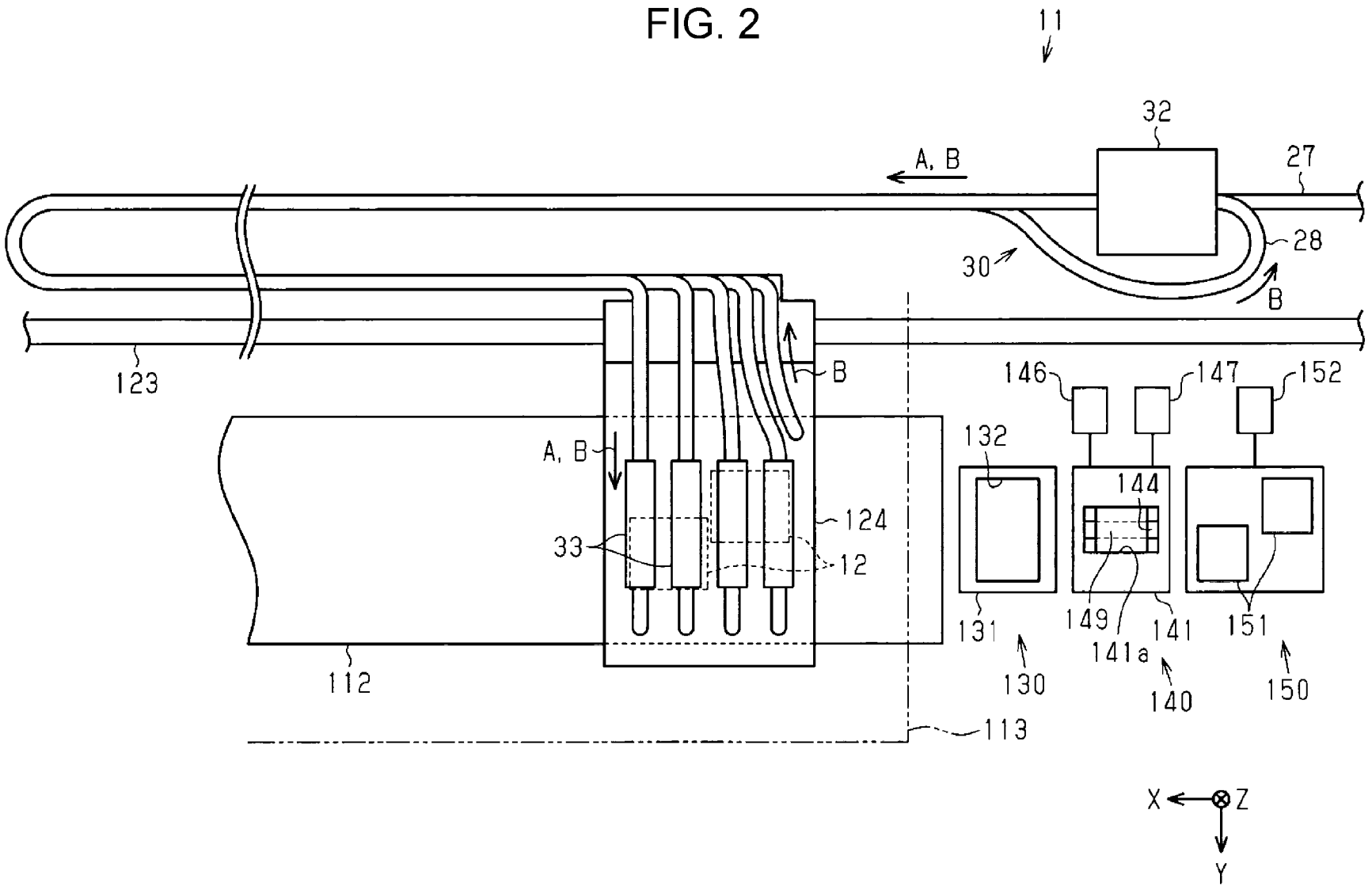
FIG. 2 is a plan view schematically illustrating an internal structure of the liquid ejecting apparatus.

As illustrated in FIG. 2, the liquid ejecting apparatus 11 may be provided with a flushing mechanism 130, a wiping mechanism 140, and a capping mechanism 150. In the present embodiment, the flushing mechanism 130, the wiping mechanism 140, and the capping mechanism 150 are provided in a non-recording region in the liquid ejecting apparatus 11, the non-recording region being a region in which no droplet is ejected to the recording medium 113. The non-recording region in the present embodiment is a region in which the liquid ejecting portion 12 does not face the recording medium 113 in the middle of transportation, that is, a region adjacent to the supporting table 112 in the scanning direction X.

The flushing mechanism 130 includes a liquid receiving portion 131 receiving the first liquid L1 that is ejected from the nozzle 19 of the liquid ejecting portion 12 due to flushing. Flushing is an operation of ejecting droplets not related to recording from the nozzle 19 for the purpose of preventing or resolving clogging or the like in the nozzle 19. The liquid receiving portion 131 is formed in a box shape. The liquid receiving portion 131 includes an opening 132 that is open toward a moving region of the carriage 124. The liquid ejecting portion 12 ejects the droplets toward the opening 132 of the liquid receiving portion 131 when the flushing is performed.

Figure 3:
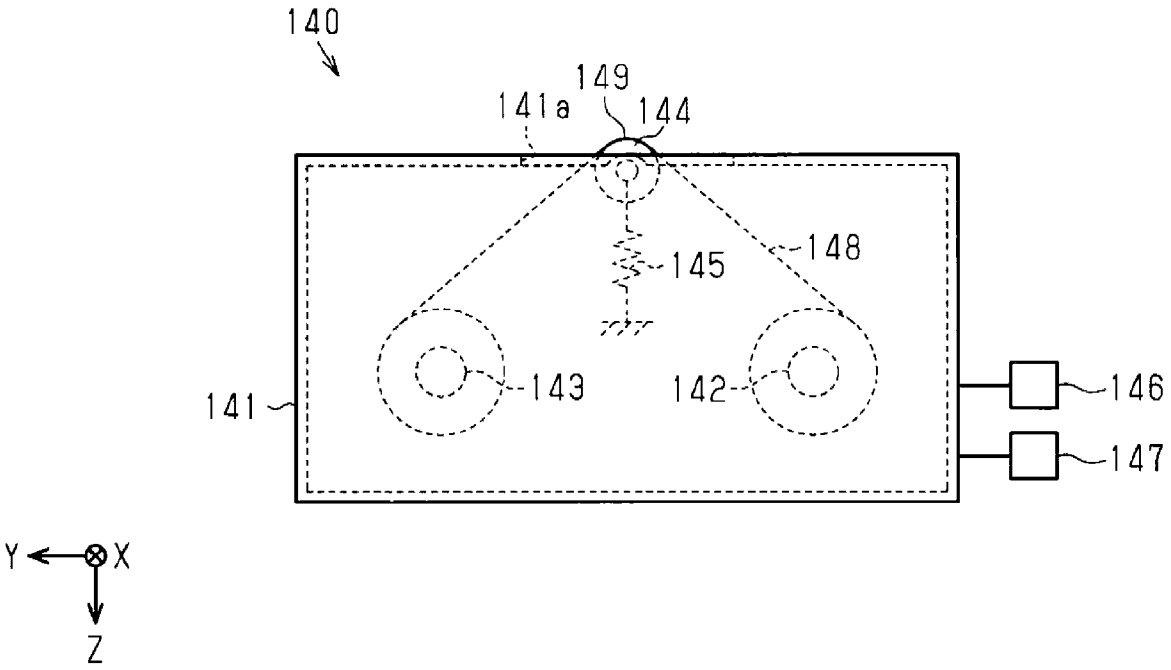
FIG. 3 is a side view of a wiping mechanism.

As illustrated in FIG. 3, the wiping mechanism 140 includes a casing 141, a feed roller 142, a winding roller 143, and an intermediate roller 144. An upper portion of the casing 141 is provided with an opening 141*a*. The feed roller 142 is positioned upstream in the transport direction Y in the casing 141. The winding roller 143 is positioned downstream in the transport direction Y in the casing 141. The intermediate roller 144 is positioned in the casing 141 such that the intermediate roller 144 is exposed through the opening 141*a*.

The wiping mechanism 140 includes a pressing member 145, a first wiper driving portion 146, and a second wiper driving portion 147. The pressing member 145 presses the intermediate roller 144 against the outside of the casing 141. When the first wiper driving portion 146 is driven, the casing 141 moves in the transport direction Y. When the second wiper driving portion 147 is driven, the casing 141 moves in the vertical direction Z. When the second wiper driving portion 147 moves the casing 141 in the vertical direction Z, a gap between the casing 141 and the nozzle surface 18 in the vertical direction Z is adjusted.

The feed roller 142, the winding roller 143, and the intermediate roller 144 are configured to rotate and are supported by the casing 141 such that axial directions thereof become the same as one another. A fabric wiper 148 configured to absorb the first liquid L1 is wound around the feed roller 142 in a roll shape. When the feed roller 142 rotates, the fabric wiper 148 is fed from the feed roller 142. The fabric wiper 148 fed from the feed roller 142 is wound on the intermediate roller 144 and wound around the winding roller 143. When the winding roller 143 rotates, the fabric wiper 148 is wound around the winding roller 143.

The wiping mechanism 140 is configured to wipe the nozzle surface 18. Wiping is an operation of wiping the nozzle surface 18 to remove foreign substances such as liquid and dust adhering to the nozzle surface 18. The wiping mechanism 140 wipes the nozzle surface 18 with a wiping portion 149, which is a portion of the fabric wiper 148 that is wound on the intermediate roller 144.

The wiping mechanism 140 wipes the nozzle surface 18 in a state where the liquid ejecting portion 12 is positioned above the wiping mechanism 140. In a case where the wiping mechanism 140 according to the present embodiment performs the wiping, first, the casing 141 moves with the second wiper driving portion 147 being driven and thus the wiping portion 149 comes into contact with the nozzle surface 18. Thereafter, the casing 141 moves with the first wiper driving portion 146 being driven and thus the wiping portion 149 wipes the nozzle surface 18. In this manner, the wiping mechanism 140 wipes the nozzle surface 18.

When the wiping mechanism 140 wipes the nozzle surface 18, the liquid ejecting portion 12 may move relative to the wiping mechanism 140 and both the wiping mechanism 140 and the liquid ejecting portion 12 may move. When the wiping mechanism 140 wipes the nozzle surface 18, the wiping mechanism 140 and the liquid ejecting portion 12 move relative to each other.

When the winding roller 143 is rotated after liquid is absorbed by the wiping portion 149 due to the wiping, a portion of the fabric wiper 148 that has absorbed the liquid is wound. Accordingly, the wiping portion 149 is replaced from a portion of the fabric wiper 148 that has absorbed the liquid to a portion of the fabric wiper 148 that has not absorbed liquid.

As illustrated in FIG. 2, the capping mechanism 150 includes a cap 151 that is configured to cap the nozzle surface 18 and a cap driving portion 152 that lifts and lowers the cap 151. Capping is an operation of bring the cap 151 into contact with the liquid ejecting portion 12 such that a space into which the nozzle 19 is open is formed. The cap 151 caps the nozzle surface 18 to cover an opening of the nozzle 19. Accordingly, it is possible to suppress an increase in viscosity of the first liquid L1 in the nozzle 19, which occurs when the first liquid L1 is dried.

The cap 151 may be configured to form a closed space such that no fluid such as air or liquid enters or exits the cap 151 in a state where the nozzle surface 18 is capped. In this case, it is possible to further inhibit the first liquid L1 in the nozzle 19 from being dried by means of the capping.

The capping mechanism 150 includes a plurality of caps 151 corresponding to the number of liquid ejecting portions 12. In the present embodiment, the capping mechanism 150 includes two caps 151. The capping mechanism 150 caps the nozzle surfaces 18 of the two liquid ejecting portions 12 in a state where the two liquid ejecting portions 12 face the two caps 151.

In a case where the capping mechanism 150 according to the present embodiment performs the capping, the cap driving portion 152 drives the two caps 151 such that the two caps 151 are lifted. Therefore, the two caps 151 come into contact with the nozzle surfaces 18 of the two liquid ejecting portions 12 such that the caps 151 cover the openings of all of the nozzles 19. As a result, the nozzle surfaces 18 of the liquid ejecting portions 12 are capped by the caps 151. That is, each cap 151 is configured to cap a region including all of the nozzles 19 in the nozzle surface 18 of each liquid ejecting portion 12.

When the cap 151 caps the liquid ejecting portion 12, the liquid ejecting portion 12 may move relative to the capping mechanism 150 and both the cap 151 and the liquid ejecting portion 12 may move. When the cap 151 caps the liquid ejecting portion 12, the cap 151 and the liquid ejecting portion 12 move relative to each other. The cap 151 may include an atmosphere opening valve. The atmosphere opening valve is a valve that can cause the inside of the cap 151 and the atmosphere outside the cap 151 to communicate with each other in a state where the nozzle surface 18 is capped by the cap 151. Therefore, when the atmosphere opening valve is opened, a space inside the cap 151 is opened to the atmosphere.

Figure 4:
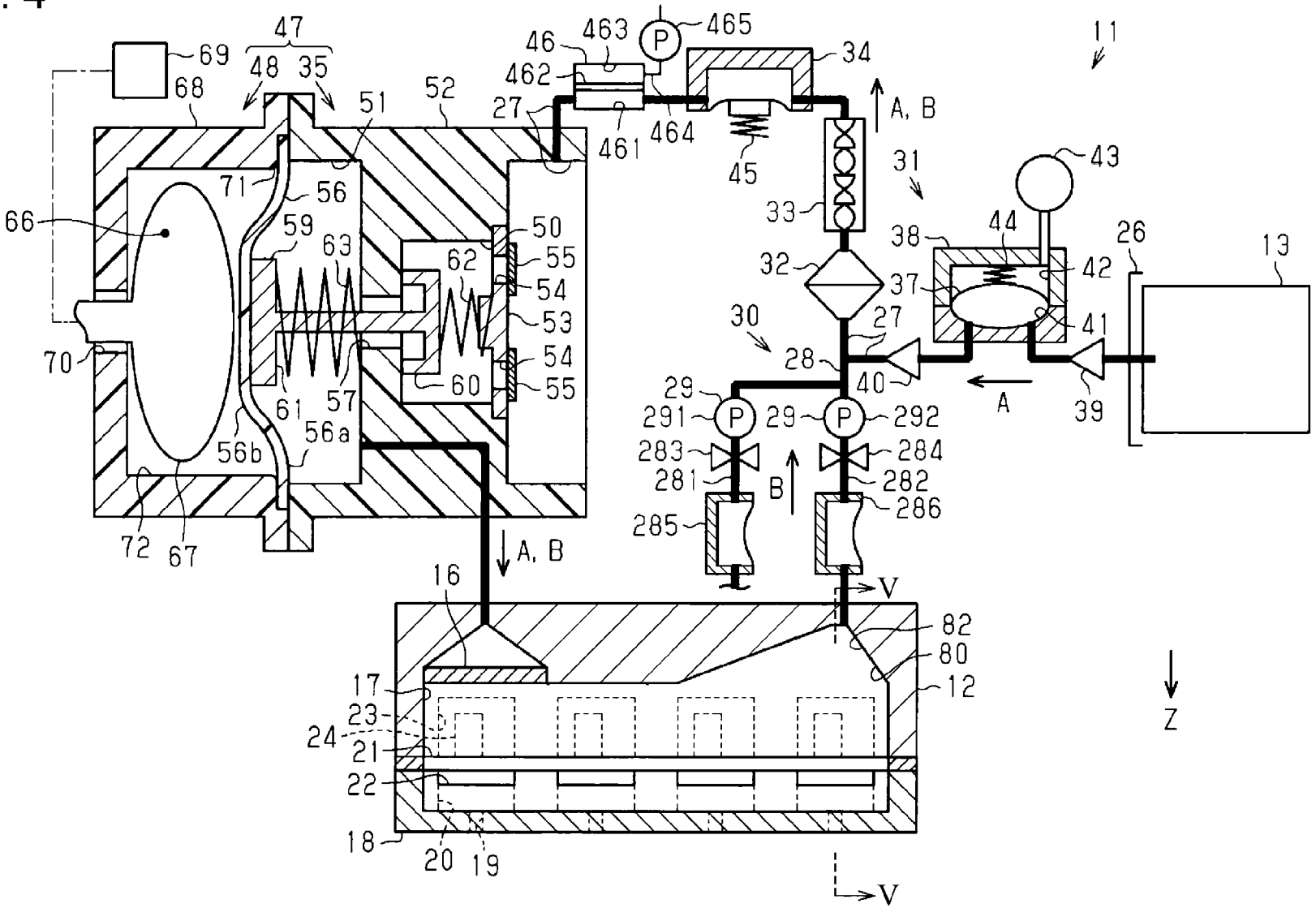
FIG. 4 is a sectional view schematically illustrating a pressure adjustment mechanism with an on-off valve closed and a liquid ejecting portion.

As illustrated in FIG. 4, the liquid ejecting apparatus 11 is provided with a liquid supply flow path 27 through which the first liquid L1 is supplied from the liquid supply source 13 to the liquid ejecting portion 12 and a return flow path 28 through which the first liquid L1 returns to the liquid supply flow path 27 from the liquid ejecting portion 12. The liquid supply flow path 27 is coupled to the liquid supply source 13 and the liquid ejecting portion 12. The liquid supply flow path 27 is a flow path through which the first liquid L1 is supplied from the liquid supply source 13, which is disposed upstream in a supply direction A of the first liquid L1, to the liquid ejecting portion 12, which is disposed downstream in the supply direction A thereof.

The return flow path 28 is coupled to the liquid ejecting portion 12 and the liquid supply flow path 27. The return flow path 28 is coupled to an intermediate portion of the liquid supply flow path 27. The return flow path 28 forms a circulation path 30 for circulation of the first liquid L1 together with the liquid supply flow path 27. That is, the circulation path 30 is configured to include the liquid supply flow path 27 and the return flow path 28. The first liquid L1 flowing through the circulation path 30 circulates through the liquid ejecting portion 12, the liquid supply flow path 27, and the return flow path 28. The return flow path 28 is provided with a circulation pump 29 that circulates the first liquid L1. The circulation pump 29 causes the first liquid L1 to flow in a circulation direction B.

The liquid supply source 13 is, for example, a container configured to accommodate the first liquid L1. The liquid supply source 13 may be a replaceable cartridge or a tank to which the first liquid L1 can be refilled. A plurality of liquid supply sources 13, a plurality of liquid supply flow paths 27, and a plurality of return flow paths 28 are provided corresponding to the type of the first liquid L1 to be ejected from the liquid ejecting portion 12. In the present embodiment, four liquid supply sources 13, four liquid supply flow paths 27, and four return flow paths 28 are provided. The liquid ejecting apparatus 11 may be provided with a mounting portion 26 on which the liquid supply source 13 is mounted.

Figure 5:
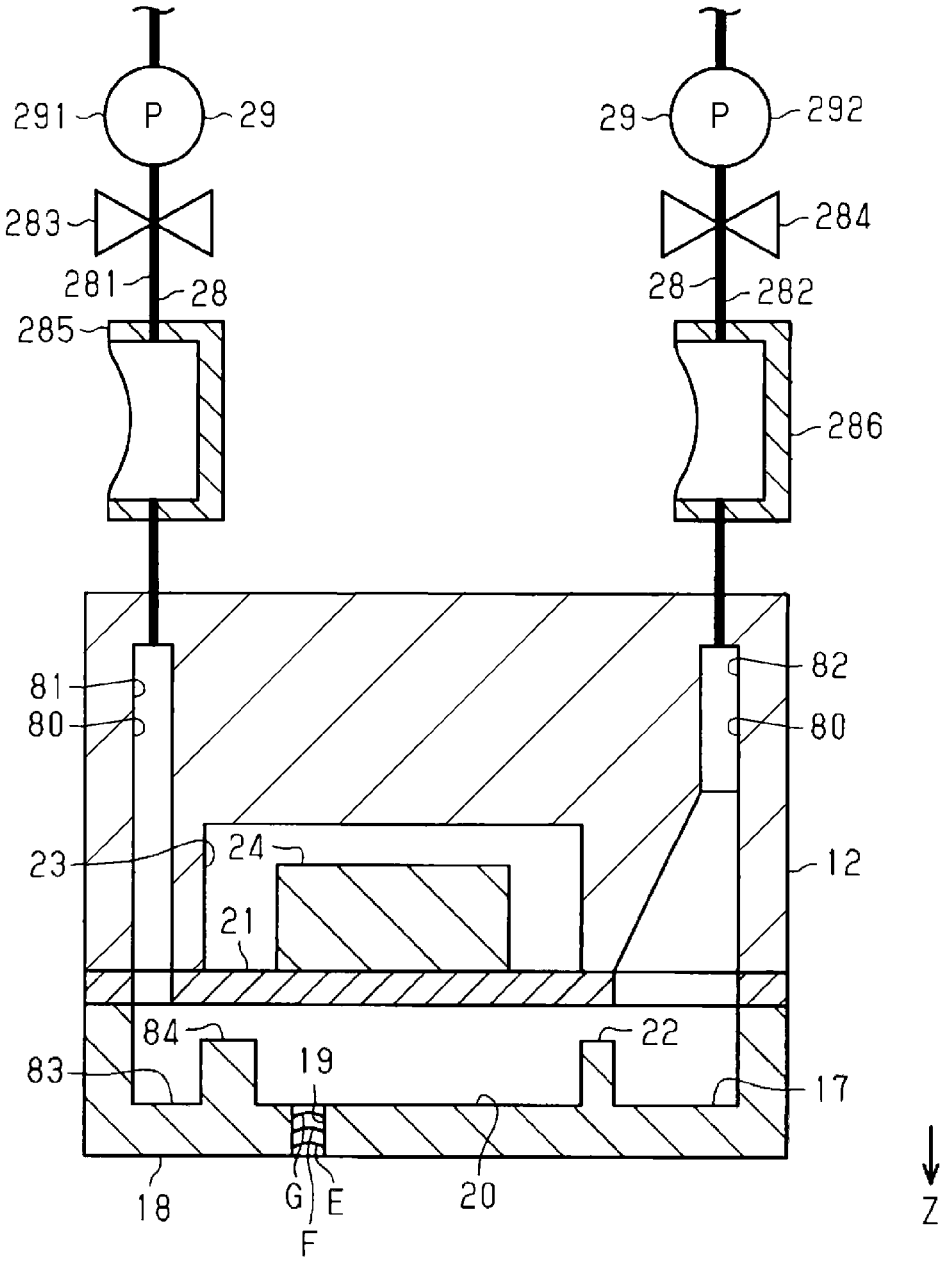
FIG. 5 is a sectional view taken along line V-V in FIG. 4.

As illustrated in FIGS. 4 and 5, the liquid ejecting portion 12 is provided with a common liquid chamber 17 into which the first liquid L1 is supplied. The first liquid L1 is supplied to the common liquid chamber 17 from the liquid supply source 13 via the liquid supply flow path 27. The liquid supply flow path 27 is coupled to the common liquid chamber 17. The common liquid chamber 17 may be provided with a filter 16 that captures air bubbles, foreign substances, or the like in the first liquid L1 supplied to the common liquid chamber 17. The common liquid chamber 17 stores the first liquid L1 passing through the filter 16.

The liquid ejecting portion 12 is provided with a plurality of pressure chambers 20 communicating with the common liquid chamber 17. The nozzles 19 are provided corresponding to the plurality of pressure chambers 20. The pressure chamber 20 communicates with the common liquid chamber 17 and the nozzle 19. A portion of a wall surface of the pressure chamber 20 is formed by a vibration plate 21. The common liquid chamber 17 and the pressure chamber 20 communicate with each other via a supply side communication path 22.

The liquid ejecting portion 12 is provided with a plurality of actuators 24 provided corresponding to the plurality of pressure chambers 20. The actuator 24 is provided on a surface of the vibration plate 21 that is opposite to a portion facing the pressure chamber 20. The actuator 24 is accommodated in an accommodation chamber 23 disposed at a different position from that of the common liquid chamber 17. The liquid ejecting portion 12 ejects the first liquid L1 in the pressure chamber 20 from the nozzle 19 in a form of droplets by driving the actuator 24. The liquid ejecting portion 12 performs a recording process on the recording medium 113 by ejecting droplets to the recording medium 113 from the nozzle 19.

In the present embodiment, a piezoelectric element which shrinks when a drive voltage is applied thereto constitutes the actuator 24. When application of a drive voltage to the actuator 24 is stopped after the vibration plate 21 is deformed by the actuator 24 shrinking due to the drive voltage application, the first liquid L1 in the pressure chamber 20 changed in volume is ejected from the nozzle 19 in a form of droplets.

The liquid ejecting portion 12 includes a discharge flow path 80 through which the first liquid L1 in the liquid ejecting portion 12 is discharged to the outside without passing through the nozzle 19. The discharge flow path 80 is provided with a first discharge flow path 81 that is coupled to the pressure chamber 20 such that the first liquid L1 in the pressure chamber 20 is discharged to the outside. The first liquid L1 flowing through the first discharge flow path 81 is discharged to the outside of the pressure chamber 20 from the pressure chamber 20 without passing through the nozzle 19.

The liquid ejecting portion 12 may include a discharge liquid chamber 83 communicating with the plurality of pressure chambers 20 and the first discharge flow path 81. In this case, the first discharge flow path 81 communicates with the plurality of pressure chambers 20 via the discharge liquid chamber 83. That is, the first discharge flow path 81 is indirectly coupled to the pressure chambers 20. The pressure chambers 20 and the discharge liquid chamber 83 communicate with each other via a discharge side communication path 84. Since the discharge liquid chamber 83 is provided, it is sufficient that one first discharge flow path 81 is provided for the plurality of pressure chambers 20. That is, since the discharge liquid chamber 83 is provided, it is not necessary to provide the first discharge flow path 81 for each pressure chamber 20. Therefore, it is possible to simplify a configuration of the liquid ejecting portion 12. The liquid ejecting portion 12 may include a plurality of first discharge flow paths 81 corresponding to the plurality of pressure chambers 20.

The liquid ejecting portion 12 may include a second discharge flow path 82 that is coupled to the common liquid chamber 17 and the return flow path 28 such that the first liquid L1 in the common liquid chamber 17 is discharged to the outside without passing through the pressure chamber 20. In this case, the discharge flow path 80 is provided with the first discharge flow path 81 and the second discharge flow path 82. That is, the liquid ejecting portion 12 includes the first discharge flow path 81 and the second discharge flow path 82. The first discharge flow path 81 is the discharge flow path 80 coupled to the pressure chamber 20. The second discharge flow path 82 is the discharge flow path 80 coupled to the common liquid chamber 17.

The return flow path 28 may be provided with a first return flow path 281 coupled to the first discharge flow path 81 and a second return flow path 282 coupled to the second discharge flow path 82. The return flow path 28 in the present embodiment is configured such that the first return flow path 281 and the second return flow path 282 join to each other. The return flow path 28 may be configured such that the first return flow path 281 and the second return flow path 282 do not join to each other and may be configured such that each of the first return flow path and the second return flow path is coupled to the liquid supply flow path 27.

In the present embodiment, the circulation pump 29 is provided for each of the first return flow path 281 and the second return flow path 282. The first return flow path 281 is provided with a first circulation pump 291 as the circulation pump 29. The second return flow path 282 is provided with a second circulation pump 292 as the circulation pump 29.

The first return flow path 281 may be provided with a first on-off valve 283. In the first return flow path 281, the first on-off valve 283 is positioned between the first circulation pump 291 and the liquid ejecting portion 12. When the first circulation pump 291 is driven with the first on-off valve 283 opened, the first liquid L1 flows through the first return flow path 281 from the pressure chamber 20 to the liquid supply flow path 27 via the discharge liquid chamber 83.

The second return flow path 282 may be provided with a second on-off valve 284. In the second return flow path 282, the second on-off valve 284 is positioned between the second circulation pump 292 and the liquid ejecting portion 12. When the second circulation pump 292 is driven with the second on-off valve 284 opened, the first liquid L1 flows through the second return flow path 282 from the common liquid chamber 17 to the liquid supply flow path 27.

Only one circulation pump 29 may be provided in the first return flow path 281 and the second return flow path 282. In this case, the circulation pump 29 is disposed between a portion of the return flow path 28 at which the first return flow path 281 and the second return flow path 282 join to each other and a portion of the return flow path 28 at which the return flow path 28 is coupled to the liquid supply flow path 27. In this case, it is possible to cause the first liquid L1 to flow through any of the first return flow path 281 and the second return flow path 282 by controlling the first on-off valve 283 and the second on-off valve 284.

In the first return flow path 281, a first damper 285 may be provided between the liquid ejecting portion 12 and the first on-off valve 283. The first damper 285 is configured to store the first liquid L1. For example, one surface of the first damper 285 is formed of a flexible film and the first damper 285 is configured such that the volume of the first liquid L1 stored in the first damper 285 can be changed. In the second return flow path 282, a second damper 286 having the same configuration as the first damper 285 may be provided between the liquid ejecting portion 12 and the second on-off valve 284. In this case, it is possible to suppress, due to changes in volume of the first damper 285 and the second damper 286, a fluctuation in pressure in the liquid ejecting portion 12 which occurs when the first liquid L1 flows through the first return flow path 281 and the second return flow path 282.

As illustrated in FIG. 4, the liquid supply flow path 27 is provided with a pressurizing mechanism 31, a filter unit 32, a static mixer 33, a liquid storage portion 34, a degasification mechanism 46, and a pressure adjustment device 47. In the liquid supply flow path 27, the pressurizing mechanism 31, the filter unit 32, the static mixer 33, the liquid storage portion 34, the degasification mechanism 46, and the pressure adjustment device 47 are disposed in this order in a direction from an upstream side which is the liquid supply source 13 side to a downstream side which is the liquid ejecting portion 12 side.

The pressurizing mechanism 31 is positioned, on the liquid supply flow path 27, closer to the liquid supply source 13 than a position at which the return flow path 28 is coupled to the liquid supply flow path 27 is. The filter unit 32, the static mixer 33, the liquid storage portion 34, the degasification mechanism 46, and the pressure adjustment device 47 are positioned, on the liquid supply flow path 27, closer to the liquid ejecting portion 12 than a position at which the return flow path 28 is coupled to the liquid supply flow path 27 is.

The pressurizing mechanism 31 causes the first liquid L1 to flow in the supply direction A from the liquid supply source 13 such that the first liquid L1 is supplied to the liquid ejecting portion 12. The pressurizing mechanism 31 is configured to pressurize the first liquid L1 so as to supply the first liquid L1 to the liquid ejecting portion 12. The pressurizing mechanism 31 includes a volume pump 38, a one-way valve 39, and a one-way valve 40. The volume pump 38 is configured to pressurize a predetermined amount of the first liquid L1 by reciprocating a flexible member 37.

The volume pump 38 includes a pump chamber 41 and a negative pressure chamber 42 which are partitioned by the flexible member 37. Furthermore, the volume pump 38 includes a pressure reduction portion 43 that reduces the pressure in the negative pressure chamber 42 and a pressing member 44 that is provided in the negative pressure chamber 42 and presses the flexible member 37 against the pump chamber 41 side.

The one-way valve 39 is positioned upstream of the volume pump 38 in the liquid supply flow path 27. The one-way valve 40 is positioned downstream of the volume pump 38 in the liquid supply flow path 27. The one-way valve 39 and the one-way valve 40 are configured to allow the first liquid L1 to flow to downstream from upstream in the liquid supply flow path 27 and to inhibit the first liquid L1 from flowing to upstream from downstream. That is, the pressurizing mechanism 31 can pressurize the first liquid L1 to be supplied to the pressure adjustment device 47 with the pressing member 44 pressing the first liquid L1 in the pump chamber 41 via the flexible member 37. Accordingly, a pressurizing force at which the pressurizing mechanism 31 pressurizes the first liquid L1 is set by means of a pressing force of the pressing member 44. In this regard, it can be said in the present embodiment that the pressurizing mechanism 31 can pressurize the first liquid L1 in the liquid supply flow path 27.

The filter unit 32 is configured to capture air bubbles, foreign substances, or the like in the first liquid L1. The filter unit 32 is provided to be replaceable. The static mixer 33 is configured to cause changes such as direction turn or division in the flow of the first liquid L1 and reduce concentration bias in the first liquid L1. The liquid storage portion 34 is configured to store the first liquid L1 in a space with variable volume that is pressed by a spring 45 and alleviate a fluctuation in pressure of the first liquid L1.

The degasification mechanism 46 includes a degasification chamber 461 in which the first liquid L1 is temporarily stored, a pressure reduction chamber 463 that is partitioned with respect to the degasification chamber 461 by a degasification film 462, a pressure reduction flow path 464 coupled to the pressure reduction chamber 463, and a pump 465. The degasification film 462 has properties of allowing a gas to pass therethrough and preventing a liquid from passing therethrough. The degasification mechanism 46 decreases, by driving the pump 465, the pressure in the pressure reduction chamber 463 through the pressure reduction flow path 464 such that air bubbles, a resolved gas, and the like mixed in the first liquid L1 stored in the degasification chamber 461 are removed. The degasification mechanism 46 may be configured to increase the pressure in the degasification chamber 461 such that air bubbles, a resolved gas, and the like mixed in the first liquid L1 stored in the degasification chamber 461 are removed.

Next, the pressure adjustment device 47 will be described.

The pressure adjustment device 47 includes a pressure adjustment mechanism 35 that constitutes a portion of the liquid supply flow path 27 and a pressing mechanism 48 that presses the pressure adjustment mechanism 35. The pressure adjustment mechanism 35 includes a main body portion 52, in which a liquid inflow portion 50 into which the first liquid L1 that is supplied from the liquid supply source 13 via the liquid supply flow path 27 flows and a liquid outflow portion 51 that can accommodate the first liquid L1 therein are formed.

The liquid supply flow path 27 and the liquid inflow portion 50 are partitioned by a wall 53 of the main body portion 52 and communicate with each other via through-holes 54 formed in the wall 53. The through-holes 54 are covered by filter members 55. Therefore, the first liquid L1 in the liquid supply flow path 27 flows into the liquid inflow portion 50 while being filtered by the filter members 55.

At least a portion of the wall portion of the liquid outflow portion 51 is configured of a diaphragm 56. A first surface 56*a* of the diaphragm 56, which is an inner surface of the liquid outflow portion 51, receives the pressure of the first liquid L1 in the liquid outflow portion 51. A second surface 56*b* of the diaphragm 56, which is an outer surface of the liquid outflow portion 51, receives atmospheric pressure. Therefore, the diaphragm 56 is displaced corresponding to the pressure in the liquid outflow portion 51. The volume of the liquid outflow portion 51 changes when the diaphragm 56 is displaced. The liquid inflow portion 50 and the liquid outflow portion 51 communicate with each other via a communication path 57.

The pressure adjustment mechanism 35 includes an on-off valve 59 that can switch between a closed state in which a portion between the liquid inflow portion 50 and the liquid outflow portion 51 in via the communication path 57 is blocked and an open state in which the liquid inflow portion 50 and the liquid outflow portion 51 communicate with each other via the communication path 57. The on-off valve 59 illustrated in FIG. 4 is in the closed state. The on-off valve 59 includes a valve portion 60 that can block the communication path 57 and a pressure receiving portion 61 that receives a pressure from the diaphragm 56. The on-off valve 59 moves when the pressure receiving portion 61 is pressed by the diaphragm 56. That is, the pressure receiving portion 61 also functions as a moving member that can move in a state of being in contact with the diaphragm 56 that is displaced in such a direction that the volume of the liquid outflow portion 51 is reduced.

An upstream pressing member 62 is provided in the liquid inflow portion 50. A downstream pressing member 63 is provided in the liquid outflow portion 51. Both the upstream pressing member 62 and the downstream pressing member 63 press the on-off valve 59 in such a direction that the on-off valve 59 is closed. The state of the on-off valve 59 is changed to the open state from the closed state when a pressure applied to the first surface 56*a* is lower than a pressure applied to the second surface 56*b* and a difference between the pressure applied to the first surface 56*a* and the pressure applied to the second surface 56*b* is equal to or greater than a predetermined value. The predetermined value is, for example, 1 kPa.

The predetermined value is a value determined corresponding to the pressing force of the upstream pressing member 62, the pressing force of the downstream pressing member 63, a force required to displace the diaphragm 56, a sealing load which is a pressing force required to block the communication path 57 with the valve portion 60, the pressure in the liquid inflow portion 50 which acts on a surface of the valve portion 60, and the pressure in the liquid outflow portion 51. That is, the predetermined value for switching from the closed state to the open state also increases as the pressing forces of the upstream pressing member 62 and the downstream pressing member 63 increase.

The pressing forces of the upstream pressing member 62 and the downstream pressing member 63 are set such that the pressure in the liquid outflow portion 51 becomes a negative pressure at which a meniscus can be formed on a gas-liquid interface in the nozzle 19. For example, when a pressure applied to the second surface 56*b* is atmospheric pressure, the pressing forces of the upstream pressing member 62 and the downstream pressing member 63 are set such that the pressure in the liquid outflow portion 51 becomes −1 kPa. In this case, the gas-liquid interface is a boundary at which the first liquid L1 and the gas are in contact with each other and the meniscus is a curved liquid surface which is formed when the first liquid L1 comes into contact with the nozzle 19. In addition, it is preferable that a concave meniscus suitable for droplet ejection be formed in the nozzle 19.

In the present embodiment, when the on-off valve 59 in the pressure adjustment mechanism 35 is in the closed state, the pressure of the first liquid L1 positioned upstream of the pressure adjustment mechanism 35 generally becomes a positive pressure due to the pressurizing mechanism 31. Specifically, when the on-off valve 59 is in the closed state, the pressure of the first liquid L1 in the liquid inflow portion 50 and the pressure of the first liquid L1 positioned upstream of the liquid inflow portion 50 generally become a positive pressure due to the pressurizing mechanism 31.

In the present embodiment, when the on-off valve 59 in the pressure adjustment mechanism 35 is in the closed state, the pressure of the first liquid L1 positioned downstream of the pressure adjustment mechanism 35 generally becomes a negative pressure due to the diaphragm 56. Specifically, when the on-off valve 59 is in the closed state, the pressure of the first liquid L1 in the liquid outflow portion 51 and the pressure of the first liquid L1 positioned downstream of the liquid outflow portion 51 generally become a negative pressure due to the diaphragm 56.

When the liquid ejecting portion 12 ejects droplets, the first liquid L1 accommodated in the liquid outflow portion 51 is supplied to the liquid ejecting portion 12 via the liquid supply flow path 27. As a result, the pressure in the liquid outflow portion 51 is reduced. When a difference between a pressure applied to the first surface 56*a* of the diaphragm 56 and a pressure applied to the second surface 56*b* of the diaphragm 56 becomes equal to or greater than the predetermined value due to the above-described pressure reduction, the diaphragm 56 is bent and deformed in such a direction that the volume of the liquid outflow portion 51 is reduced. When the pressure receiving portion 61 is pressed and moved in accordance with the deformation of the diaphragm 56, the on-off valve 59 enters the open state.

When the on-off valve 59 enters the open state, since the first liquid L1 in the liquid inflow portion 50 is pressurized by the pressurizing mechanism 31, the first liquid L1 is supplied to the liquid outflow portion 51 from the liquid inflow portion 50. As a result, the pressure in the liquid outflow portion 51 increases. When the pressure in the liquid outflow portion 51 increases, the diaphragm 56 is deformed such that the volume of the liquid outflow portion 51 increases. When the difference between the pressure applied to the first surface 56*a* of the diaphragm 56 and the pressure applied to the second surface 56*b* of the diaphragm 56 becomes lower than the predetermined value, the state of the on-off valve 59 changes to the closed state from the open state. As a result, the on-off valve 59 inhibits the first liquid L1 from flowing to the liquid outflow portion 51 from the liquid inflow portion 50.

As described above, the pressure adjustment mechanism 35 adjusts the pressure of the first liquid L1 supplied to the liquid ejecting portion 12 with displacement of the diaphragm 56 in order to adjust the pressure in the liquid ejecting portion 12, which is a back pressure of the nozzle 19.

The pressing mechanism 48 includes an expansion and contraction portion 67 that forms a pressure adjustment chamber 66 which is positioned close to the second surface 56*b* of the diaphragm 56, a retaining member 68 that retains the expansion and contraction portion 67, and a pressure adjustment portion 69 that can adjust the pressure in the pressure adjustment chamber 66. The expansion and contraction portion 67 is formed in a balloon-like shape, for example, by rubber, resin, or the like. The expansion and contraction portion 67 expands or contracts in response to adjustment of the pressure in the pressure adjustment chamber 66 which is performed by the pressure adjustment portion 69. The retaining member 68 is formed to have, for example, a bottomed cylindrical shape. A portion of the expansion and contraction portion 67 is inserted into an insertion hole 70 formed in the bottom of the retaining member 68.

To an end edge portion of an inner surface of the retaining member 68 on an opening portion 71 side, roundness is given through R-chamfering. The retaining member 68 is attached to the pressure adjustment mechanism 35 such that the opening portion 71 is blocked by the pressure adjustment mechanism 35. Therefore, the retaining member 68 forms an air chamber 72 that covers the second surface 56*b* of the diaphragm 56. The pressure in the air chamber 72 is set to atmospheric pressure. Therefore, the atmospheric pressure acts on the second surface 56*b* of the diaphragm 56.

The pressure adjustment portion 69 causes the expansion and contraction portion 67 to expand by adjusting the pressure in the pressure adjustment chamber 66 to be higher than the atmospheric pressure which is the pressure in the air chamber 72. The pressing mechanism 48 presses the diaphragm 56 in such a direction that the volume of the liquid outflow portion 51 is reduced with the pressure adjustment portion 69 causing the expansion and contraction portion 67 to expand. At this time, the expansion and contraction portion 67 of the pressing mechanism 48 presses a portion of the diaphragm 56 that comes into contact with the pressure receiving portion 61. The area of the portion of the diaphragm 56 that comes into contact with the pressure receiving portion 61 is greater than the cross-sectional area of the communication path 57.

Figure 6:
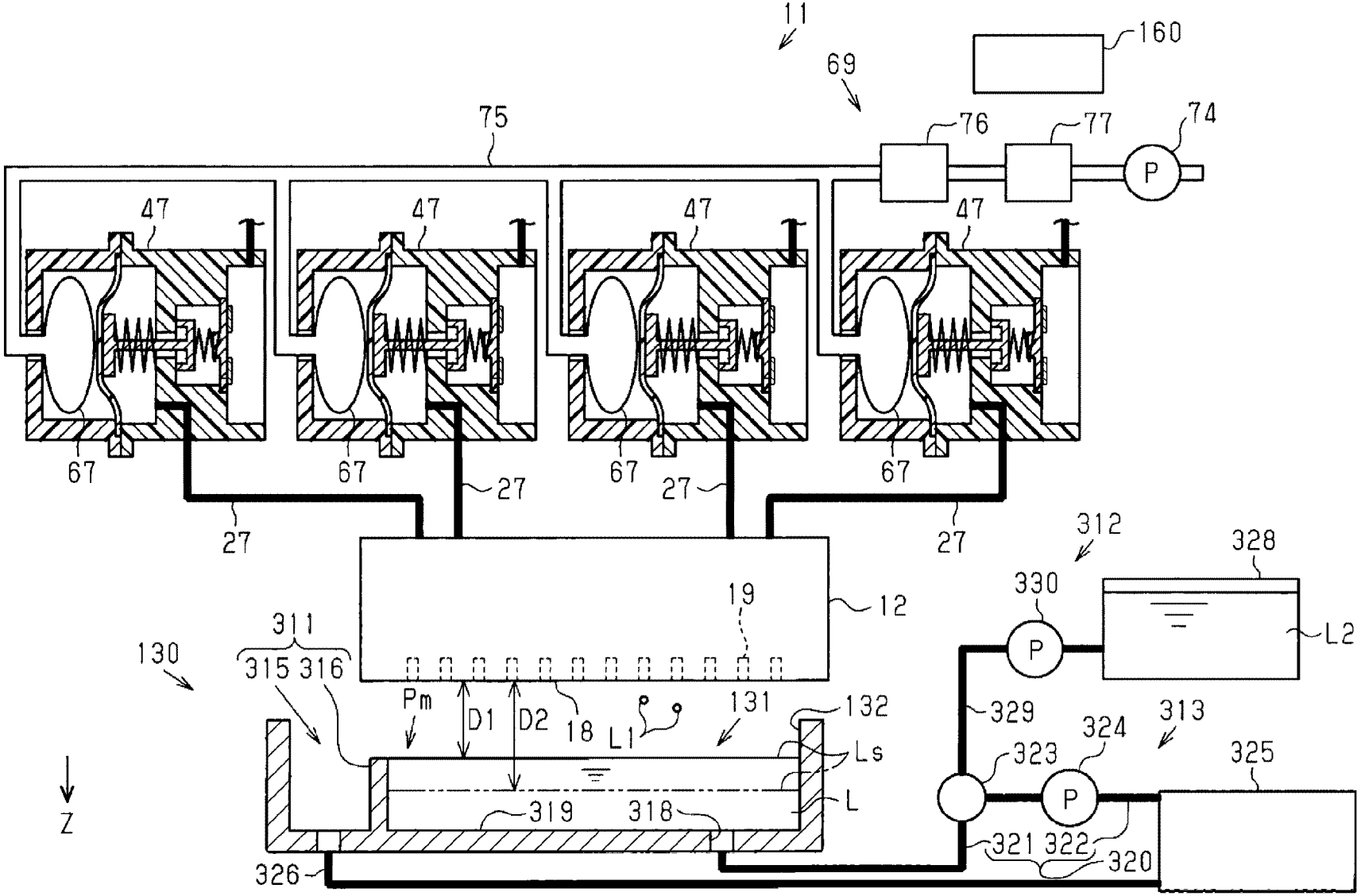
FIG. 6 is a sectional view schematically illustrating a plurality of pressure adjustment mechanisms and a flushing mechanism.

As illustrated in FIG. 6, the pressure adjustment portion 69 includes a pressurizing pump 74 that pressurizes fluid such as air or water and a coupling path 75 that couples the pressurizing pump 74 and the expansion and contraction portions 67 to each other. The pressure adjustment portion 69 includes a pressure measurement portion 76 that measures the pressure of fluid in the coupling path 75 and a fluid pressure adjustment portion 77 that adjusts the pressure of fluid in the coupling path 75.

The coupling path 75 branches into a plurality of flow paths and the flow paths are respectively coupled to the expansion and contraction portions 67 of a plurality of pressure adjustment devices 47. In the present embodiment, the coupling path 75 branches into four flow paths and the four flow paths are respectively coupled to the expansion and contraction portions 67 of four pressure adjustment devices 47. Fluid pressurized by the pressurizing pump 74 is supplied to each of the expansion and contraction portions 67 via the coupling path 75. A changeover valve that switches the state of a flow path between an open state and a closed state may be provided for each of the plurality of branches of the coupling path 75. In this case, it is possible to selectively supply the pressurized fluid to the plurality of expansion and contraction portions 67 by controlling the changeover valve.

The fluid pressure adjustment portion 77 is configured of, for example, a safety valve. The fluid pressure adjustment portion 77 is configured to be automatically opened when the pressure of fluid in the coupling path 75 becomes higher than a predetermined pressure. When the fluid pressure adjustment portion 77 is opened, the fluid in the coupling path 75 is discharged to the outside. In this manner, the fluid pressure adjustment portion 77 reduces the pressure of fluid in the coupling path 75.

Next, the flushing mechanism 130 will be described.

As illustrated in FIG. 6, the flushing mechanism 130 is provided with the liquid receiving portion 131, a maintenance portion 311 which maintains a liquid surface Ls of a liquid L accommodated in the liquid receiving portion 131 at an upper limit position Pm, and a supply portion 312 that supplies a second liquid L2 to the liquid receiving portion 131. The flushing mechanism 130 is provided with a discharge portion 313 configured to discharge the liquid L accommodated in the liquid receiving portion 131.

The second liquid L2 supplied to the liquid receiving portion 131 is a liquid that enhances the fluidity of the first liquid L1 ejected by the liquid ejecting portion 12. For example, when the first liquid L1 is an aqueous ink, the second liquid L2 may be pure water, or may be water to which an additive such as a preservative is added. The second liquid L2 may be a cleaning liquid to which a surfactant is added, or may be a moisturizing liquid to which a moisturizing agent is added. When the first liquid L1 is a solvent ink, the second liquid L2 may be a solvent.

The liquid receiving portion 131 is configured to receive, in a state where the second liquid L2 is accommodated therein, the first liquid L1 discharged from the nozzle 19 for a purpose of maintenance of the liquid ejecting portion 12. Therefore, the liquid receiving portion 131 accommodates the second liquid L2 supplied by the supply portion 312 or a mixed liquid in which the second liquid L2 and the first liquid L1 are mixed. In the present embodiment, the first liquid L1 or the second liquid L2 accommodated in the liquid receiving portion 131 is referred to as the liquid L.

The maintenance portion 311 includes a liquid collection portion 315 collecting the liquid L getting over the upper limit position Pm, and a partition wall 316 partitioning the liquid collection portion 315 and the liquid receiving portion 131. The partition wall 316 sets the upper limit position Pm such that the upper end of the partition wall 316 becomes the upper limit position Pm. The partition wall 316 is lower in height than the wall surrounding the liquid receiving portion 131 and the liquid collection portion 315. The liquid L overflowing from the liquid receiving portion 131 and getting over the upper limit position Pm is collected in the liquid collection portion 315 via the partition wall 316.

In the liquid receiving portion 131, a discharge port 318 is formed at a position below the upper limit position Pm. The discharge port 318 may open at a bottom 319 of the liquid receiving portion 131. The discharge portion 313 is configured to discharge the liquid L accommodated in the liquid receiving portion 131 from the discharge port 318 open to the liquid receiving portion 131.

The discharge portion 313 is provided with a waste liquid flow path 320 coupled to the discharge port 318. The waste liquid flow path 320 is configured to include a first waste liquid flow path 321 upstream and a second waste liquid flow path 322 downstream. The discharge portion 313 includes a switching portion 323 that switches the coupling between the first waste liquid flow path 321 and the second waste liquid flow path 322, and a waste liquid pump 324 provided in the second waste liquid flow path 322. The discharge portion 313 includes a collection flow path 326 coupling a waste liquid accommodation portion 325 capable of accommodating waste liquid and the liquid collection portion 315 to each other. An upstream end of the collection flow path 326 is coupled to the liquid collection portion 315 and a downstream end thereof is coupled to the waste liquid accommodation portion 325.

An upstream end of the first waste liquid flow path 321 is coupled to the discharge port 318 and a downstream end thereof is coupled to the switching portion 323. The first waste liquid flow path 321 couples the liquid receiving portion 131 and the switching portion 323 to each other. An upstream end of the second waste liquid flow path 322 is coupled to the switching portion 323, and a downstream end thereof is coupled to the waste liquid accommodation portion 325. The second waste liquid flow path 322 couples the switching portion 323 and the waste liquid accommodation portion 325 to each other.

The supply portion 312 is provided with a liquid flow path 329 coupled to a liquid accommodation portion 328 accommodating the second liquid L2, and a supply pump 330 provided in the liquid flow path 329. The liquid flow path 329 couples the liquid accommodation portion 328 and the switching portion 323 to each other.

The switching portion 323 is, for example, a solenoid valve. The switching portion 323 is a three-way valve that couples any two of the three coupled flow paths to each other and does not couple the rest one flow path. The switching portion 323 may couple the first waste liquid flow path 321 and the second waste liquid flow path 322 to each other, and may not couple the liquid flow path 329. The switching portion 323 may couple the first waste liquid flow path 321 and the liquid flow path 329 to each other, and may not couple the second waste liquid flow path 322. The switching portion 323 may couple the liquid flow path 329 and the second waste liquid flow path 322 to each other, and may not couple the first waste liquid flow path 321.

The supply portion 312 and the discharge portion 313 drive the switching portion 323, the supply pump 330, and the waste liquid pump 324 to change the position of the liquid surface Ls of the liquid L accommodated in the liquid receiving portion 131. That is, the supply portion 312 and the discharge portion 313 adjust the gap between the liquid surface Ls and the nozzle surface 18. In the present embodiment, the gap between the liquid surface Ls obtained when the liquid surface Ls is positioned at the upper limit position Pm and the nozzle surface 18 is a first gap D1, and the gap between the liquid surface Ls obtained when the liquid surface Ls is positioned below the upper limit position Pm, which is indicated by a two-dot chain line in FIG. 6 and the nozzle surface 18, is a second gap D2. That is, the first gap D1 is smaller than the second gap D2.

The supply portion 312 may drive the supply pump 330 in a state where the liquid flow path 329 and the first waste liquid flow path 321 are coupled to each other, to supply the second liquid L2 accommodated in the liquid accommodation portion 328 to the liquid receiving portion 131. That is, the supply portion 312 may supply the second liquid L2 to the liquid receiving portion 131 via the first waste liquid flow path 321. The supply portion 312 may supply the second liquid L2 to the liquid receiving portion 131 while cleaning the first waste liquid flow path 321 with the second liquid L2. When the second liquid L2 is supplied in an amount larger than the amount that can be accommodated by the liquid receiving portion 131, the second liquid L2 overflows from the liquid receiving portion 131. The liquid L overflowing from the liquid receiving portion 131 is collected by the liquid collection portion 315, and is accommodated in the waste liquid accommodation portion 325 via the collection flow path 326. Accordingly, the liquid surface Ls is positioned at the upper limit position Pm, and the gap between the nozzle surface 18 and the liquid surface Ls becomes the first gap D1.

The discharge portion 313 may drive the waste liquid pump 324 in a state where the first waste liquid flow path 321 and the second waste liquid flow path 322 are coupled to each other, to discharge the liquid L in the liquid receiving portion 131 from the discharge port 318. The discharged liquid L is accommodated in the waste liquid accommodation portion 325 via the first waste liquid flow path 321 and the second waste liquid flow path 322. When the liquid L accommodated in the liquid receiving portion 131 is discharged, the position of the liquid surface Ls is lowered. When the waste liquid pump 324 is driven in a state where the liquid surface Ls is positioned at the upper limit position Pm, to discharge the liquid L in an amount smaller than the amount that can be accommodated by the liquid receiving portion 131 and stop driving of the waste liquid pump 324, the liquid surface Ls is positioned between the upper limit position Pm and the bottom 319. Accordingly, the gap between the nozzle surface 18 and the liquid surface Ls becomes the second gap D2.

The supply portion 312 and the discharge portion 313 may drive the supply pump 330 and the waste liquid pump 324 in a state where the liquid flow path 329 and the second waste liquid flow path 322 are coupled to each other, to supply the second liquid L2 accommodated in the liquid accommodation portion 328 to the waste liquid accommodation portion 325. The supply portion 312 may supply the second liquid L2 to the waste liquid accommodation portion 325 while cleaning the second waste liquid flow path 322.

Next, an electrical configuration of the liquid ejecting apparatus 11 will be described.

Figure 7:
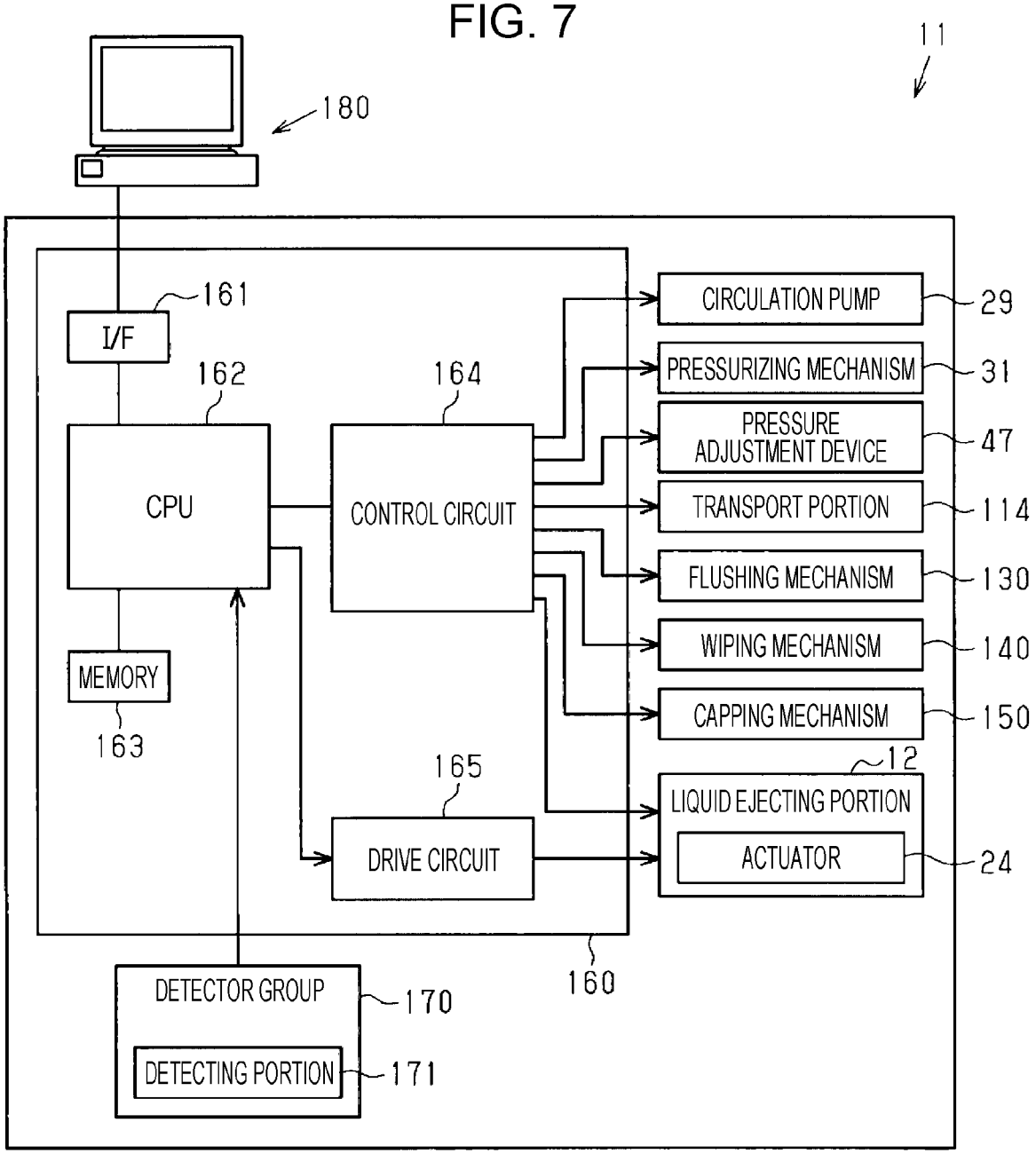
FIG. 7 is a block diagram illustrating an electrical configuration of the liquid ejecting apparatus.

As illustrated in FIG. 7, the liquid ejecting apparatus 11 is provided with a control portion 160 that collectively controls constituent elements of the liquid ejecting apparatus 11 and a detector group 170 controlled by the control portion 160. The detector group 170 includes a detecting portion 171 that detects the state of the insides of the pressure chambers 20 by detecting the vibration waveforms of the pressure chambers 20. The detector group 170 monitors a situation in the liquid ejecting apparatus 11. The detector group 170 outputs the result of the detection to the control portion 160.

The control portion 160 includes an interface portion 161, a CPU 162, a memory 163, a control circuit 164, and a drive circuit 165. The interface portion 161 transmits and receives data between a computer 180, which is an external device, and the liquid ejecting apparatus 11. The drive circuit 165 generates a drive signal to drive the actuators 24.

The CPU 162 is a calculation processing device. The memory 163 is a storage device that secures a region storing a program for the CPU 162 or a working region and includes a storage element such as a RAM, an EEPROM, or the like. The CPU 162 controls, based on the program stored in the memory 163, the circulation pumps 29, the pressurizing mechanism 31, the pressure adjustment device 47, the transport portion 114, the flushing mechanism 130, the wiping mechanism 140, the capping mechanism 150, the liquid ejecting portion 12, and the like via the control circuit 164.

The detector group 170 includes, for example, a linear encoder that detects the state of movement of the carriage 124, a medium detecting sensor that detects the recording medium 113, and the detecting portion 171 which is a circuit detecting residual vibration of the pressure chamber 20. The control portion 160 performs nozzle inspection, which will be described later, based on the result of detection performed by the detecting portion 171. The detecting portion 171 may include a piezoelectric element constituting the actuator 24.

Next, the nozzle inspection will be described.

When voltage is applied to the actuator 24 through a signal from the drive circuit 165, the vibration plate 21 is bent and deformed. Accordingly, there is a fluctuation in pressure in the pressure chamber 20. Due to the fluctuation, the vibration plate 21 vibrates for a while. This vibration is called residual vibration. Detecting the states of the pressure chamber 20 and the nozzle 19 communicating with the pressure chamber 20 from the state of the residual vibration is referred to as the nozzle inspection.

Figure 8:
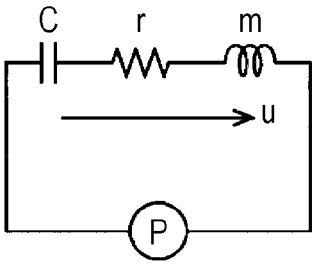
FIG. 8 is a diagram illustrating a simple harmonic motion calculation model made in consideration of residual vibration of a vibration plate.

FIG. 8 is a diagram illustrating a simple harmonic motion calculation model made in consideration of the residual vibration of the vibration plate 21.

When the drive circuit 165 applies a drive signal to the actuator 24, the actuator 24 expands and contracts corresponding to the voltage of the drive signal. The vibration plate 21 is bent corresponding to the expansion and contraction of the actuator 24. Accordingly, the volume of the pressure chamber 20 is decreased after being increased. At this time, due to the pressure generated in the pressure chamber 20, a portion of the first liquid L1 filling the pressure chamber 20 is ejected from the nozzle 19 in the form of droplets.

At the time of the above-described series of operations of the vibration plate 21, the vibration plate 21 freely vibrates at a natural vibration frequency which is determined by a flow path resistance r, an inertance m, and a compliance C of the vibration plate 21. The flow path resistance r is based on the shape of a flow path in which the first liquid L1 flows, the viscosity of the first liquid L1, and the like and the inertance m is based on the weight of liquid in the flow path. The free vibration of the vibration plate 21 is the residual vibration of the vibration plate 21.

The residual vibration calculation model of the vibration plate 21 which is illustrated in FIG. 8 can be represented with a pressure P, the inertance m, the compliance C, and the flow path resistance r. When step response at a time when the pressure P is applied to a circuit in FIG. 8 is calculated with respect to a volume velocity u, the following equations are obtained.

$$u = \frac{P}{\omega \cdot m} e^{-\alpha t} \cdot \sin \omega t \quad (1)$$

$$\omega = \sqrt{\frac{1}{m \cdot C} - \alpha^2} \quad (2)$$

$$\alpha = \frac{r}{2m} \quad (3)$$

Figure 9:
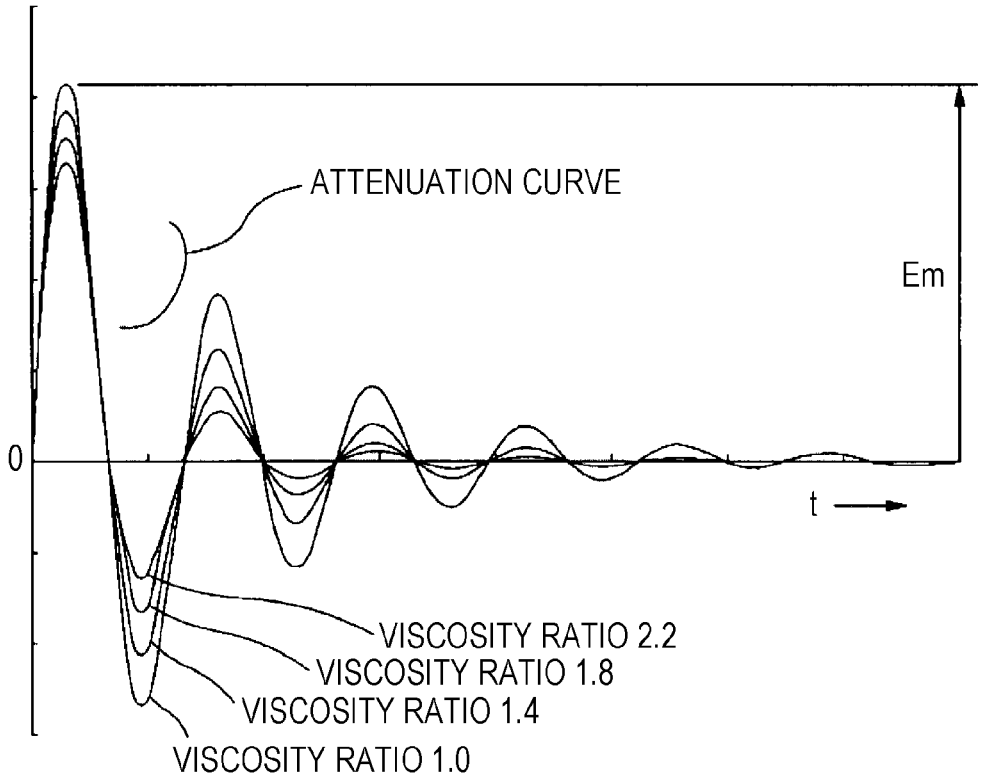
FIG. 9 is a diagram for describing a relationship between an increase in viscosity of a first liquid and a residual vibration waveform.

FIG. 9 is a diagram for describing a relationship between an increase in viscosity of the first liquid L1 and a residual vibration waveform. The horizontal axis in FIG. 9 represents time and the vertical axis represents the magnitude of residual vibration. For example, when the first liquid L1 near the nozzle 19 is dried, the viscosity of the first liquid L1 is increased. When the viscosity of the first liquid L1 is increased, the flow path resistance r increases and thus the vibration cycle and attenuation of residual vibration become great.

Figure 10:
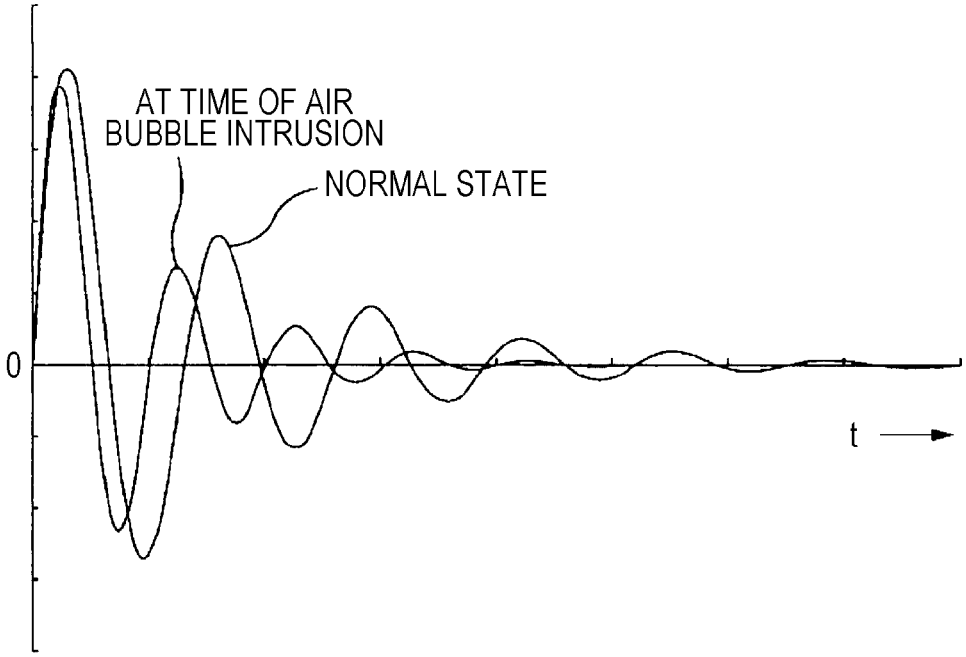
FIG. 10 is a diagram for describing a relationship between air bubble intrusion and the residual vibration waveform.

FIG. 10 is a diagram for describing a relationship between air bubble intrusion and the residual vibration waveform. The horizontal axis in FIG. 10 represents time and the vertical axis represents the magnitude of residual vibration. For example, when air bubbles intrude into a flow path of the first liquid L1 or a tip end of the nozzle 19, the inertance m, which is the weight of liquid, decreases corresponding to the air bubble intrusion in comparison with a case where the nozzle 19 is in a normal state. As the inertance m decreases, an angular velocity co increases as understood from Equation (2) and thus the vibration cycle becomes short. That is, the vibration frequency becomes great.

In addition, it is considered that the amount of the first liquid L1 in the pressure chamber 20 and the amount of the first liquid L1 corresponding to seepage are increased in comparison with a normal state as seen from the vibration plate 21 such that the inertance m is increased when foreign substances such as paper dust adhere to the vicinity of the opening of the nozzle 19. It is considered that the flow path resistance r is increased due to fibers of the paper dust adhering to the vicinity of an outlet of the nozzle 19. Therefore, when paper dust adheres to the vicinity of the opening of the nozzle 19, a frequency becomes lower in comparison with a case where the first liquid L1 is ejected normally and a frequency in the residual vibration becomes higher in comparison with a case where the viscosity of the first liquid L1 is increased.

When an increase in viscosity of the first liquid L1, intrusion of air bubbles, adhesion of foreign substances, or the like occurs, the state of the inside of the nozzle 19 and the state of the inside of the pressure chamber 20 become abnormal and thus the first liquid L1 becomes not able to be ejected from the nozzle 19 in a typical manner. Therefore, dot omission on an image recorded on the recording medium 113 occurs. Even if droplets are ejected from the nozzle 19, the amounts of droplets may be small or the droplets may not be landed on target positions due to flying direction deviation of the droplets. The nozzle 19 with such an ejection failure is referred to as an abnormal nozzle.

As described above, the residual vibration of the pressure chamber 20 communicating with an abnormal nozzle is different from the residual vibration of the pressure chamber 20 communicating with the nozzle 19 in a normal state. Therefore, the detecting portion 171 detects the state of the inside of the pressure chamber 20 by detecting the vibration waveform of the pressure chamber 20. The control portion 160 performs inspection of the nozzle 19 based on the result of the detection performed by the detecting portion 171.

The control portion 160 may estimate whether the state of the inside of the pressure chamber 20 is normal or abnormal based on the vibration waveform of the pressure chamber 20, which is the result of the detection performed by the detecting portion 171. When the state of the inside of the pressure chamber 20 is abnormal, the nozzle 19 communicating with the pressure chamber 20 is estimated as an abnormal nozzle. The control portion 160 may estimate, based on the vibration waveform of the pressure chamber 20, whether the state of the inside of the pressure chamber 20 is abnormal due to air bubbles present therein or the state of the inside of the pressure chamber 20 is abnormal due to an increase in viscosity of the first liquid L1. The control portion 160 may estimate, based on the vibration waveform of the pressure chamber 20, the total volume of air bubbles present in the pressure chamber 20 and the nozzle 19 communicating with the pressure chamber 20 and the degree to which the first liquid L1 in the pressure chamber 20 and the nozzle 19 communicating with the pressure chamber 20 is increased in viscosity.

The frequency of a vibration waveform that is detected in a state where air bubbles are present in the pressure chamber 20 and the nozzle 19 filled with the first liquid L1 is higher than the frequency of a vibration waveform that is detected in a state where air bubbles are not present in the pressure chamber 20 and the nozzle 19 filled with the first liquid L1. The frequency of a vibration waveform that is detected in a state where the pressure chamber 20 and the nozzle 19 are filled with air is higher than the frequency of a vibration waveform that is detected in a state where air bubbles are present in the pressure chamber 20 and the nozzle 19 filled with the first liquid L1. The size of air bubbles present in the pressure chamber 20 and the nozzle 19 filled with the first liquid L1 increases, the frequency of the vibration waveform increases.

When the flow of the first liquid L1 becomes stagnant in the liquid ejecting apparatus 11, the first liquid L1 becomes likely to be increased in viscosity or air bubbles become likely to be accumulated. In this case, there is a high possibility of an abnormal nozzle. That is, the state of the inside of the pressure chamber 20 is likely to be abnormal. Therefore, the liquid ejecting apparatus 11 is configured to perform a maintenance operation of performing maintenance of the liquid ejecting portion 12 in order to suppress an increase in viscosity of the first liquid L1 or discharge air bubbles. The liquid ejecting apparatus 11 of the present embodiment is configured to perform a first discharge operation, a second discharge operation, a third discharge operation, a fourth discharge operation, and a fifth discharge operation as the maintenance operation for the liquid ejecting portion 12.

The liquid ejecting apparatus 11 performs, as the maintenance operation for the liquid ejecting portion 12, the first discharge operation of causing the first liquid L1 in the pressure chamber 20 to be discharged toward the return flow path 28 via the discharge flow path 80 coupled to the pressure chamber 20 when no droplet is ejected from the nozzle 19 during a recording process. The first discharge operation is an operation of causing the first liquid L1 in the pressure chamber 20 to be discharged toward the return flow path 28 via the first discharge flow path 81.

A time when no droplet is ejected from the nozzle 19 during the recording process is, for example, a returning time of the carriage 124 or an inter-page time of the recording medium 113. The returning time of the carriage 124 is a time at which the carriage 124 moves to return to a home position. The inter-page time of the recording medium 113 is a time between when an image is recorded on the recording medium 113 and when the next recording medium 113 reaches a position facing the liquid ejecting portion 12. The liquid ejecting apparatus 11 performs the first discharge operation at such a time.

In the liquid ejecting portion 12 in the middle of the recording process, the nozzle 19 used for recording and the nozzle 19 not used for the recording are present. In the nozzle 19 used for the recording and the pressure chamber 20 communicating with the nozzle 19, the first liquid L1 is less likely to be increased in viscosity since the first liquid L1 is ejected from the nozzle 19. In the nozzle 19 not used for the recording and the pressure chamber 20 communicating with the nozzle 19, the first liquid L1 becomes stagnant and is likely to be increased in viscosity since the first liquid L1 is not ejected from the nozzle 19.

In order to suppress an increase in viscosity of the first liquid L1, generally, the flushing is performed. If the flushing is performed at a time when no droplet is ejected from the nozzle 19 during the recording process, that is, at the returning time of the carriage 124 or the inter-page time of the recording medium 113, an increase in viscosity of the first liquid L1 in the liquid ejecting portion 12 can be suppressed. When the flushing is performed, droplets are ejected from the nozzle 19 and thus the first liquid L1 is consumed. When the flushing is performed for each time the recording process is performed in order to suppress an increase in viscosity of the first liquid L1, the amount of the first liquid L1 consumed becomes large.

When the liquid ejecting apparatus 11 performs the first discharge operation, the first liquid L1 discharged from the pressure chamber 20 to the return flow path 28 via the discharge flow path 80 coupled to the pressure chamber 20 flows in the circulation path 30. Since the first liquid L1 flows, an increase in viscosity of the first liquid L1 is suppressed. Therefore, by using the first discharge operation, it is possible to suppress an increase in viscosity of the first liquid L1 without ejecting droplets from the nozzle 19. Therefore, it is possible to reduce the amount of the first liquid L1 consumed for maintenance.

In the first discharge operation, the liquid ejecting apparatus 11 may cause the first liquid L1 to be discharged toward the return flow path 28 with the first liquid L1 in the pressure chamber 20 sucked from the discharge flow path 80 side such that a meniscus on a gas-liquid interface in the nozzle 19 is maintained. The liquid ejecting apparatus 11 of the present embodiment performs the first discharge operation by driving the circulation pumps 29. When the first discharge operation is performed with the first liquid L1 in the pressure chamber 20 sucked from the discharge flow path 80 side, the meniscus on the gas-liquid interface in the nozzle 19 is moved toward the pressure chamber 20. That is, the first liquid L1 in the nozzle 19 flows. Therefore, an increase in viscosity of the first liquid L1 in the nozzle 19 can be suppressed.

The liquid ejecting apparatus 11 may be configured to cause the first liquid L1 in the pressure chamber 20 to be discharged toward the return flow path 28 by pressurizing the first liquid L1 in the pressure chamber 20 from the liquid supply flow path 27 side. In this case, the first liquid L1 may be pressurized at such a pressure that the first liquid L1 does not flow out through the nozzle 19.

The liquid ejecting apparatus 11 may perform the first discharge operation when it is estimated, based on the result of the detection performed by the detecting portion 171, that the state of the inside of the pressure chamber 20 is abnormal since the volume of air bubbles present in the pressure chamber 20 and the nozzle 19 is equal to or greater than a set value. The set value is stored in the memory 163 of the control portion 160. The memory 163 stores the vibration waveform that is detected by the detecting portion 171 when the volume of air bubbles present in the pressure chamber 20 and the nozzle 19 is equal to the set value.

When the volume of air bubbles present in the pressure chamber 20 and the nozzle 19 is small, the air bubbles may be eliminated by being dissolved in the first liquid L1 with time. When the volume of the air bubbles is small, it is possible to remove the air bubbles from the pressure chamber 20 and the nozzle 19 without performing the first discharge operation by, for example, waiting for a predetermined time. On the contrary, when the volume of air bubbles present in the pressure chamber 20 and the nozzle 19 is large, the air bubbles may grow with time. Therefore, the set value is a value that indicates the minimum volume of air bubbles estimated not to be eliminated with time.

The liquid ejecting apparatus 11 performs the first discharge operation when the air bubbles are not estimated to be eliminated with time. In this case, it is not necessary to perform the first discharge operation when the air bubbles are estimated to be eliminated with time. Therefore, it is possible to decrease a frequency at which the first discharge operation is performed.

When the first discharge operation is not performed since the air bubbles are estimated to be eliminated, the nozzle 19 in an abnormal state caused by the air bubbles may not be able to be used for the recording until the air bubbles are eliminated. Therefore, when the recording process is continued without performing the first discharge operation, a complementary recording operation of compensating for droplets to be ejected from the nozzle 19 in an abnormal state by means of droplets ejected from the nozzle 19 in a normal state may be performed.

For example, when one of the plurality of nozzles 19 ejecting the same kind of droplet is in an abnormal state, droplets larger than droplets to be ejected from the nozzle 19 in the abnormal state are ejected from the nozzle 19 in the normal state that is positioned near the nozzle 19 in the abnormal state such that dot omission is compensated. For example, when the nozzle 19 ejecting black ink is in an abnormal state, yellow, cyan, and magenta droplets are discharged in a superimposed manner to a position to which droplets to be ejected from the nozzle 19 are to be landed such that dot omission of the black ink is compensated.

The liquid ejecting apparatus 11 may estimate whether the state of the inside of the pressure chamber 20 is improved or not by comparing the vibration waveforms of the pressure chamber 20 that is detected by the detecting portion 171 at intervals and when it is estimated that the state of the inside of the pressure chamber 20 is not improved, the liquid ejecting apparatus 11 may perform, as the maintenance operation for the liquid ejecting portion 12, the second discharge operation of causing the first liquid L1 in the pressure chamber 20 to be discharged to the outside from the nozzle 19. The second discharge operation is the above-described flushing operation.

For example, when the state of the inside of the pressure chamber 20 is not improved even after the first discharge operation is performed, the liquid ejecting apparatus 11 performs the second discharge operation of causing the first liquid L1 in the pressure chamber 20 to be discharged to the outside from the nozzle 19. In this case, the liquid ejecting apparatus 11 detects the state of the inside of the pressure chamber 20 again with the detecting portion 171 after the first discharge operation is performed based on the result of the detection performed by the detecting portion 171. At this time, when it is estimated, based on the vibration waveforms of the pressure chamber 20, that the volume of air bubbles in the pressure chamber 20 and the nozzle 19 is large or an increase in viscosity of the first liquid L1 is in progress, the liquid ejecting apparatus 11 determines that the state of the inside of the pressure chamber 20 is not improved and performs the second discharge operation.

Since the second discharge operation is an operation of causing the first liquid L1 in the pressure chamber 20 to be discharged to the outside from the nozzle 19, the second discharge operation is an operation that has a higher maintenance effect with respect to the liquid ejecting portion 12 than the first discharge operation of discharging the first liquid L1 in the pressure chamber 20 to the return flow path 28 via the discharge flow path 80. In this manner, by performing the second discharge operation when the state of the inside of the pressure chamber 20 is not improved with the first discharge operation, it is possible to appropriately perform maintenance of the liquid ejecting portion 12. The liquid ejecting apparatus 11 may perform the second discharge operation when the first discharge operation is not performed since the volume of air bubbles present in the pressure chamber 20 and the nozzle 19 is smaller than the set value but the state of the inside of the pressure chamber 20 is not improved even after a time estimated to be taken for the air bubbles to be eliminated elapses.

When the number of pressure chambers 20 estimated as the pressure chamber 20 of which the inside is in an abnormal state due to air bubbles present in the pressure chamber 20 and the nozzle 19 based on the result of the detection performed by the detecting portion 171 is equal to or larger than a set number, the liquid ejecting apparatus 11 may perform, as the maintenance operation for the liquid ejecting portion 12, the third discharge operation of causing the first liquid L1 in the common liquid chamber 17 to be discharged toward the return flow path 28 via the discharge flow path 80 coupled to the common liquid chamber 17 before the first discharge operation is performed. The third discharge operation is an operation of causing the first liquid L1 in the common liquid chamber 17 to be discharged toward the return flow path 28 via the second discharge flow path 82. The set number is stored in the memory 163 of the control portion 160.

When the number of pressure chambers 20 estimated as the pressure chamber 20 of which the inside is in an abnormal state due to air bubbles present in the pressure chamber 20 and the nozzle 19 is equal to or larger than the set number, it is considered that air bubbles are present in the common liquid chamber 17 communicating with the plurality of pressure chambers 20. In this case, there is a possibility that consecutive nozzles in the nozzle surface 18 are in an abnormal state and thus it is difficult to perform the complementary recording operation. Therefore, when the number of pressure chambers 20 estimated as the pressure chamber 20 of which the inside is in an abnormal state due to air bubbles present in the pressure chamber 20 and the nozzle 19 is equal to or larger than the set number, the third discharge operation is performed as the maintenance operation for the liquid ejecting portion 12. Accordingly, it is possible to discharge the first liquid L1 in the common liquid chamber 17 in which air bubbles are expected to be present. In the present embodiment, air bubbles in the first liquid L1 discharged from the liquid ejecting portion 12 are removed by the degasification mechanism 46 when being circulated in the circulation path 30.

The liquid ejecting apparatus 11 may perform, as the maintenance operation for the liquid ejecting portion 12, the fourth discharge operation of causing the first liquid L1 in the pressure chamber 20 to be discharged toward the return flow path 28 via the discharge flow path 80 coupled to the pressure chamber 20 at a flow rate lower than the first discharge operation when droplets are ejected from the nozzle 19 during the recording process. The fourth discharge operation is an operation of causing the first liquid L1 in the pressure chamber 20 to be discharged toward the return flow path 28 via the first discharge flow path 81 at a flow rate lower than the first discharge operation.

A time when no droplet is ejected from the nozzle 19 during the recording process is, for example, a time when an image is recorded on the recording medium 113. When the first liquid L1 in the pressure chamber 20 is discharged toward the return flow path 28 via the discharge flow path 80 coupled to the pressure chamber 20 in order to suppress an increase in viscosity of the first liquid L1, the pressure in the pressure chamber 20 is likely to become unstable due to the flow of the first liquid L1. If the pressure in the pressure chamber 20 becomes unstable when droplets are ejected from the nozzle 19 during the recording process, the ejection accuracy of the nozzle 19 ejecting droplets is decreased. Therefore, when droplets are ejected from the nozzle 19 during the recording process, the fourth discharge operation is performed as the maintenance operation for the liquid ejecting portion 12.

In the fourth discharge operation, the pressure in the pressure chamber 20 does not significantly fluctuate since the first liquid L1 flows from the pressure chamber 20 to the return flow path 28 at a low flow rate in comparison with the first discharge operation. That is, the pressure in the pressure chamber 20 is less likely to be unstable. By performing the fourth discharge operation, it is possible to suppress an increase in viscosity of the first liquid L1 while suppressing a fluctuation in pressure in the pressure chamber 20 even when droplets are ejected from the nozzle 19 during the recording process. The fourth discharge operation is particularly effective in suppressing an increase in viscosity of the first liquid L1 in the nozzle 19 not used for the recording during the recording process and in the pressure chamber 20 communicating with the nozzle 19. The flow rate of the first liquid L1 is the volume of the first liquid L1 flowing per unit time.

In FIG. 5, the position of a normal meniscus that is formed when the first liquid L1 in the pressure chamber 20 does not flow is represented with a meniscus E, the position of a meniscus that is formed when the fourth discharge operation is performed is represented with a meniscus F, and the position of a meniscus that is formed when the first discharge operation is performed is represented with a meniscus G. When the first discharge operation or the fourth discharge operation is performed, a meniscus on the gas-liquid interface in the nozzle 19 is moved toward the pressure chamber 20 side. Therefore, the meniscus E is positioned closer to the nozzle surface 18 than the meniscus F and the meniscus G in the nozzle 19.

In the case of the fourth discharge operation, the amount of movement of a meniscus in the nozzle 19 is small since the first liquid L1 flows at a lower flow rate than the first discharge operation. Therefore, the meniscus F is positioned between the meniscus E and the meniscus G in the nozzle 19.

The liquid ejecting apparatus 11 may perform, as the maintenance operation for the liquid ejecting portion 12, the fifth discharge operation of causing the first liquid L1 in the pressure chamber 20 to be discharged toward the return flow path 28 via the discharge flow path 80 coupled to the pressure chamber 20 at a flow rate higher than the first discharge operation in a state where the nozzle surface 18 is capped by the cap 151 when the recording process is not performed. The fifth discharge operation is an operation of causing the first liquid L1 in the pressure chamber 20 to be discharged toward the return flow path 28 via the first discharge flow path 81 at a flow rate higher than the first discharge operation in a state where the nozzle surface 18 is capped by the cap 151 when the recording process is not performed.

When a flow rate at which the first liquid L1 flows from the pressure chamber 20 toward the return flow path 28 is made higher with the liquid sucked from the discharge flow path 80 side, there is a possibility that the outside air is drawn into the pressure chamber 20 through the nozzle 19. However, if the nozzle surface 18 is capped by the cap 151 when the first liquid L1 in the pressure chamber 20 is discharged toward the return flow path 28 via the discharge flow path 80 coupled to the pressure chamber 20, a possibility that the outside air enters the pressure chamber 20 through the nozzle 19 is decreased.

When a flow rate at which the first liquid L1 flows from the pressure chamber 20 toward the return flow path 28 is made higher with the liquid pressurized from the liquid supply flow path 27 side, there is a possibility that the first liquid L1 flows out through the nozzle 19. However, if the nozzle surface 18 is capped by the cap 151 when the first liquid L1 in the pressure chamber 20 is discharged toward the return flow path 28 via the discharge flow path 80 coupled to the pressure chamber 20, a possibility that the first liquid L1 flows out through the nozzle 19 is decreased.

Due to the above-described reasons, in a state where the nozzle surface 18 is capped by the cap 151, it is possible to make a flow rate at which the first liquid L1 is discharged from the inside of the pressure chamber 20 toward the return flow path 28 via the discharge flow path 80 coupled to the pressure chamber 20 higher. As the flow rate at which the first liquid L1 is discharged from the inside of the pressure chamber 20 toward the return flow path 28 increases, the maintenance effect with respect to the liquid ejecting portion 12 increases. By performing the fifth discharge operation with the nozzle surface capped, it is possible to more effectively perform the maintenance of the liquid ejecting portion 12. When the cap 151 is provided with the atmosphere opening valve, the fifth discharge operation is performed with the atmosphere opening valve closed.

Next, as a maintenance method for the liquid ejecting apparatus 11, an example of a maintenance process for performing the maintenance operation of the liquid ejecting portion 12 will be described. The maintenance process is repeatedly performed while the liquid ejecting portion 12 is performing the recording process.

Figure 11:
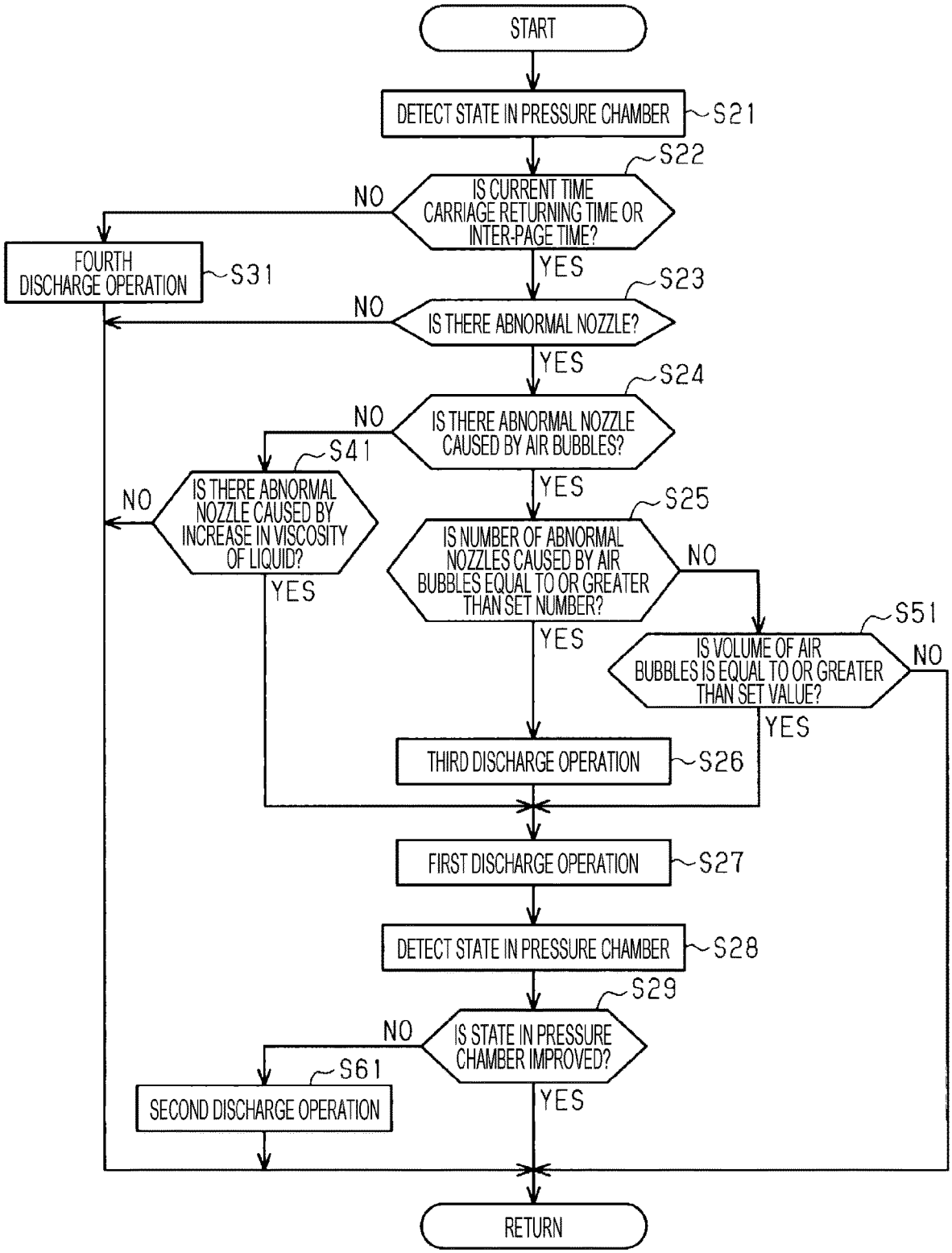
FIG. 11 is a flowchart illustrating an example of a maintenance process.

As illustrated in FIG. 11, the control portion 160 that performs the maintenance process detects the state of the inside of the pressure chamber 20 with the detecting portion 171 in Step S21. The control portion 160 detects the state of the insides of all of the pressure chambers 20 by performing the nozzle inspection with respect to all of the nozzles 19 in Step S21. The vibration waveform of the pressure chamber 20 detected by the detecting portion 171 in Step S21 may be vibration waveforms attributable to the actuator 24 driven to eject droplets or vibration waveforms attributable to the actuator 24 driven to such an extent that droplets are not ejected.

In Step S22, the control portion 160 determines whether a current time is the returning time of the carriage 124 or the inter-page time of the recording medium 113. In other words, in Step S22, the control portion 160 determines whether a current time is a time when droplets are ejected from the nozzle 19 or not. The control portion 160 transitions into a process in Step S31 when it is determined that the current time is not the returning time of the carriage 124 or the inter-page time of the recording medium 113 in Step S22. The control portion 160 transitions into a process in Step S23 when it is determined that the current time is the returning time of the carriage 124 or the inter-page time of the recording medium 113 in Step S22.

In Step S23, the control portion 160 determines whether an abnormal nozzle is present or not. In Step S23, the control portion 160 determines whether an abnormal nozzle is present or not based on the result of the nozzle inspection performed in Step S21. In other words, in Step S23, the control portion 160 estimates whether the state of the inside of the pressure chamber 20 is abnormal or not. The control portion 160 transitions into a process in Step S24 when it is determined that an abnormal nozzle is present in Step S23. The control portion 160 terminates the maintenance process when it is determined that an abnormal nozzle is not present in Step S23. When the maintenance process is terminated while the liquid ejecting portion 12 is performing the recording process, the control portion 160 restarts the maintenance process.

In Step S24, the control portion 160 determines whether an abnormal nozzle caused by air bubbles is present or not. In Step S24, the control portion 160 estimates whether a cause of the abnormal nozzle is air bubbles or not based on the vibration waveforms of the pressure chamber 20 detected in Step S21. In other words, in Step S24, the control portion 160 estimates whether a cause of the abnormality in the pressure chamber 20 is air bubbles or not. The control portion 160 transitions into a process in Step S25 when it is determined that the cause of the abnormal nozzle is air bubbles in Step S24. The control portion 160 transitions into a process in Step S41 when it is determined that the cause of the abnormal nozzle is not air bubbles in Step S24.

In Step S25, the control portion 160 determines whether the number of abnormal nozzles caused by air bubbles is equal to or greater than the set number or not. In Step S25, the control portion 160 estimates whether the number of abnormal nozzles caused by air bubbles is equal to or greater than the set number or not based on the vibration waveforms of the pressure chamber 20 detected in Step S21. In other words, in Step S25, the control portion 160 estimates whether the number of pressure chambers 20 in an abnormal state caused by air bubbles is equal to or greater than the set number or not. The control portion 160 transitions into a process in Step S26 when it is determined that the number of abnormal nozzles caused by air bubbles is equal to or greater than the set number in Step S25. The control portion 160 transitions into a process in Step S51 when it is determined that the number of abnormal nozzles caused by air bubbles is smaller than the set number in Step S25.

In Step S26, the control portion 160 performs the third discharge operation. In Step S26, since the number of abnormal nozzles caused by air bubbles is equal to or greater than the set number, it is considered that air bubbles are present in the common liquid chamber 17. Therefore, the third discharge operation is performed such that the air bubbles are discharged from the common liquid chamber 17. The control portion 160 performs the third discharge operation for a predetermined time in Step S26.

In Step S27, the control portion 160 performs the first discharge operation. It is considered that air bubbles are present in the pressure chamber 20 when a process in Step S27 is reached after the process in Step S26 is performed. Therefore, the control portion 160 performs the first discharge operation in Step S27 after the process in Step S26 is finished such that the air bubbles are discharged from the pressure chamber 20. In Step S27, the control portion 160 performs the first discharge operation for a predetermined time.

In Step S28, the control portion 160 detects the state of the inside of the pressure chamber 20. In Step S28, the control portion 160 performs the same process as in Step S21.

In Step S29, the control portion 160 determines whether the state of the inside of the pressure chamber 20 is improved or not due to the maintenance operation. That is, in Step S29, the control portion 160 estimates whether the state of the inside of the pressure chamber 20 is improved or not by comparing the vibration waveforms of the pressure chamber 20 detected at intervals in Step S21 and Step S28. The control portion 160 terminates the maintenance process when it is determined that the state of the inside of the pressure chamber 20 is improved in Step S29. The control portion 160 transitions into a process in Step S61 when it is determined that the state of the inside of the pressure chamber 20 is not improved in Step S29.

In Step S61, the control portion 160 performs the second discharge operation. In Step S61, since the state of the inside of the pressure chamber 20 is not improved with the first discharge operation performed in Step S27, a discharge operation having a higher maintenance effect than the first discharge operation is performed. Therefore, in Step S61, the control portion 160 performs the second discharge operation having a high maintenance effect such that the state of the inside of the pressure chamber 20 is improved. The control portion 160 terminates the maintenance process after the second discharge operation is performed.

When it is determined in Step S22 that the current time is not the returning time of the carriage 124 or the inter-page time of the recording medium 113, the control portion 160 performs the fourth discharge operation in Step S31. In Step S31, since an image is being recorded on the recording medium 113, a great fluctuation in pressure in the pressure chamber 20 is not preferable. Therefore, in Step S31, the control portion 160 performs the fourth discharge operation in which the first liquid L1 flows at a flow rate lower than the first discharge operation. In Step S31, the control portion 160 terminates the maintenance process after performing the fourth discharge operation for a predetermined time.

When it is determined in Step S24 that a cause of the abnormal nozzle is not air bubbles, the control portion 160 determines whether an abnormal nozzle caused by an increase in viscosity of the first liquid L1 is present or not in Step S41. In Step S41, the control portion 160 estimates whether a cause of the abnormal nozzle is an increase in viscosity of the first liquid L1 or not based on the vibration waveforms of the pressure chamber 20 detected in Step S21. In other words, in Step S41, the control portion 160 estimates whether a cause of the abnormality in the pressure chamber 20 is an increase in viscosity of the first liquid L1 or not. The control portion 160 transitions into the process in Step S27 when it is determined that the cause of the abnormal nozzle is an increase in viscosity of the first liquid L1 in Step S41. The control portion 160 terminates the maintenance process when it is determined that the cause of the abnormal nozzle is not an increase in viscosity of the first liquid L1 in Step S41.

It is considered that there is an increase in viscosity of the first liquid L1 in the pressure chamber 20 when the process in Step S27 is reached after the process in Step S41 is performed. Therefore, in Step S27, the control portion 160 performs the first discharge operation after the process in Step S41 is finished such that the first liquid L1 increased in viscosity is discharged from the pressure chamber 20.

When it is determined in Step S25 that the number of abnormal nozzles caused by air bubbles is smaller than the set number, the control portion 160 determines whether the volume of air bubbles present in the pressure chamber 20 and the nozzle 19 communicating with the pressure chamber 20 is equal to or greater than the set value or not in Step S51. The control portion 160 transitions into the process in Step S27 when it is determined that the volume of air bubbles present in the pressure chamber 20 and the nozzle 19 communicating with the pressure chamber 20 is equal to or greater than the set value in Step S51.

It is considered that air bubbles are present in the pressure chamber 20 when the process in Step S27 is reached after the process in Step S51 is performed. Therefore, in Step S27, the control portion 160 performs the first discharge operation after the process in Step S51 is finished such that the air bubbles are discharged from the pressure chamber 20. In Step S27, the control portion 160 performs the first discharge operation for a predetermined time.

When it is determined in Step S51 that the volume of air bubbles present in the pressure chamber 20 and the nozzle 19 communicating with the pressure chamber 20 is smaller than the set value, the control portion 160 terminates the maintenance process. When it is determined in Step S51 that the volume of air bubbles present in the pressure chamber 20 and the nozzle 19 communicating with the pressure chamber 20 is smaller than the set value, it is estimated that the air bubbles will be eliminated with time. Therefore, in this case, the control portion 160 does not perform the first discharge operation. When the recording process is continued even after the process in Step S51 is finished, the control portion 160 may perform the above-described complementary recording operation. The control portion 160 may wait for a time estimated to be taken for the air bubbles to be eliminated after the process in Step S51 is finished.

Next, a cleaning operation of the liquid ejecting portion 12 will be described.

The liquid ejecting apparatus 11 is configured to perform the cleaning operation of causing the first liquid L1 to be forcibly discharged from the nozzle 19 of the liquid ejecting portion 12. The cleaning operation is an operation which has a higher maintenance effect with respect to the liquid ejecting portion 12 than the discharge operation.

In the present embodiment, the control portion 160 performs the cleaning operation of causing the first liquid L1 to be discharged from the nozzle 19 of the liquid ejecting portion 12 by causing the pressurizing mechanism 31 to pressurize the inside of the liquid ejecting portion 12 such that pressure in the liquid ejecting portion 12 is made higher than the pressure of the outside of the liquid ejecting portion 12. That is, the control portion 160 performs pressurization cleaning as the cleaning operation by causing the pressurizing mechanism 31 to pressurize the inside of the liquid ejecting portion 12. The liquid ejecting apparatus 11 may be configured to perform suction cleaning as the cleaning operation, the suction cleaning being an operation of forcibly discharging the first liquid L1 from the nozzle 19 by sucking air in the cap 151 in a state where the nozzle surface 18 is capped.

That is, when performing the cleaning operation, the control portion 160 causes the pressing mechanism 48 to press the diaphragm 56 such that the on-off valve 59 is opened. The control portion 160 drives the pressurizing mechanism 31 with the on-off valve 59 opened such that the first liquid L1 is supplied to the pressure adjustment mechanism 35 and the liquid ejecting portion 12. In this manner, the control portion 160 causes the pressurizing mechanism 31 to pressurize the inside of the liquid ejecting portion 12. In this manner, the cleaning operation is performed.

The control portion 160 drives the pressurizing pump 74 when opening the on-off valve 59 such that the pressurized fluid is supplied to the expansion and contraction portion 67. The expansion and contraction portion 67 expands due to the supplied fluid and thus the diaphragm 56 is displaced in such a direction that the volume of the liquid outflow portion 51 is reduced. Therefore, the on-off valve 59 enters the open state. The control portion 160 controls the pressure adjustment portion 69 when closing the on-off valve 59 such that the fluid supplied to the expansion and contraction portion 67 is discharged to the outside. As described above, the control portion 160 opens or closes the on-off valve 59 based on the driving of the pressing mechanism 48.

The pressure in the liquid ejecting portion 12 after the cleaning operation is likely to be higher than the pressure in the liquid ejecting portion 12 at the time of the recording process. Specifically, the pressure in the liquid ejecting portion 12 becomes a negative pressure at the time of the recording process but the pressure in the liquid ejecting portion 12 is likely to become a positive pressure higher than the atmospheric pressure after the cleaning operation. Therefore, when the recording process is performed after the cleaning operation is performed, droplets may be unstably ejected from the nozzle 19. For example, the size of droplets ejected from the nozzle 19 of the liquid ejecting portion 12 may not be a desired size or droplets may not be ejected at a time when the droplets need to be ejected.

In the present embodiment, when the cleaning operation is performed, the control portion 160 performs a pressure reducing operation after performing a cleaning stopping operation of stopping the cleaning operation. The pressure reducing operation is an operation of reducing the pressure in the liquid ejecting portion 12 and the pressure in the liquid supply flow path 27 that is positioned downstream of the pressure adjustment mechanism 35.

The control portion 160 performs a finishing wiping operation of wiping the nozzle surface 18 of the liquid ejecting portion 12 in a state where the pressure in the liquid ejecting portion 12 is reduced due to the pressure reducing operation. In this case, the pressure in the liquid ejecting portion 12 becomes an appropriate pressure before the recording process is performed. As a result, a meniscus suitable for droplet ejection is formed in the nozzle 19 of the liquid ejecting portion 12. In the pressure reducing operation, the pressure in the liquid ejecting portion 12 is reduced such that the meniscus is positioned in the nozzle 19.

When the cleaning operation is performed for a long period of time, the amount of the first liquid L1 consumed by being discharged from the nozzle 19 of the liquid ejecting portion 12 may become excessively large with respect to the amount of the first liquid L1 that the pressurizing mechanism 31 supplies to the liquid ejecting portion 12. In this case, the flow speed of the first liquid L1 flowing in the liquid supply flow path 27 gradually decreases. When the flow speed of the first liquid L1 flowing in the liquid supply flow path 27 is decreased, it may not be possible to effectively discharge foreign substances such as air bubbles present in the liquid ejecting portion 12 and the liquid supply flow path 27.

In the present embodiment, the control portion 160 repeatedly performs the cleaning operation and the cleaning stopping operation of stopping the cleaning operation at short intervals. Accordingly, the gradual decrease in flow speed of the first liquid L1 flowing in the liquid supply flow path 27 is suppressed. An effect of discharging foreign substances such as air bubbles present in the liquid supply flow path 27 becoming weak is suppressed.

Next, an example of a cleaning process performed by the control portion 160 of the present embodiment will be described with reference to a flowchart in FIG. 12. The cleaning process is a process including the cleaning operation. The cleaning process may be performed for each predetermined control cycle, may be performed only when it is expected that there is a droplet ejection failure in the nozzle 19. The cleaning process may be performed manually by a user or an operator of the liquid ejecting apparatus 11.

Figure 12:
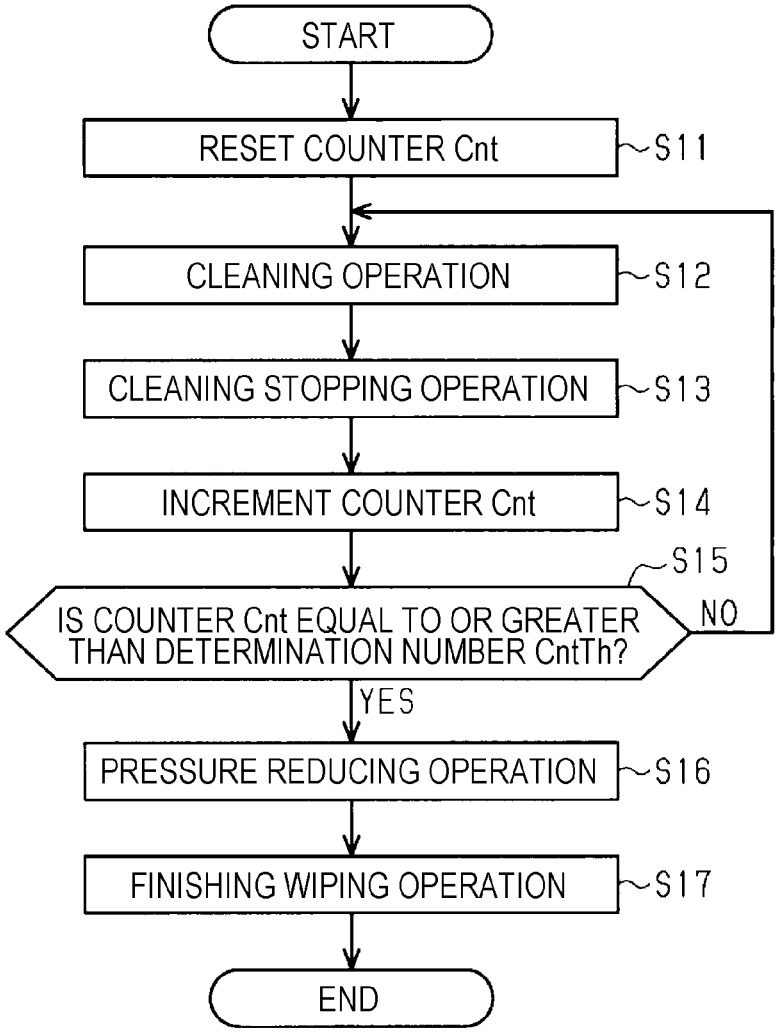
FIG. 12 is a flowchart illustrating an example of a cleaning process.

As illustrated in FIG. 12, the control portion 160 that performs the cleaning process resets a counter Cnt, which is a variable for counting, in Step S11. That is, the control portion 160 resets the counter Cnt to "0" in Step S11.

In Step S12, the control portion 160 performs the cleaning operation. In Step S12, the control portion 160 controls the driving of the pressing mechanism 48 such that the diaphragm 56 is displaced in such a direction that the volume of the liquid outflow portion 51 is reduced. In this manner, the control portion 160 causes the on-off valve 59 to enter the open state. When the on-off valve 59 enters the open state, the pressurized first liquid L1 flows into the liquid outflow portion 51, the liquid supply flow path 27, the common liquid chamber 17, the pressure chamber 20, and the nozzle 19. As a result, the first liquid L1 is discharged from the nozzle 19. In Step S12, the control portion 160 performs the cleaning operation for the predetermined time.

In Step S13, the control portion 160 performs the cleaning stopping operation to stop the cleaning operation. In Step S13, the control portion 160 controls the driving of the pressing mechanism 48 such that the diaphragm 56 is displaced in such a direction that the volume of the liquid outflow portion 51 increases. In this manner, the control portion 160 causes the on-off valve 59 to enter the closed state. When the on-off valve 59 enters the closed state, the pressurized first liquid L1 is not supplied downstream of the pressure adjustment mechanism 35. As a result, the cleaning operation is stopped. A period of time between the start of the cleaning operation and the start of the cleaning stopping operation may be, for example, a period of time of about 0.1 seconds to 1.0 second.

In Step S14, the control portion 160 increments the counter Cnt by "1".

In Step S15, the control portion 160 determines whether the counter Cnt is equal to or greater than a determination number CntTh. The determination number CntTh is a determination value for determining the number of times the cleaning operation and the cleaning stopping operation are repeatedly performed. Therefore, the determination number CntTh may be determined based on the specifications of the liquid ejecting apparatus 11 or setting by the user. Note that, when the nozzle inspection is performed for all of the nozzles 19 of the liquid ejecting portion 12, the determination number CntTh may be determined corresponding to the number of abnormal nozzles in each of which the droplet ejection failure occurs.

The control portion 160 transitions into the process in Step S12 when it is determined that the counter Cnt is smaller than the determination number CntTh in Step S15. The control portion 160 transitions into a process in Step S16 when it is determined that the counter Cnt is equal to or greater than the determination number CntTh in Step S15.

In Step S16, the control portion 160 performs the pressure reducing operation. In the present embodiment, the pressure reducing operation is a wiping operation of wiping the nozzle surface 18 by using the wiping mechanism 140. Hereinafter, the wiping operation is referred to as a preceding wiping operation. As a result of the preceding wiping operation, the wiping portion 149 comes into contact with the gas-liquid interface positioned outside the nozzle 19 or in the vicinity of the opening of the nozzle 19, so that the pressurized first liquid L1 leaks out from the nozzle 19. Accordingly, the pressure in the liquid ejecting portion 12 is reduced.

Immediately after the last cleaning stopping operation is performed in the cleaning process, the first liquid L1 may continue to leak out from the nozzle 19 of the liquid ejecting portion 12 due to the cleaning operation performed immediately before the cleaning stopping operation. Therefore, it is preferable that the preceding wiping operation be performed after the first liquid L1 stops to leak out due to the cleaning operation. In the present embodiment, since the pressure reducing operation is performed when the counter Cnt is equal to or greater than the determination number CntTh, the pressure reducing operation is an operation that is performed after the last cleaning stopping operation is performed.

In Step S17, the control portion 160 performs a finishing wiping operation. The finishing wiping operation is a wiping operation of wiping the nozzle surface 18 by using the wiping mechanism 140. Therefore, in the present embodiment, the control portion 160 performs the wiping operations in both of Step S16 and Step S17. As a result of the finishing wiping operation, the first liquid L1 or foreign substances adhering to the nozzle surface 18 are removed and a meniscus suitable for the droplet ejection is formed in the nozzle 19. The control portion 160 temporarily terminates the cleaning process after the process in Step S17 is finished.

The cleaning process in the present embodiment is a process including the cleaning operation, the cleaning stopping operation, the preceding wiping operation which is the pressure reducing operation, and the finishing wiping operation. The cleaning process in the present embodiment is an operation of recovering the droplet ejection performance of the liquid ejecting portion 12. The cleaning process may be performed, for example, when it is expected that the droplet ejection performance of the liquid ejecting portion 12 is not recovered in the maintenance process in which the discharge operation is performed. The cleaning process may be performed, for example, when the state of the inside of the pressure chamber 20 is not improved continuously.

Next, an effect when the liquid ejecting apparatus 11 performs the cleaning process will be described.

When the liquid ejecting apparatus 11 performs the recording process, a portion of the plurality of nozzles 19 provided in the liquid ejecting portion 12 may become abnormal nozzles in which a droplet ejection failure occurs. In this case, the cleaning process may be performed to recover the abnormal nozzles from the droplet ejection failure.

Figure 13:
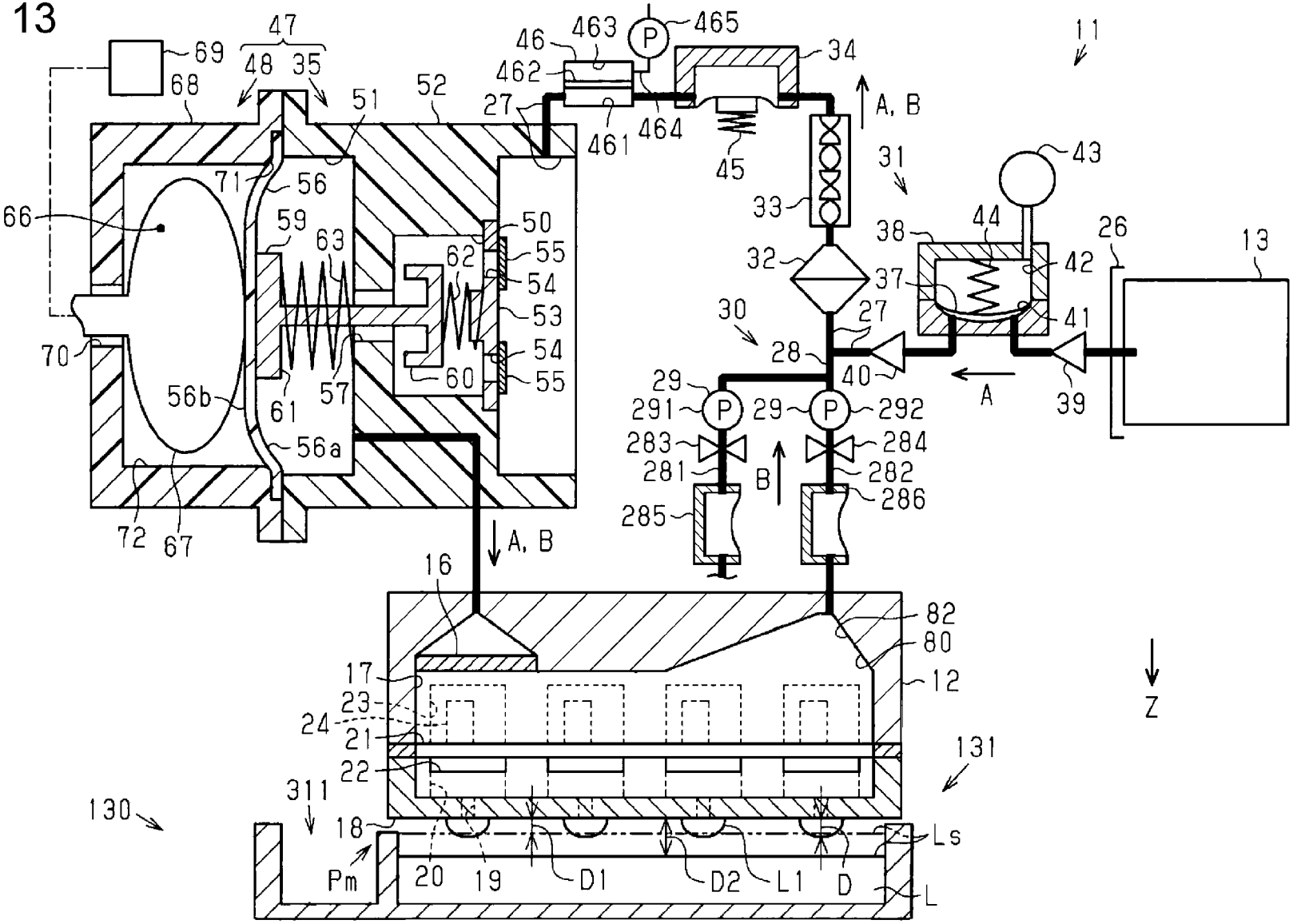
FIG. 13 is a sectional view schematically illustrating the pressure adjustment mechanism with the on-off valve opened and the liquid ejecting portion.

As illustrated in FIG. 13, when the cleaning process is performed, the pressurizing pump 74 illustrated in FIG. 6 is driven such that the pressurized fluid is supplied to the expansion and contraction portion 67. Then, the expansion and contraction portion 67 supplied with the fluid expands and presses a region of the diaphragm 56 that comes into contact with the pressure receiving portion 61 such that the on-off valve 59 enters the open state.

The pressing mechanism 48 moves the pressure receiving portion 61 against pressing forces of the upstream pressing member 62 and the downstream pressing member 63 such that the on-off valve 59 enters the open state. In this case, since the pressure adjustment portion 69 is coupled to the expansion and contraction portions 67 of the plurality of pressure adjustment devices 47, all of the on-off valves 59 in the pressure adjustment devices 47 enter the open state.

When the on-off valve 59 is caused to enter the open state, the diaphragm 56 is displaced in such a direction that the volume of the liquid outflow portion 51 is reduced. Therefore, the first liquid L1 accommodated in the liquid outflow portion 51 is pressed out toward the liquid ejecting portion 12 side. That is, the pressure with which the diaphragm 56 presses the liquid outflow portion 51 is transmitted to the liquid ejecting portion 12 and thus the meniscus collapses and the first liquid L1 flows out from the nozzle 19. The pressing mechanism 48 presses the diaphragm 56 such that the pressure in the liquid outflow portion 51 becomes higher than a pressure at which at least one meniscus collapses. The pressing mechanism 48 presses the diaphragm 56 such that, for example, a pressure on the first liquid L1 side becomes 3 kPa higher than a pressure on an air side for the gas-liquid interface in the nozzle 19.

The pressing mechanism 48 presses the diaphragm 56 such that the on-off valve 59 enters the open state regardless of the pressure in the liquid inflow portion 50. In this case, the pressing mechanism 48 presses the diaphragm 56 with a pressing force that is greater than a pressing force that is generated when a pressure, which is obtained by adding the above-described predetermined value to a pressure at which the pressurizing mechanism 31 pressurizes the first liquid L1, is applied to the diaphragm 56.

The pressure reduction portion 43 is periodically driven in a state where the on-off valve 59 is in the open state and thus the first liquid L1 pressurized by the pressurizing mechanism 31 is supplied to the liquid ejecting portion 12. That is, when the pressure reduction portion 43 is driven and the pressure in the negative pressure chamber 42 is reduced, the flexible member 37 moves in such a direction that the volume of the pump chamber 41 increases.

When the flexible member 37 moves in such a direction that the volume of the pump chamber 41 increases, the first liquid L1 flows from the liquid supply source 13 into the pump chamber 41. When the pressure reduction performed by the pressure reduction portion 43 is stopped, the flexible member 37 is pressed by the pressing force of the pressing member 44 in such a direction that the volume of the pump chamber 41 is reduced. That is, the first liquid L1 in the pump chamber 41 is pressurized by the pressing force of the pressing member 44 via the flexible member 37. The first liquid L1 in the pump chamber 41 is supplied to the downstream of the liquid supply flow path 27 while passing through the one-way valve 40 positioned downstream of the pump chamber 41.

While the pressing mechanism 48 presses the diaphragm 56, the open state of the on-off valve 59 is maintained. Therefore, if the pressurizing mechanism 31 pressurizes the first liquid L1 in a state where the open state of the on-off valve 59 is maintained, the pressurizing force is transmitted to the liquid ejecting portion 12 via the liquid inflow portion 50, the communication path 57, and the liquid outflow portion 51. Accordingly, the pressurization cleaning, which is the cleaning operation in which the first liquid L1 is discharged from the nozzle 19 is performed. As illustrated in FIG. 13, when the cleaning operation is performed, the carriage 124 may be moved such that the liquid ejecting portion 12 faces the liquid receiving portion 131 and the liquid receiving portion 131 may receive the first liquid L1 discharged from the nozzle 19.

After the cleaning operation is performed, the cleaning stopping operation of stopping the cleaning operation is performed. In the cleaning stopping operation, the on-off valve 59 enters the closed state by stopping pressing of the diaphragm 56 by the pressing mechanism 48. Accordingly, the upstream and the downstream of the pressure adjustment mechanism 35 are blocked and thus the pressurized first liquid L1 is not supplied from the liquid supply source 13 to the liquid ejecting portion 12.

In the present embodiment, the cleaning operation and the cleaning stopping operation are repeatedly performed at short intervals. Accordingly, a decrease in flow speed of the first liquid L1 flowing in the liquid supply flow path 27 and the liquid ejecting portion 12 during the cleaning operation is suppressed and it becomes easy to remove foreign substances such as air bubbles from the insides of the liquid supply flow path 27 and the liquid ejecting portion 12.

The pressure in the liquid ejecting portion 12 disposed downstream of the pressure adjustment mechanism 35 becomes high immediately after the cleaning stopping operation is performed. That is, immediately after the cleaning stopping operation is performed, the state of the inside of the liquid ejecting portion 12 becomes not suitable for the recording process. Therefore, after the cleaning stopping operation is performed, the preceding wiping operation is performed as the pressure reducing operation in order to reduce the pressure in the liquid ejecting portion 12.

Immediately after the cleaning stopping operation is performed, the first liquid L1 continues to drop from the nozzle 19. That is, immediately after the cleaning stopping operation is performed, a state where the first liquid L1 is discharged from the nozzle 19 continues. The first liquid L1 continues to be discharged from the nozzle 19 until the pressure in the liquid ejecting portion 12 is reduced and the meniscus is formed in the nozzle 19. At this time, the meniscus that is formed in the nozzle 19 or in the vicinity of the opening of the nozzle 19 is a meniscus that is curved toward the outside of the nozzle 19 from the nozzle opening or the vicinity of the opening of the nozzle 19 instead of a meniscus that is formed in the nozzle 19 when the recording process is performed and that is curved toward the inside of the nozzle 19.

Figure 14:
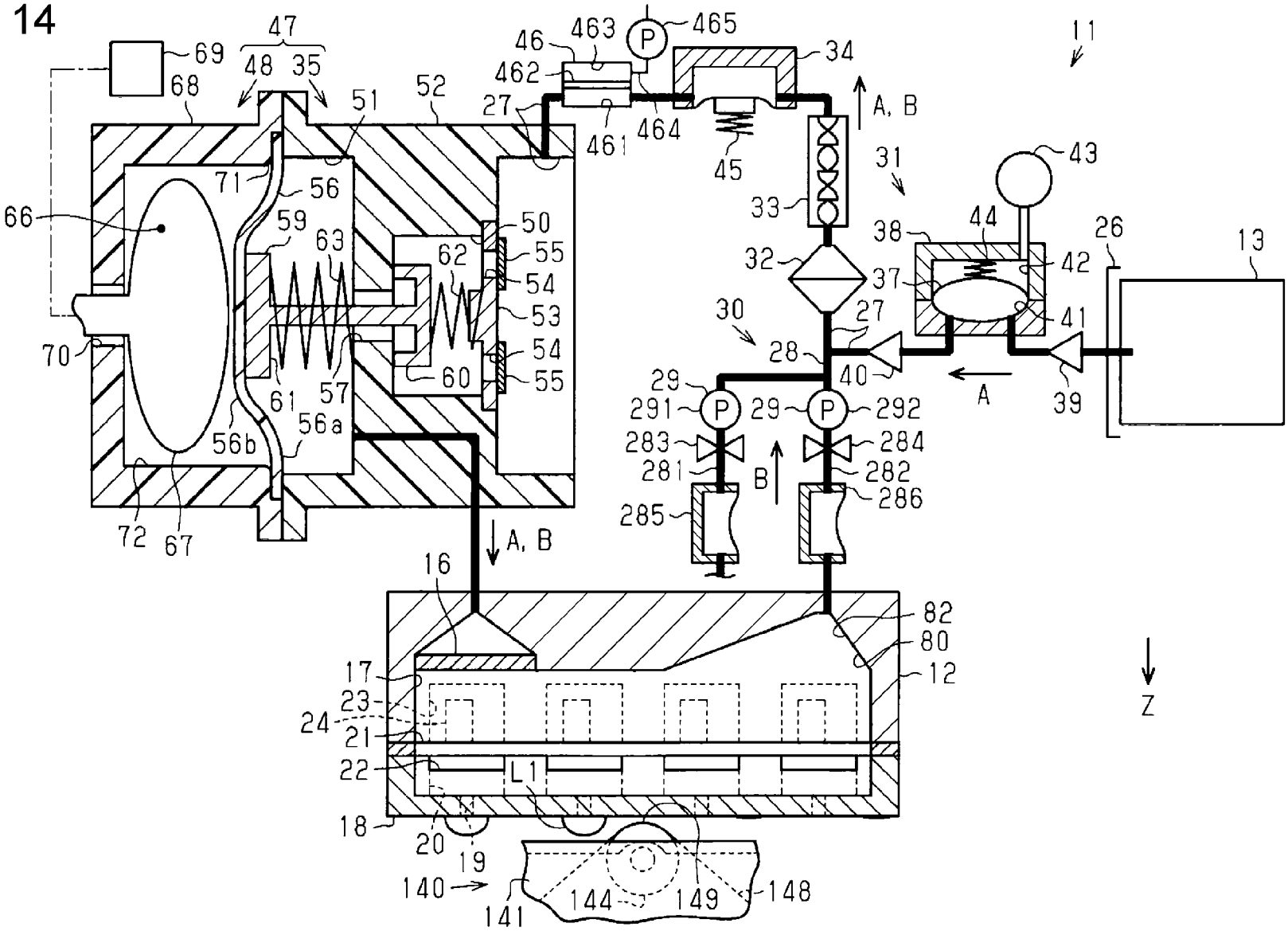
FIG. 14 is a sectional view schematically illustrating the pressure adjustment mechanism and the liquid ejecting portion in the middle of a pressure reducing operation.

As illustrated in FIG. 14, in the preceding wiping operation, the carriage 124 is moved such that the liquid ejecting portion 12 faces the wiping mechanism 140, and the wiping mechanism 140 wipes the liquid ejecting portion 12. Therefore, since the pressure in the liquid ejecting portion 12 becomes a positive pressure, and the gas-liquid interface swelling toward the outside of the nozzle 19 comes into contact with the wiping portion 149 of the fabric wiper 148, the first liquid L1 leaks out from the liquid ejecting portion 12.

The purpose of the preceding wiping operation is to reduce the pressure in the liquid ejecting portion 12 by causing the first liquid L1 to leak out from the nozzle 19. Therefore, in the preceding wiping operation, the wiping operation may be performed in a state where the gas-liquid interface swelling from the nozzle 19 are in contact with the wiping portion 149 while the nozzle surface 18 of the liquid ejecting portion 12 is not in contact with the wiping portion 149 as illustrated in FIG. 14. In the preceding wiping operation, the wiping operation may be performed in a state where the nozzle surface 18 of the liquid ejecting portion 12 is in contact with the wiping portion 149.

When the cleaning process is performed, air bubbles may not be fully discharged from liquid ejecting portion 12 and the liquid supply flow path 27 and the air bubbles may remain in the liquid ejecting portion 12 and the liquid supply flow path 27. In the cleaning operation, since the pressure of the first liquid L1 is high, the volume of air bubbles in the first liquid L1 is small. After the cleaning stopping operation, since the pressure of the first liquid L1 is reduced, the volume of air bubbles in the first liquid L1 is large. Therefore, the volume of air bubbles is changed in the cleaning operation and the cleaning stopping operation. Due to the change in volume of air bubbles, the pressure in the liquid ejecting portion 12 and the liquid supply flow path 27 when the meniscus is formed in the nozzle 19 may become higher.

When the wiping operation is performed in a state where the pressure in the liquid ejecting portion 12 and the liquid supply flow path 27 is made higher, the wiping portion 149 may break the unstable convex meniscus swelling from the nozzle opening while coming into contact with the meniscus and thus the first liquid L1 may spread over the nozzle surface 18. That is, when the wiping operation is performed, the meniscus formed in the nozzle 19 may become unstable. Therefore, it is assumed that a state where the pressure in the liquid ejecting portion 12 and a portion of the liquid supply flow path 27 that is positioned downstream of the pressure adjustment device 47 is stable is a state where the pressure in the liquid ejecting portion 12 and the liquid supply flow path 27 becomes a negative pressure to such an extent that meniscus is formed in the nozzle 19.

When the preceding wiping operation is finished, the pressure in the liquid ejecting portion 12 and the portion of the liquid supply flow path 27 that is positioned downstream of the pressure adjustment device 47 becomes stable. Thereafter, the finishing wiping operation is performed.

Figure 15:
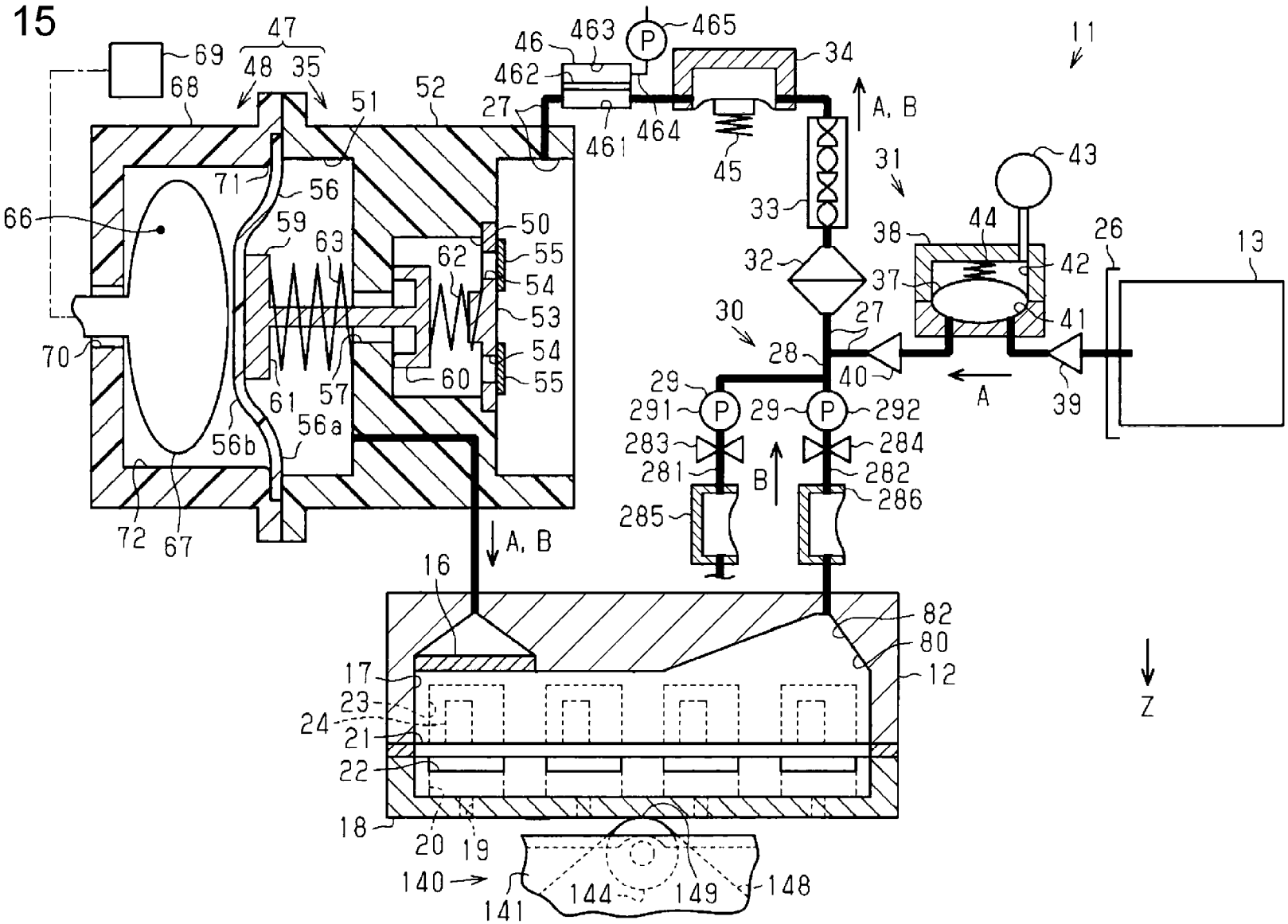
FIG. 15 is a sectional view schematically illustrating the pressure adjustment mechanism and the liquid ejecting portion in the middle of a finishing wiping operation.

As illustrated in FIG. 15, in the finishing wiping operation, wiping is performed in a state where the wiping portion 149 of the fabric wiper 148 is in contact with the nozzle surface 18 of the liquid ejecting portion 12. In this manner, the liquid adhering to the nozzle surface 18 of the liquid ejecting portion 12 is removed and a normal meniscus is formed in the nozzle 19 of the liquid ejecting portion 12.

Next, as a maintenance method for the liquid ejecting apparatus 11, when the first liquid L1 is discharged from the liquid ejecting portion 12 for the purpose of maintenance and flushing or pressurization cleaning is performed, a receiving process in which the liquid receiving portion 131 receives the first liquid L1 will be described.

Figure 16:
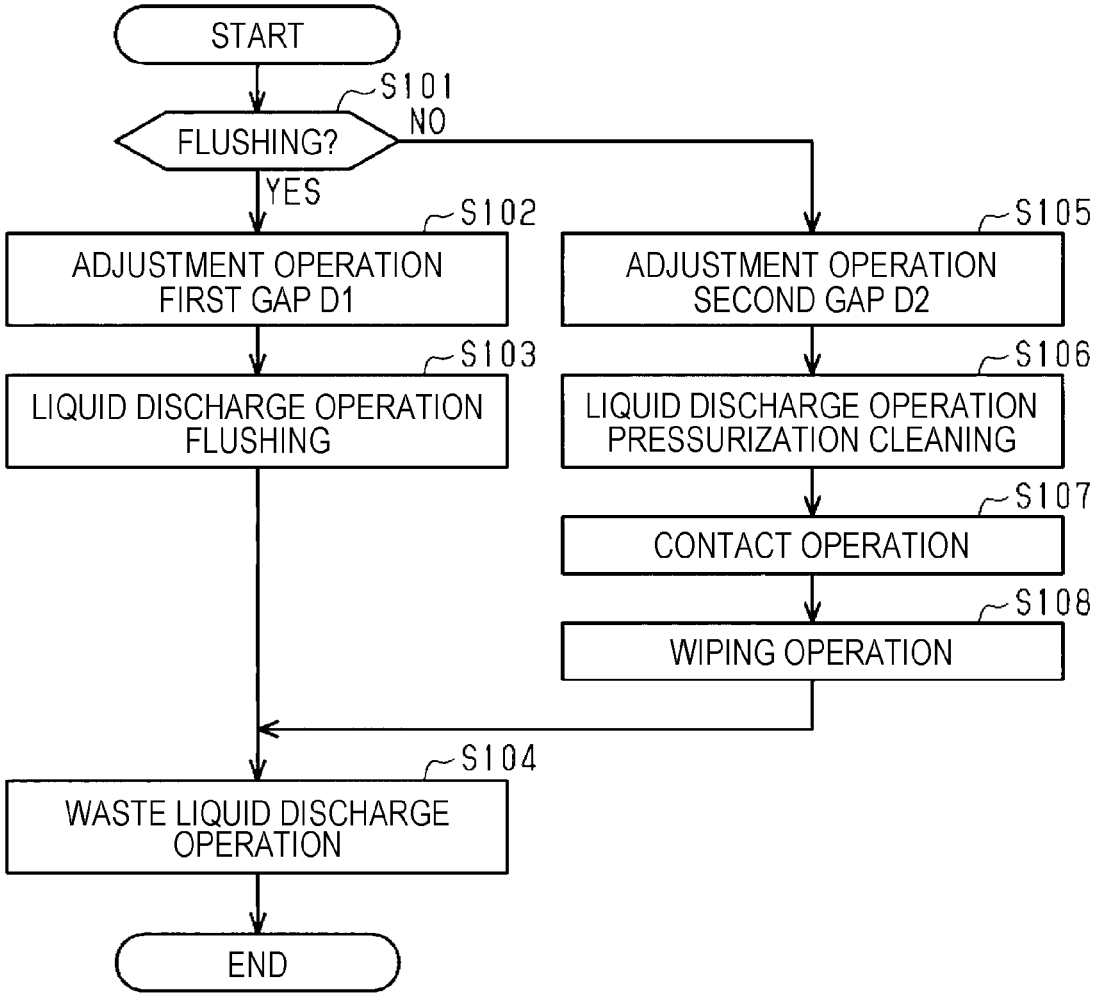
FIG. 16 is a flowchart illustrating an example of a receiving process.

As illustrated in FIG. 16, in Step S101, the control portion 160 which performs the receiving process determines which of the flushing and the pressurization cleaning is to be performed. The control portion 160 transitions into a process in Step S102 when it is determined that the flushing is performed in Step S101.

In Step S102, the control portion 160 performs an adjustment operation of adjusting the position of the liquid surface Ls of the liquid L accommodated in the liquid receiving portion 131. In the adjustment operation of Step S102, a gap between the liquid surface Ls of the liquid L accommodated in the liquid receiving portion 131 and the nozzle surface 18 is set as a first gap D1. The first gap D1 is, for example, 1.5 mm.

After the adjustment operation in Step S102, the control portion 160 performs a liquid discharge operation in Step S103. In the liquid discharge operation, the first liquid L1 is discharged from the nozzle 19 toward the liquid surface Ls of the liquid L accommodated in the liquid receiving portion 131. Specifically, the control portion 160 performs flushing of discharging the first liquid L1 from the nozzle 19 by driving the actuator 24 as the liquid discharge operation.

In Step S104, the control portion 160 performs a waste liquid discharge operation of discharging the liquid L in the liquid receiving portion 131 from the liquid receiving portion 131.

The control portion 160 transitions into a process in Step S105 when it is determined that the pressurization cleaning is performed in Step S101.

In Step S105, the control portion 160 performs an adjustment operation of adjusting the position of the liquid surface Ls of the liquid L accommodated in the liquid receiving portion 131. In the adjustment operation of Step S105, a gap between the liquid surface Ls of the liquid L accommodated in the liquid receiving portion 131 and the nozzle surface 18 is set as a second gap D2. The second gap D2 is, for example, 3 mm.

After the adjustment operation in Step S105, the control portion 160 performs a liquid discharge operation in Step S106. In the liquid discharge operation, the first liquid L1 is discharged from the nozzle 19 toward the liquid surface Ls of the liquid L accommodated in the liquid receiving portion 131. Specifically, the control portion 160 performs pressurization cleaning of discharging the pressurized first liquid L1 from the nozzle 19 by driving the pressurizing mechanism 31 as the liquid discharge operation. In the liquid discharge operation, the pressurizing mechanism 31 pressurizes the first liquid L1 and discharges the first liquid L1 from the nozzle 19.

In Step S107, the control portion 160 performs a contact operation. In the contact operation, the control portion 160 drives the supply pump 330 in a state where the liquid flow path 329 and the first waste liquid flow path 321 are coupled to each other to supply the second liquid L2 to the liquid receiving portion 131, thereby raising the liquid surface Ls. That is, the control portion 160 brings the first liquid L1 expanded from the nozzle surface 18 by the liquid discharge operation into contact with the liquid L in the liquid receiving portion 131. After the contact operation in Step S107, the control portion 160 performs a wiping operation of wiping the nozzle surface 18 in Step S108, and transitions into the process in Step S104.

Next, an effect when the liquid ejecting apparatus 11 performs the receiving process will be described.

As illustrated in FIG. 6, in the liquid discharge operation, the control portion 160 may change the position of the liquid surface Ls obtained when the flushing is performed and the position of the liquid surface Ls obtained when the pressurization cleaning is performed. The liquid ejecting portion 12 ejects the first liquid L1 toward the liquid surface Ls separated by the first gap D1 to perform flushing. The first gap D1 between the liquid surface Ls and the nozzle surface 18 when the flushing is performed is smaller than the second gap D2 between the liquid surface Ls and the nozzle surface 18 when the pressurization cleaning is performed.

The control portion 160 drives the supply pump 330 in a state where the liquid flow path 329 and the first waste liquid flow path 321 are coupled to each other to supply the second liquid L2 accommodated in the liquid accommodation portion 328 to the liquid receiving portion 131 and to cause the liquid L to overflow from the liquid receiving portion 131, thereby maintaining the liquid surface Ls at the upper limit position Pm. The control portion 160 may drive the supply pump 330 while performing the flushing as the liquid discharge operation. That is, the control portion 160 may perform the liquid discharge operation while causing the liquid L accommodated in the liquid receiving portion 131 to flow.

As illustrated in FIG. 13, the control portion 160 performs the pressurization cleaning in a state where the gap between the liquid surface Ls and the nozzle surface 18 is set as the second gap D2. When the pressurization cleaning is performed, the expanded first liquid L1 adheres to the nozzle surface 18. The first liquid L1 expanded from the nozzle surface 18 is held by the nozzle surface 18 so as to hang from the nozzle surface 18. The nozzle surface 18 can hold the first liquid L1 having a thickness D illustrated in FIG. 13 from the lower end of the expanded first liquid L1 to the nozzle surface 18. In other words, the first liquid L1 drops from the nozzle surface 18 when it has a thickness thicker than the thickness D.

The first gap D1 is smaller than the thickness D, and the second gap D2 is larger than the thickness D. Therefore, while the pressurization cleaning is performed at the second gap D2, the first liquid L1 expanded from the nozzle surface 18 does not contact the liquid L accommodated in the liquid receiving portion 131, and the liquid receiving portion 131 receives the first liquid L1 dropped from the nozzle surface 18.

After the pressurization cleaning is performed, the control portion 160 drives the supply pump 330 in a state where the liquid flow path 329 and the first waste liquid flow path 321 are coupled to each other to supply the second liquid L2 accommodated in the liquid accommodation portion 328 to the liquid receiving portion 131. Accordingly, the liquid surface Ls of the liquid receiving portion 131 rises, and the gap between the nozzle surface 18 and the liquid surface Ls becomes smaller.

The first gap D1 between the liquid surface Ls positioned at the upper limit position Pm and the nozzle surface 18 is smaller than the thickness D of the first liquid L1 expanded to the nozzle surface 18 by the pressurization cleaning. Therefore, when the second liquid L2 is supplied to the liquid accommodation portion 328 and the liquid surface Ls rises, the first liquid L1 expanded from the nozzle surface 18 comes into contact with the liquid L in the liquid receiving portion 131. The liquid L in the liquid receiving portion 131 is pulled up to the nozzle surface 18 by contacting with the first liquid L1, and the liquid L is supplied to the nozzle surface 18.

As illustrated in FIGS. 14 and 15, in the wiping operation, the foreign substances adhering to the nozzle surface 18 and the liquid L supplied to the nozzle surface 18 are wiped by the wiping mechanism 140. The control portion 160 may perform the preceding wiping operation and the finishing wiping operation as the wiping operation.

The waste liquid discharge operation of discharging the liquid L in the liquid receiving portion 131 may be performed each time the flushing or the pressurization cleaning is performed, or may be performed each time the flushing or the pressurization cleaning is performed a plurality of times. In the liquid L accommodated in the liquid receiving portion 131, the first liquid L1 is received or the second liquid L2 is evaporated, so that the viscosity of the liquid L may increase to make the liquid difficult to flow. In the waste liquid discharge operation, while the liquid L can flow, the waste liquid pump 324 is driven in a state where the first waste liquid flow path 321 and the second waste liquid flow path 322 are coupled to each other and the liquid L is discharged from the liquid receiving portion 131. After the liquid L in the liquid receiving portion 131 is discharged, the second liquid L2 may be supplied to the liquid receiving portion 131.

Next, a method for manufacturing the pressure adjustment device 47 according to the present embodiment will be described.

First, the main body portion 52 of the present embodiment is formed of a light absorbing resin which generates heat when absorbing laser light, or a resin colored with a dye which absorbs light. The light absorbing resin is, for example, polypropylene or polybutylene terephthalate.

The diaphragm 56 is formed by laminating different materials such as polypropylene and polyethylene terephthalate. The diaphragm 56 has transparency which allows laser light to pass therethrough and flexibility.

The retaining member 68 is formed of a light transmitting resin which transmits laser light. The light transmitting resin is, for example, polystyrene or polycarbonate. The transparency of the diaphragm 56 is greater than the transparency of the main body portion 52 and is lower than the transparency of the retaining member 68.

As illustrated in FIG. 4, first, as an interposing step, the diaphragm 56 is interposed between the retaining member 68, in which a portion of the expansion and contraction portion 67 has been inserted into the insertion hole 70, and the main body portion 52. Next, irradiation with laser light is performed via the retaining member 68 as an irradiation step. As a result, the laser light passing through the retaining member 68 is absorbed by the main body portion 52 and the main body portion 52 generates heat. The main body portion 52, the diaphragm 56, and the retaining member 68 are welded to each other due to the heat generated at this time. Therefore, the retaining member 68 also functions as a jig which presses the diaphragm 56 when the pressure adjustment device 47 is manufactured.

Effects of the present embodiment will be described.

(1) The discharge port 318 for discharging the liquid L opens at a position below the upper limit position Pm of the liquid surface Ls in the liquid receiving portion 131. The discharge portion 313 can adjust the position of the liquid surface Ls between the upper limit position Pm and the discharge port 318 by discharging the liquid L in a state where the liquid surface Ls is positioned at the upper limit position Pm, for example. Therefore, the maintenance of the liquid ejecting portion 12 can be performed with the specifications changed.

(2) Since the discharge port 318 opens at the bottom 319 of the liquid receiving portion 131, the discharge portion 313 can adjust the position of the liquid surface Ls between the upper limit position Pm and the bottom 319. Since the supply portion 312 supplies the second liquid L2 to the liquid receiving portion 131 via the waste liquid flow path 320 coupled to the discharge port 318, it is possible to make it difficult for the liquid L discharged from the discharge port 318 and the waste liquid flow path 320 to remain in the waste liquid flow path 320.

(3) The maintenance portion 311 collects the liquid L getting over the upper limit position Pm in the liquid collection portion 315 via the partition wall 316. That is, the maintenance portion 311 can set the upper limit position Pm according to the height of the partition wall 316, and can easily maintain the liquid surface Ls of the liquid L accommodated in the liquid receiving portion 131 at the upper limit position Pm.

(4) After adjusting the position of the liquid surface Ls of the liquid L accommodated in the liquid receiving portion 131 by the adjustment operation, the first liquid L1 is discharged from the nozzle 19 by the liquid discharge operation and the liquid ejecting portion 12 is maintained. Therefore, the maintenance of the liquid ejecting portion 12 can be performed with the specifications changed.

(5) In the liquid discharge operation, the first liquid L1 is discharged from the nozzle 19 toward the liquid surface Ls of which position is adjusted by the adjustment operation. Therefore, the occurrence of mist or splashing can be reduced, and the risk of contaminating the surroundings can be reduced.

(6) When flushing of discharging the first liquid L1 from the nozzle 19 is performed by driving the actuator 24, mist may occur. In that respect, since the flushing is performed in a state where the position of the liquid surface Ls is adjusted, the occurrence of mist can be reduced.

(7) The pressurization cleaning is performed in a state where the position of the liquid surface Ls is adjusted. Therefore, for example, the pressurization cleaning can be performed while reducing the possibility that the liquid surface Ls and the nozzle surface 18 meet by the first liquid L1.

(8) Since the first gap D1 between the liquid surface Ls and the nozzle surface 18 when the flushing is performed is smaller than the second gap D2 when the pressurization cleaning is performed, the occurrence of mist due to the flushing can be reduced. Since the second gap D2 between the liquid surface Ls and the nozzle surface 18 when the pressurization cleaning is performed is greater than the first gap D1, it is possible to reduce the possibility that the liquid surface Ls and the nozzle surface 18 meet by the first liquid L1 discharged from the nozzle 19. Therefore, flushing or pressurization cleaning can be performed under appropriate conditions.

(9) In the contact operation, the first liquid L1 expanded from the nozzle surface 18 is brought into contact with the liquid L in the liquid receiving portion 131. For example, when the lyophilic property of the nozzle surface 18 is high, the second liquid L2 in the liquid receiving portion 131 is pulled up to the nozzle surface 18 by the contact operation. Therefore, since the second liquid L2 can be supplied to the nozzle surface 18, the nozzle surface 18 is wiped such that foreign substances adhering to the nozzle surface 18 can be easily removed. Note that, the term "lyophilic property is high" as used herein means that the contact angle formed by the nozzle surface 18 and the droplets of the second liquid L2 is smaller than 90°.

(10) In the liquid discharge operation, the first liquid L1 is discharged from the nozzle 19 while causing the liquid L accommodated in the liquid receiving portion 131 to flow. Therefore, it is possible to reduce the possibility that the first liquid L1 is increased in viscosity or solidified to stay in the liquid receiving portion 131.

The present embodiment can be modified as follows. The present embodiment and the following modification examples can be combined with each other unless there is a technical contradiction.

Figure 17:
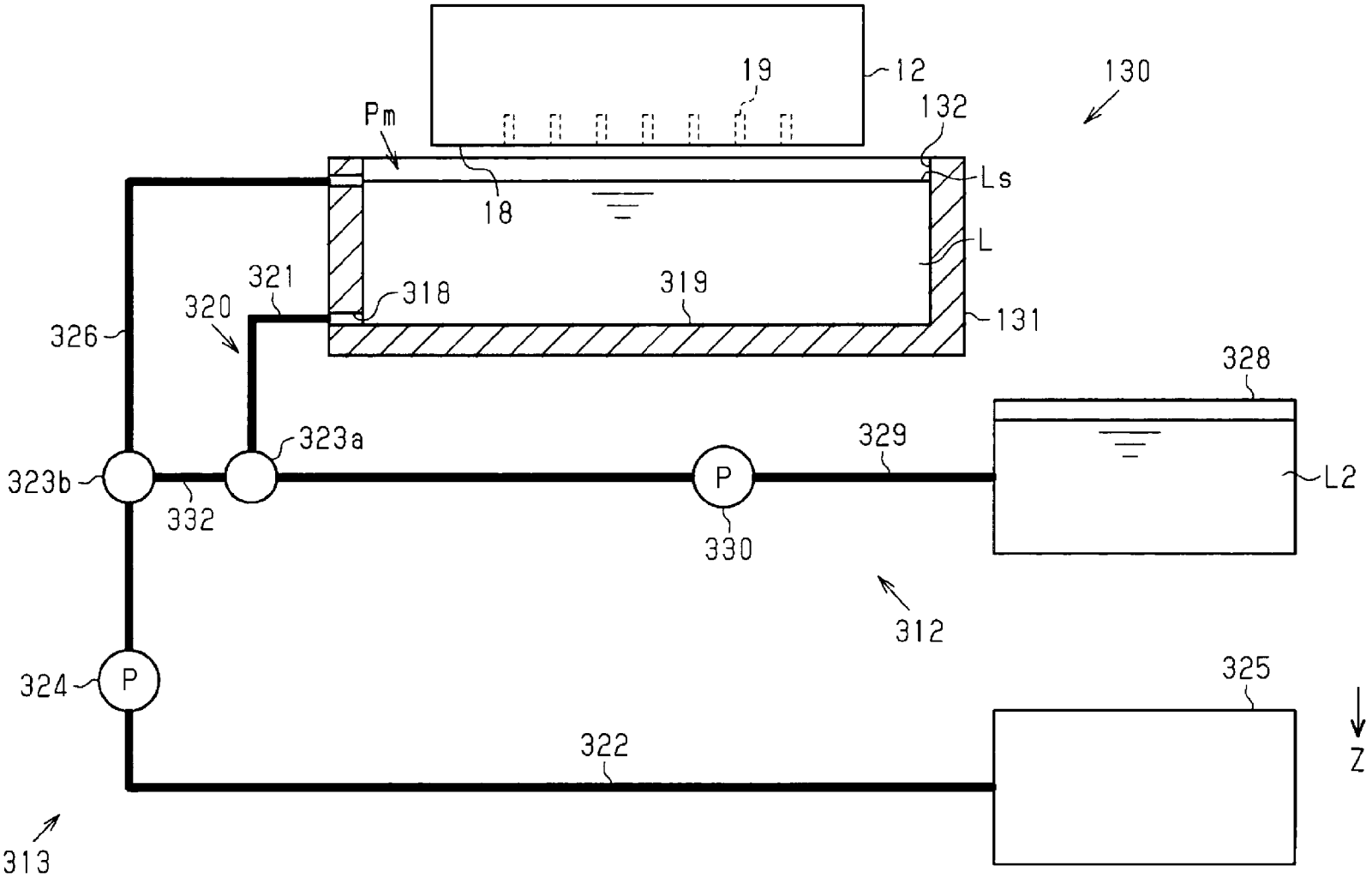
FIG. 17 is a sectional view schematically illustrating a first modification example of the flushing mechanism.

FIG. 17 illustrates a first modification example of the flushing mechanism 130. The discharge port 318 may be formed at a position different from the bottom 319 in the liquid receiving portion 131. For example, the discharge port 318 may be formed on the side wall of the liquid receiving portion 131.

As illustrated in FIG. 17, the discharge portion 313 may include a first switching portion 323*a* coupled to the downstream end of the first waste liquid flow path 321, a second switching portion 323*b* coupled to the upstream end of the second waste liquid flow path 322, and a coupling flow path 332 which couples the first switching portion 323*a* and the second switching portion 323*b* to each other. The upstream end of the collection flow path 326 may be coupled to a position above the discharge port 318 in the liquid receiving portion 131. The downstream end of the collection flow path 326 may be coupled to the second switching portion 323*b*. The first switching portion 323*a* couples any two of the first waste liquid flow path 321, the liquid flow path 329, and the coupling flow path 332 to each other. The second switching portion 323*b* couples any two of the second waste liquid flow path 322, the collection flow path 326, and the coupling flow path 332 to each other.

As illustrated in FIG. 17, the control portion 160 drives the supply pump 330 in a state where the first waste liquid flow path 321 and the liquid flow path 329 are coupled to each other to supply the second liquid L2 accommodated in the liquid accommodation portion 328 to the liquid receiving portion 131. The supply portion 312 supplies the second liquid L2 to the liquid receiving portion 131 from the discharge port 318. When the second liquid L2 is supplied to the liquid receiving portion 131 or when the liquid receiving portion 131 receives the first liquid L1, the control portion 160 drives the waste liquid pump 324 in a state where the collection flow path 326 and the second waste liquid flow path 322 are coupled to each other. Accordingly, the liquid L overflowing from the upper limit position Pm is sent to the waste liquid accommodation portion 325 via the collection flow path 326 and the second waste liquid flow path 322, and the position of the liquid surface Ls is maintained at the upper limit position Pm.

As illustrated in FIG. 17, the control portion 160 drives the waste liquid pump 324 in a state where the first waste liquid flow path 321 and the coupling flow path 332 are coupled to each other and the coupling flow path 332 and the second waste liquid flow path 322 are coupled to each other to discharge the liquid L accommodated in the liquid receiving portion 131 from the discharge port 318. Accordingly, the position of the liquid surface Ls is lowered from the upper limit position Pm. That is, the control portion 160 supplies the second liquid L2 from the discharge port 318, and discharges the liquid L from the discharge port 318 to change the position of the liquid surface Ls between the discharge port 318 and the upper limit position Pm.

Figure 18:
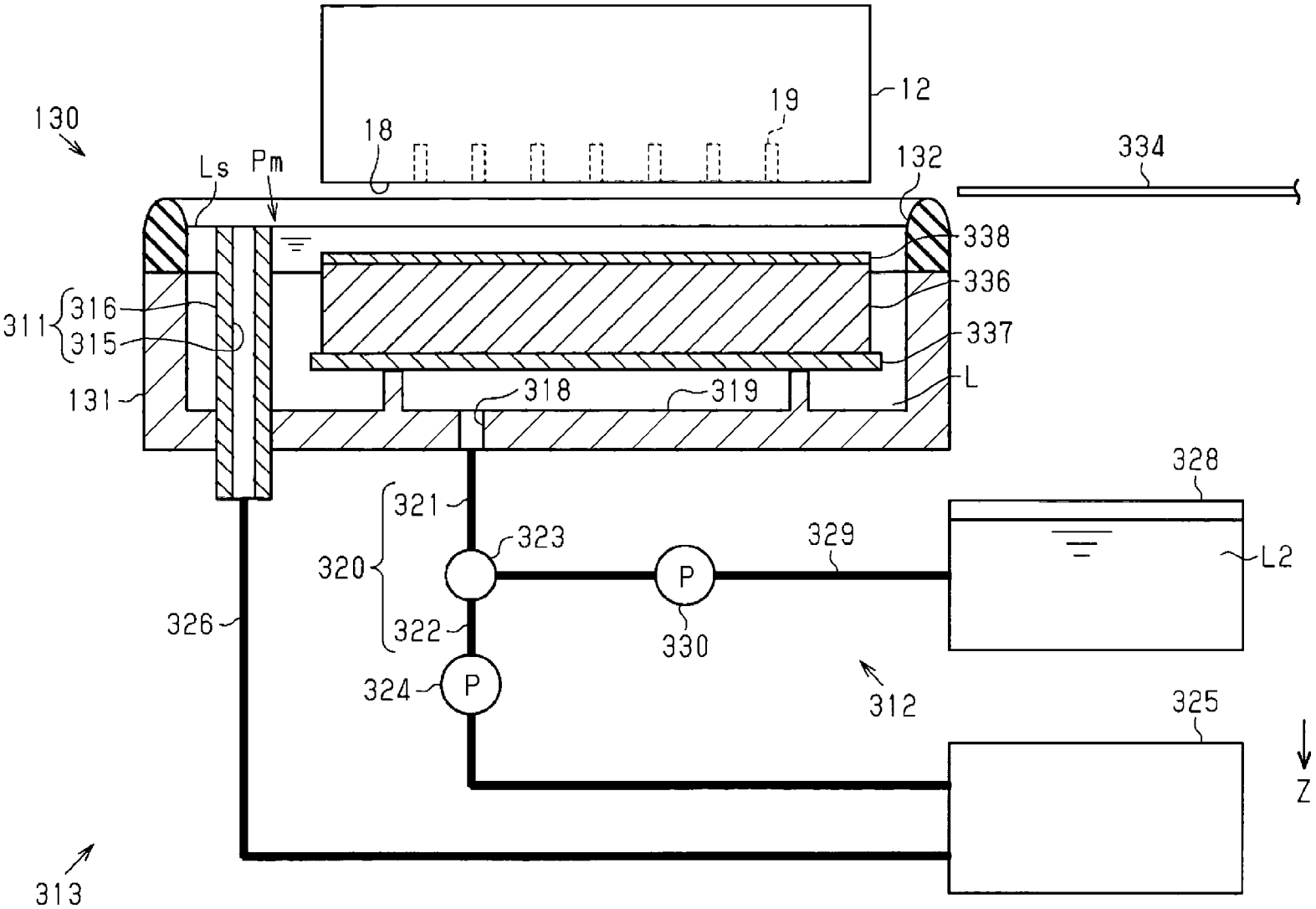
FIG. 18 is a sectional view schematically illustrating a second modification example of the flushing mechanism.

FIG. 18 illustrates a second modification example of the flushing mechanism 130. The flushing mechanism 130 may include an openable lid 334 covering the opening 132 of the liquid receiving portion 131. For example, by covering the liquid receiving portion 131 with the lid 334, the liquid ejecting apparatus 11 can be moved while the liquid L is accommodated in the liquid receiving portion 131. When the opening 132 is formed of an elastic member such as rubber or an elastomer, the lid 334 can easily come into close contact with the liquid receiving portion 131.

As illustrated in FIG. 18, the flushing mechanism 130 may include an absorber 336 provided in the liquid receiving portion 131, a support portion 337 supporting the absorber 336 at a position above the bottom 319, and a pressing plate 338 pressing the swelling absorber 336. The support portion 337 supports the absorber 336 at the position above the bottom 319.

As illustrated in FIG. 18, the partition wall 316 may be formed in a tubular shape. The liquid collection portion 315 may be formed so as to be surrounded by the liquid receiving portion 131. The pressing plate 338 presses the absorber 336 such that the upper end of the absorber 336 is positioned lower than the upper end of the partition wall 316. That is, the absorber 336 is positioned below the upper limit position Pm of the liquid surface Ls. When the liquid surface Ls is positioned at the upper limit position Pm, the absorber 336 is positioned in the liquid L. Accordingly, the absorber 336 can be cleaned. The control portion 160 may lower the liquid surface Ls to expose a portion of the absorber 336 from the liquid L. The liquid ejecting portion 12 may eject the first liquid L1 toward the absorber 336 to perform flushing. For example, when the first liquid L1 is ejected toward the liquid surface Ls to perform flushing, the liquid surface Ls may shake and the gap between the liquid surface Ls and the nozzle surface 18 may change. In that respect, since the gap between the absorber 336 and the nozzle surface 18 is kept constant, the flushing can be performed stably.

Figure 19:
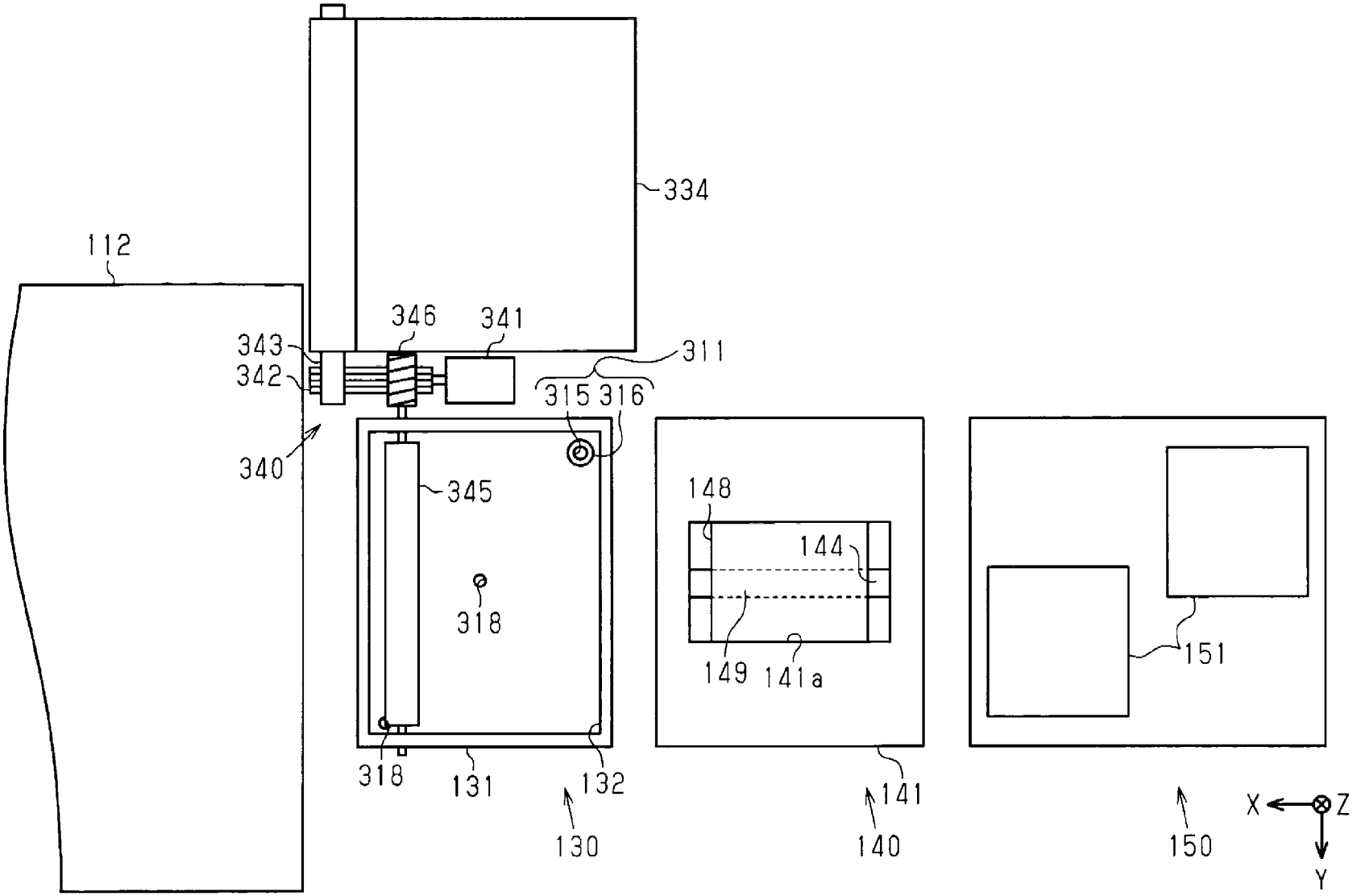
FIG. 19 is a plan view schematically illustrating a third modification example of the flushing mechanism.
Figure 20:
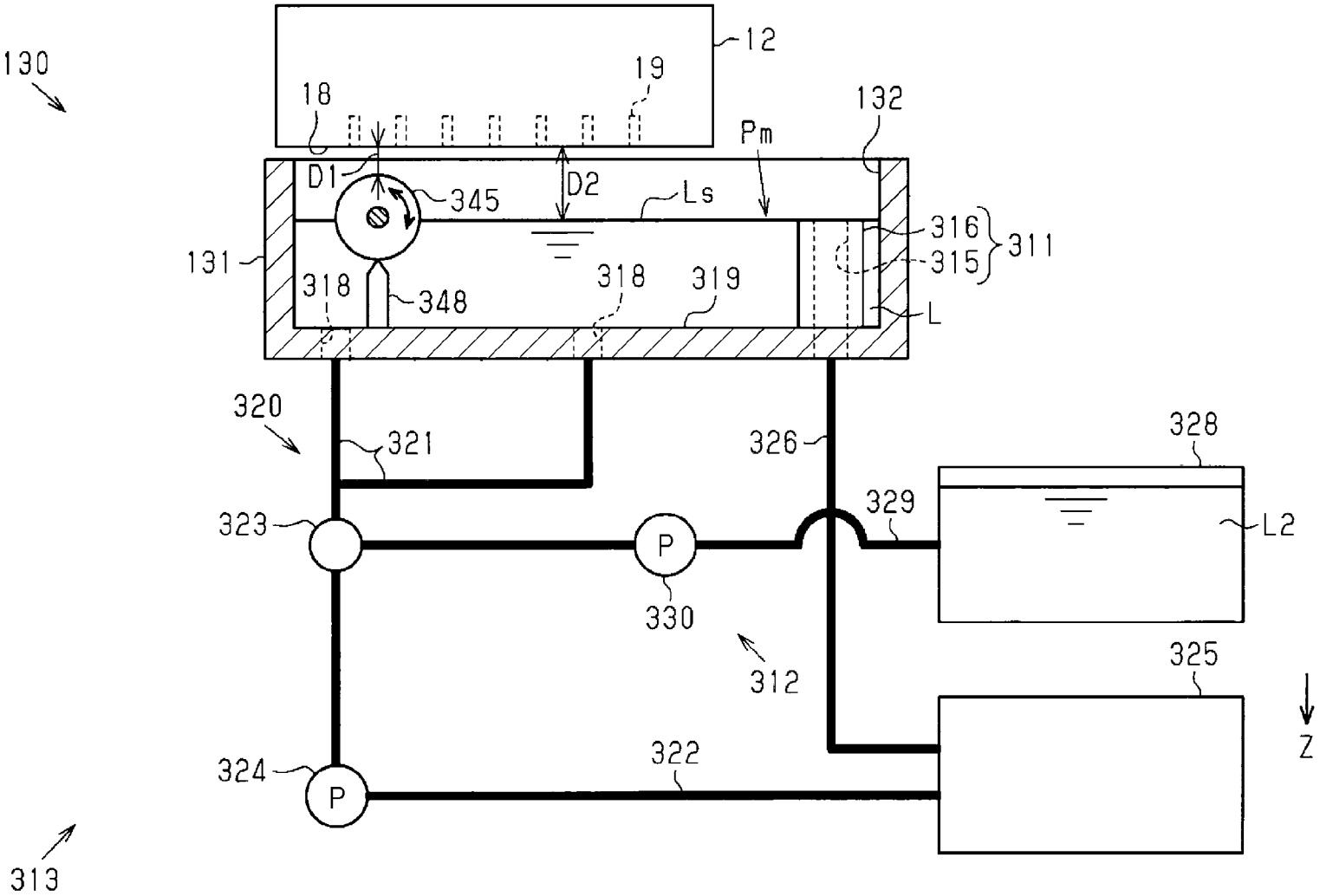
FIG. 20 is a sectional view schematically illustrating the third modification example of the flushing mechanism.

FIGS. 19 and 20 illustrate a third modification example of the flushing mechanism 130. A plurality of discharge ports 318 may be formed in the liquid receiving portion 131. The discharge port 318 may be provided at the center of the liquid receiving portion 131 or at the corner thereof. When the plurality of discharge ports 318 are provided, the first waste liquid flow path 321 may be branched and coupled to each of the discharge ports 318.

As illustrated in FIG. 19, the flushing mechanism 130 may include a moving mechanism 340 for moving the lid 334. The moving mechanism 340 includes a drive source 341, a pinion 342 coupled to the drive source 341, and a rack 343 that meshes with the pinion 342. The lid 334 is attached to the rack 343. When the pinion 342 rotates in accordance with the driving of the drive source 341, the lid 334 moves together with the rack 343. The lid 334 moves between an open position illustrated in FIG. 19 which exposes the opening 132 of the liquid receiving portion 131 and a closed position (not illustrated) covering the opening 132 of the liquid receiving portion 131.

As illustrated in FIG. 19, the flushing mechanism 130 may include a receiving roller 345 for receiving the first liquid L1 discharged from the liquid ejecting portion 12. The receiving roller 345 may be coupled to a worm gear 346 that meshes with the rack 343. That is, the receiving roller 345 may rotate as the lid 334 is opened and closed. The flushing mechanism 130 may separately include a drive source for rotating the receiving roller 345.

As illustrated in FIG. 20, a portion of the receiving roller 345 is positioned below the upper limit position Pm, and the upper end thereof is positioned above the upper limit position Pm. The gap between the upper end of the receiving roller 345 and the nozzle surface 18 may be set as a first gap D1, and the gap between the liquid surface Ls of the liquid L accommodated in the liquid receiving portion 131 and the nozzle surface 18 may be set as a second gap D2. The flushing mechanism 130 may include a scraper 348 in contact with the receiving roller 345 in the liquid L. The scraper 348 can scrape off the first liquid L1 adhering to the rotating receiving roller 345.

As illustrated in FIG. 20, the liquid ejecting portion 12 may discharge the first liquid L1 from the nozzle 19 toward the liquid receiving portion 131. The liquid ejecting portion 12 may eject the first liquid L1 toward the receiving roller 345 to perform flushing. In the pressurization cleaning, the first liquid L1 may be discharged from the nozzle 19 toward the liquid surface Ls of the liquid L accommodated in the liquid receiving portion 131.

Figure 21:
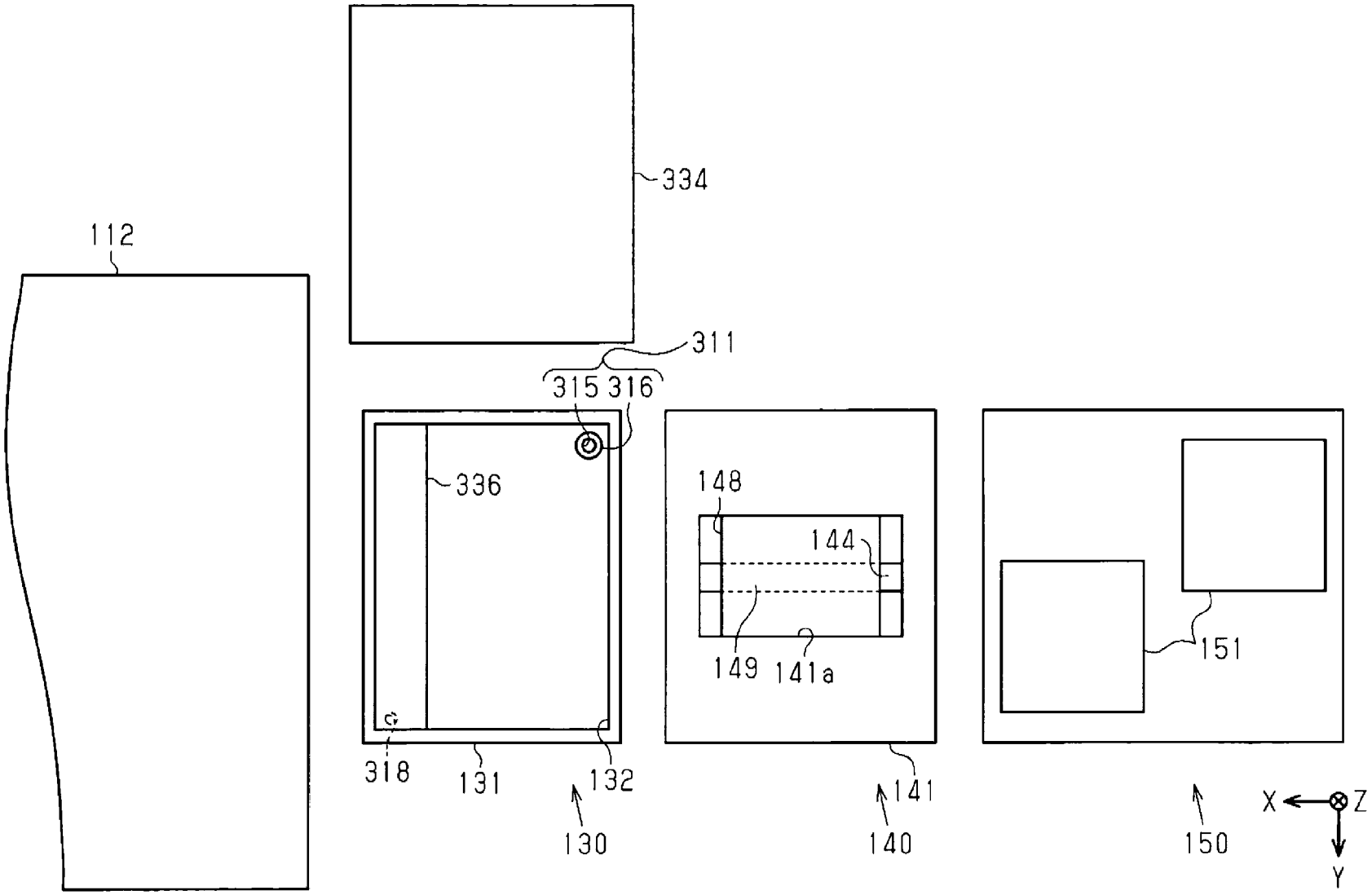
FIG. 21 is a plan view schematically illustrating a fourth modification example of the flushing mechanism.
Figure 22:
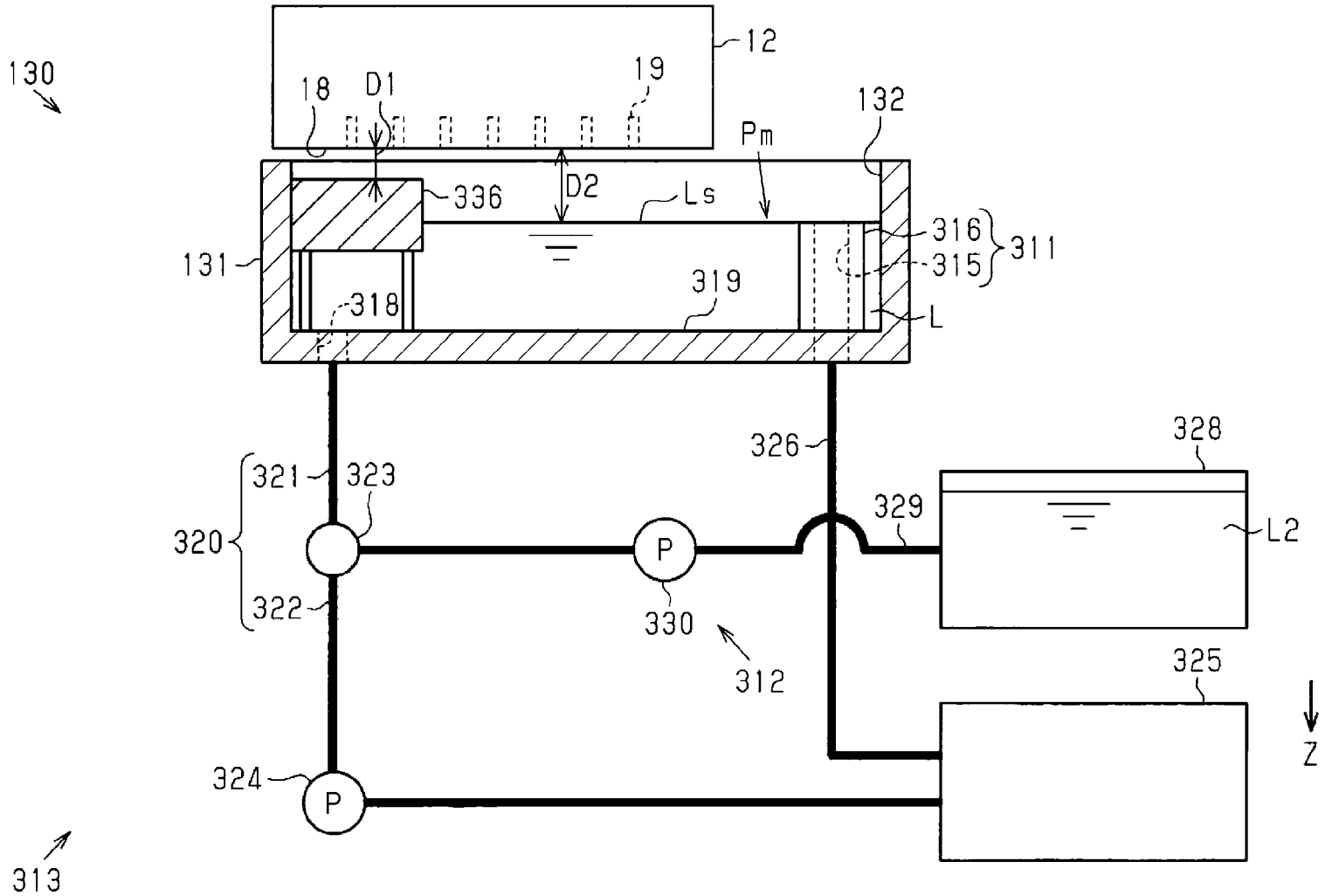
FIG. 22 is a sectional view schematically illustrating the fourth modification example of the flushing mechanism.

FIGS. 21 and 22 illustrate a fourth modification example of the flushing mechanism 130. The absorber 336 may be disposed at the end of the liquid receiving portion 131. The liquid ejecting portion 12 may eject the first liquid L1 toward the absorber 336 to perform flushing. The pressurization cleaning may be performed in a state where the liquid surface Ls of the liquid L accommodated in the liquid receiving portion 131 and the nozzle surface 18 face each other.

The gap between the nozzle surface 18 and the liquid surface Ls may be changed by relatively moving the liquid ejecting portion 12 and the liquid receiving portion 131 in the vertical direction Z. The liquid ejecting portion 12 and the liquid receiving portion 131 may move relative to each other so that the nozzle surface 18 is positioned below the upper limit position Pm. The liquid ejecting portion 12 is cleaned by the nozzle surface 18 being positioned in the liquid L. The supply portion 312 and the discharge portion 313 may discharge the liquid L in the liquid receiving portion 131 before cleaning the nozzle surface 18 with the liquid L, and newly supply the second liquid L2 to the liquid receiving portion 131 to clean the nozzle surface 18.

The capping mechanism 150 may include a cleaning container for cleaning the cap 151. The capping mechanism 150 may include a flow path coupling the liquid flow path 329 and the cleaning container to each other. The supply portion 312 may drive the supply pump 330 to supply the second liquid L2 accommodated in the liquid accommodation portion 328 to the cleaning container.

The bottom 319 of the liquid receiving portion 131 may be sloped down toward the discharge port 318.

The liquid receiving portion 131 may be provided above the casing 141 of the wiping mechanism 140 in the vertical direction. In this case, it is possible to perform the wiping operation without moving the liquid ejecting portion 12 after the pressurization cleaning is performed. Therefore, it is possible to suppress leakage of the pressurized first liquid L1 from the nozzle 19 of the liquid ejecting portion 12 due to vibration acting on the liquid ejecting portion 12 when the liquid ejecting portion 12 moves.

The pressing mechanism 48 may not include the expansion and contraction portion 67 and may press the diaphragm 56 by adjusting the pressure in the air chamber 72. For example, the pressing mechanism 48 may displace the diaphragm 56 in such a direction that the volume of the liquid outflow portion 51 is reduced by increasing the pressure in the air chamber 72. The pressing mechanism 48 may displace the diaphragm 56 in such a direction that the volume of the liquid outflow portion 51 is increased by reducing the pressure in the air chamber 72.

The flushing may be performed in a state where the supply of the second liquid L2 to the liquid receiving portion 131 is stopped. That is, the flushing may be performed in a state where the flow of the liquid L accommodated in the liquid receiving portion 131 is stopped.

The gap between the liquid surface Ls positioned at the upper limit position Pm and the nozzle surface 18 may be larger than the thickness D of the first liquid L1 expanded from the nozzle surface 18. The liquid L accommodated in the liquid receiving portion 131 may not be in contact with the first liquid L1 expanded from the nozzle surface 18.

In the flushing and pressurization cleaning, the position of the liquid surface Ls may not be changed. For example, the liquid ejecting portion 12 may perform flushing in a state where the gap between the nozzle surface 18 and the liquid surface Ls is set as the second gap D2.

The control portion 160 may perform the wiping operation in Step S108 without performing the contact operation in Step S107 after performing the pressurization cleaning as the liquid discharge operation in Step S106.

For the purpose of maintenance of the liquid ejecting portion 12, the control portion 160 may perform the liquid discharge operation in Step S106 after adjusting the gap between the liquid surface Ls of the liquid L accommodated in the liquid receiving portion 131 and the nozzle surface 18 to a gap at which the first liquid L1 expanded from the nozzle surface 18 and the liquid L in the liquid receiving portion 131 are in contact with each other in the adjustment operation in Step S105. The gap at which the first liquid L1 expanded from the nozzle surface 18 and the liquid L in the liquid receiving portion 131 are in contact with each other is, for example, a first gap D1. In this case, the wiping operation may be performed in Step S108 without performing the contact operation in Step S107.

The liquid ejecting portion 12 may include a nozzle forming member that constitutes the nozzle surface 18 in which the plurality of nozzles 19 are formed, and may form a liquid repellent film having high liquid repellency as a liquid repellent treatment on the nozzle opening surface where the nozzle 19 is open in the nozzle forming member. Note that, the term "high liquid repellency" as used herein means that the contact angle formed by the nozzle opening surface and the droplets of the second liquid L2 is equal to or greater than 90°. The liquid repellent film may be constituted by including, for example, a thin film underlayer mainly composed of polyorganosiloxane containing an alkyl group, and a liquid repellent film layer composed of metal alkoxide having a long chain polymer group containing fluorine. The nozzle surface 18 may be configured of a nozzle opening surface subjected to the liquid repelling treatment, and a cover member which covers a portion of the nozzle opening surface so that the nozzle 19 is exposed. In this case, the cover member may be made of, for example, a thin stainless steel member having a thickness of about 0.1 mm. A region having a high lyophilic property may be formed on the nozzle surface 18 by the cover member, and the liquid L in the liquid receiving portion 131 may be pulled up to the nozzle surface 18 by the contact operation. At this time, the liquid receiving portion 131 may accommodate the second liquid L2. Further, for example, when the plurality of nozzles 19 open to the nozzle opening surface are aligned in the transport direction Y to form a nozzle row, the cover member may be provided with through-holes so that the nozzle row is exposed. The through-hole has a dimension in the scanning direction X which is a direction intersecting the direction in which the nozzles 19 forming the nozzle row are arranged, and the dimension may be larger than the first gap D1 and smaller than the second gap D2, the first gap D1 and the second gap D2 being gaps between the liquid surface Ls of the liquid L and the nozzle surface 18. The dimension of the through-hole in the scanning direction X may be, for example, 2 mm.

The first gap D1 may be larger than the gap between the nozzle surface 18 and the upper limit position Pm. The position of the liquid surface Ls obtained when the flushing is performed may be a position between the position of the liquid surface Ls obtained when the pressurization cleaning is performed and the upper limit position Pm. In this case, in a state where the liquid surface Ls is positioned at the upper limit position Pm, the control portion 160 may discharge the liquid L in the liquid receiving portion 131 from the discharge port 318, and adjust the position of the liquid surface Ls to the first gap D1.

The liquid receiving portion 131 may be configured to receive one of the first liquid L1 discharged from the nozzle 19 by flushing and the first liquid L1 discharged from the nozzle 19 by pressurization cleaning. When the liquid receiving portion 131 receives the first liquid L1 discharged by flushing, the liquid ejecting apparatus 11 may not include the pressurizing mechanism 31. The liquid ejecting apparatus 11 may supply the first liquid L1 from the liquid supply source 13 to the liquid ejecting portion 12 using, for example, a water head.

The downstream end of the liquid flow path 329 may be directly coupled to the liquid receiving portion 131. The liquid flow path 329 may couple the liquid receiving portion 131 and the liquid accommodation portion 328 to each other. The supply portion 312 may supply the second liquid L2 to the liquid receiving portion 131 not via the waste liquid flow path 320. The supply portion 312 may supply the second liquid L2 from the opening 132 of the liquid receiving portion 131. The downstream end of the liquid flow path 329 may be coupled to the liquid ejecting portion 12. The supply portion 312 may supply the second liquid L2 to the liquid receiving portion 131 via the nozzle 19.

The first liquid L1 ejected by the liquid ejecting portion 12 is not limited to ink and may be, for example, a liquid into which functional particles are dispersed or mixed. For example, the liquid ejecting portion 12 may eject a liquid containing a material such as an electrode material or a pixel material used for production of liquid crystal displays, electroluminescent displays, and surface emission displays in the form of a dispersion or a solution.

Hereinafter, the technical idea and the effect thereof figured out from the above-described embodiment and the modification examples will be described.

A liquid ejecting apparatus includes a liquid ejecting portion configured to eject a first liquid from a nozzle, a liquid receiving portion configured to receive, in a state where a second liquid is accommodated in the liquid receiving portion, for a purpose of maintenance of the liquid ejecting portion, the first liquid discharged from the nozzle, a maintenance portion that maintains a liquid surface of a liquid accommodated in the liquid receiving portion at an upper limit position, and a discharge portion configured to discharge, from a discharge port open to the liquid receiving portion, the liquid accommodated in the liquid receiving portion. The discharge port is positioned below the upper limit position.

According to this configuration, the discharge port for discharging the liquid opens at a position below the upper limit position of the liquid surface in the liquid receiving portion. The discharge portion can adjust the position of the liquid surface between the upper limit position and the discharge port by discharging the liquid in a state where the liquid surface is positioned at the upper limit position Pm, for example. Therefore, the maintenance of the liquid ejecting portion can be performed with the specifications changed.

In the liquid ejecting apparatus, the discharge portion may have a waste liquid flow path coupled to the discharge port open at a bottom of the liquid receiving portion, and the liquid ejecting apparatus may further include a supply portion that supplies the second liquid to the liquid receiving portion via the waste liquid flow path.

According to this configuration, since the discharge port opens at the bottom of the liquid receiving portion, the discharge portion can adjust the position of the liquid surface between the upper limit position and the bottom. Since the supply portion supplies the second liquid to the liquid receiving portion via the waste liquid flow path coupled to the discharge port, it is possible to make it difficult for the liquid discharged from the discharge port and the waste liquid flow path to remain in the waste liquid flow path.

In the liquid ejecting apparatus, the maintenance portion may include a liquid collection portion collecting the liquid getting over the upper limit position, and a partition wall partitioning the liquid collection portion and the liquid receiving portion, and the liquid getting over the upper limit position may be collected in the liquid collection portion via the partition wall.

According to this configuration, the maintenance portion collects the liquid getting over the upper limit position in the liquid collection portion via the partition wall. That is, the maintenance portion can set the upper limit position according to the height of the partition wall, and can easily maintain the liquid surface of the liquid accommodated in the liquid receiving portion at the upper limit position.

There is provided a maintenance method for a liquid ejecting apparatus, the apparatus including a liquid ejecting portion configured to eject a first liquid from a nozzle, and a liquid receiving portion configured to receive, in a state where a second liquid is accommodated in the liquid receiving portion, for a purpose of maintenance of the liquid ejecting portion, the first liquid discharged from the nozzle, the method including an adjustment operation of adjusting a position of a liquid surface of a liquid accommodated in the liquid receiving portion, a liquid discharge operation of discharging the first liquid from the nozzle toward the liquid receiving portion after the adjustment operation, and a waste liquid discharge operation of discharging, from the liquid receiving portion, the liquid in the liquid receiving portion.

According to this method, after adjusting the position of the liquid surface of the liquid accommodated in the liquid receiving portion by the adjustment operation, the first liquid is discharged from the nozzle by the liquid discharge operation and the liquid ejecting portion is maintained. Therefore, the maintenance of the liquid ejecting portion can be performed with the specifications changed.

In the maintenance method for a liquid ejecting apparatus, in the liquid discharge operation, the first liquid may be discharged from the nozzle toward the liquid surface of the liquid accommodated in the liquid receiving portion.

According to this method, in the liquid discharge operation, the first liquid is discharged from the nozzle toward the liquid surface of which position is adjusted by the adjustment operation. Therefore, the occurrence of mist or splashing can be reduced, and the risk of contaminating the surroundings can be reduced.

In the maintenance method for a liquid ejecting apparatus, the liquid ejecting portion may eject, from the nozzle, by driving an actuator, the first liquid in a pressure chamber communicating with the nozzle, and as the liquid discharge operation, flushing of discharging the first liquid from the nozzle may be performed by driving the actuator.

When flushing of discharging the first liquid from the nozzle is performed by driving the actuator, mist may occur. In that respect, according to this method, since the flushing is performed in a state where the position of the liquid surface is adjusted, the occurrence of mist can be reduced.

In the maintenance method for a liquid ejecting apparatus, the liquid ejecting apparatus may further include a pressurizing mechanism configured to pressurize the first liquid to supply the first liquid to the liquid ejecting portion, and as the liquid discharge operation, pressurization cleaning of discharging the first liquid that is pressurized from the nozzle may be performed by driving the pressurizing mechanism.

According to this method, the pressurization cleaning is performed in a state where the position of the liquid surface is adjusted. Therefore, for example, the pressurization cleaning can be performed while reducing the possibility that the liquid surface and the nozzle surface meet by the first liquid.

In the maintenance method for a liquid ejecting apparatus, in the liquid discharge operation, a first gap between the liquid surface of the liquid accommodated in the liquid receiving portion when the flushing is performed and a nozzle surface of the liquid ejecting portion on which the nozzle is formed may be smaller than a second gap between the liquid surface obtained when the pressurization cleaning is performed and the nozzle surface.

According to this method, since the first gap between the liquid surface obtained when the flushing is performed and the nozzle surface is smaller than the second gap when the pressurization cleaning is performed, the occurrence of mist due to the flushing can be reduced. Since the second gap between the liquid surface obtained when the pressurization cleaning is performed and the nozzle surface is greater than the first gap, it is possible to reduce the possibility that the liquid surface and the nozzle surface meet by the first liquid discharged from the nozzle. Therefore, flushing or pressurization cleaning can be performed under appropriate conditions.

In the maintenance method for a liquid ejecting apparatus, the liquid ejecting apparatus may further include a pressurizing mechanism configured to pressurize the first liquid to supply the first liquid to the liquid ejecting portion, and a wiping mechanism that wipes a nozzle surface on which the nozzle is formed, in the liquid discharge operation, the pressurizing mechanism may pressurize the first liquid to discharge the first liquid from the nozzle, and the method may further include a contact operation of bringing the first liquid expanded from the nozzle surface by the liquid discharge operation into contact with the liquid in the liquid receiving portion, and a wiping operation of wiping the nozzle surface after the contact operation.

According to this method, in the contact operation, the first liquid expanded from the nozzle surface is brought into contact with the liquid in the liquid receiving portion. For example, when the lyophilic property of the nozzle surface is high, the second liquid in the liquid receiving portion is pulled up to the nozzle surface by the contact operation. Therefore, since the second liquid can be supplied to the nozzle surface, the nozzle surface is wiped such that foreign substances adhering to the nozzle surface can be easily removed.

In the maintenance method for a liquid ejecting apparatus, the liquid discharge operation may be performed while causing the liquid accommodated in the liquid receiving portion to flow.

According to this configuration, in the liquid discharge operation, the first liquid is discharged from the nozzle while causing the liquid accommodated in the liquid receiving portion to flow. Therefore, it is possible to reduce the possibility that the first liquid is increased in viscosity or solidified to stay in the liquid receiving portion.

What is claimed is:

1. A liquid ejecting apparatus comprising:

a liquid ejecting portion configured to eject a first liquid from a nozzle;

a liquid receiving portion configured to receive, in a state where a second liquid is accommodated in the liquid receiving portion, for a purpose of maintenance of the liquid ejecting portion, the first liquid discharged from the nozzle;

a maintenance portion that maintains a liquid surface of a liquid accommodated in the liquid receiving portion at an upper limit position; and a discharge portion configured to discharge, from a discharge port open to the liquid receiving portion, the liquid accommodated in the liquid receiving portion, wherein the discharge port is positioned below the upper limit position, wherein the maintenance portion includes a liquid collection portion that collects the liquid getting over the upper limit position, and a partition wall that partitions the liquid collection portion and the liquid receiving portion, and wherein the liquid getting over the upper limit position is collected in the liquid collection portion via the partition wall.

2. A liquid ejecting apparatus comprising:

a liquid ejecting portion configured to eject a first liquid from a nozzle;

a liquid receiving portion configured to receive, in a state where a second liquid is accommodated in the liquid receiving portion, for a purpose of maintenance of the liquid ejecting portion, the first liquid discharged from the nozzle;

a maintenance portion that maintains a liquid surface of a liquid accommodated in the liquid receiving portion at an upper limit position; and a discharge portion configured to discharge, from a discharge port open to the liquid receiving portion, the liquid accommodated in the liquid receiving portion, wherein the discharge port is positioned below the upper limit position, wherein the discharge portion has a waste liquid flow path coupled to the discharge port open at a bottom of the liquid receiving portion, and wherein the liquid ejecting apparatus further comprises a supply portion that supplies the second liquid to the liquid receiving portion via the waste liquid flow path.

3. A maintenance method for a liquid ejecting apparatus, the apparatus including a liquid ejecting portion configured to eject a first liquid from a nozzle, and a liquid receiving portion configured to receive, in a state where a second liquid is accommodated in the liquid receiving portion, for a purpose of maintenance of the liquid ejecting portion, the first liquid discharged from the nozzle, wherein the liquid receiving portion includes a liquid collection portion that collects liquid getting over an upper limit position, and a partition wall that partitions the liquid collection portion and the liquid receiving portion, and wherein the liquid getting over the upper limit position is collected in the liquid collection portion via the partition wall, the method comprising:

an adjustment operation of adjusting a position of a liquid surface of a liquid accommodated in the liquid receiving portion;

a liquid discharge operation of discharging the first liquid from the nozzle toward the liquid receiving portion after the adjustment operation; and a waste liquid discharge operation of discharging the liquid in the liquid receiving portion from the liquid receiving portion.

4. The maintenance method for a liquid ejecting apparatus according to claim 3, wherein in the liquid discharge operation, the first liquid is discharged from the nozzle toward the liquid surface of the liquid accommodated in the liquid receiving portion.

5. The maintenance method for a liquid ejecting apparatus according to claim 4, wherein the liquid ejecting portion ejects, from the nozzle, by driving an actuator, the first liquid in a pressure chamber communicating with the nozzle, and as the liquid discharge operation, flushing of discharging the first liquid from the nozzle is performed by driving the actuator.

6. The maintenance method for a liquid ejecting apparatus according to claim 5, wherein the liquid ejecting apparatus further includes a pressurizing mechanism configured to pressurize the first liquid to supply the first liquid to the liquid ejecting portion, and as the liquid discharge operation, pressurization cleaning of discharging the first liquid that is pressurized from the nozzle is performed by driving the pressurizing mechanism.

7. The maintenance method for a liquid ejecting apparatus according to claim 6, wherein in the liquid discharge operation, a first gap between the liquid surface of the liquid accommodated in the liquid receiving portion when the flushing is performed and a nozzle surface of the liquid ejecting portion on which the nozzle is formed is smaller than a second gap between the liquid surface obtained when the pressurization cleaning is performed and the nozzle surface.

8. The maintenance method for a liquid ejecting apparatus according to claim 3, wherein the liquid ejecting apparatus further includes a pressurizing mechanism configured to pressurize the first liquid to supply the first liquid to the liquid ejecting portion, and a wiping mechanism that wipes a nozzle surface on which the nozzle is formed, and in the liquid discharge operation, the pressurizing mechanism pressurizes the first liquid to discharge the first liquid from the nozzle, the method further comprising:

a contact operation of bringing the first liquid expanded from the nozzle surface by the liquid discharge operation into contact with the liquid in the liquid receiving portion; and a wiping operation of wiping the nozzle surface after the contact operation.

9. The maintenance method for a liquid ejecting apparatus according to claim 3, wherein the liquid discharge operation is performed while causing the liquid accommodated in the liquid receiving portion to flow.

* * * * *